US011940225B1

(12) United States Patent
Kim et al.

(10) Patent No.: US 11,940,225 B1
(45) Date of Patent: Mar. 26, 2024

(54) ENERGY STORAGE SYSTEMS

(71) Applicant: Higher Dimension Materials, Inc., St. Paul, MN (US)

(72) Inventors: Young-Hwa Kim, Hudson, WI (US); Richard Dale Olmsted, Vadnais Heights, MN (US)

(73) Assignee: Higher Dimension Materials, Inc., St. Paul, MN (US)

( * ) Notice: Subject to any disclaimer, the term of this patent is extended or adjusted under 35 U.S.C. 154(b) by 0 days.

(21) Appl. No.: 18/348,916

(22) Filed: Jul. 7, 2023

(51) Int. Cl.
*F28D 20/00* (2006.01)

(52) U.S. Cl.
CPC .. *F28D 20/0056* (2013.01); *F28D 2020/0082* (2013.01)

(58) Field of Classification Search
CPC ..... F24H 7/062; F28D 20/021; F28D 20/028; F28D 2020/0082
See application file for complete search history.

(56) References Cited

U.S. PATENT DOCUMENTS

| | | | | |
|---|---|---|---|---|
| 7,425,807 | B1 | 9/2008 | Perkins et al. | |
| 10,012,113 | B2 | 7/2018 | Vamvas | |
| 11,451,112 | B2 | 9/2022 | Kim et al. | |
| 11,585,571 | B1 | 2/2023 | Kim et al. | |
| 2006/0059937 | A1 | 3/2006 | Perkins et al. | |
| 2008/0289793 | A1* | 11/2008 | Geiken | F24S 80/20 165/10 |
| 2011/0114406 | A1 | 5/2011 | Gibson et al. | |
| 2011/0219771 | A1 | 9/2011 | Stiesdal | |
| 2011/0263384 | A1 | 10/2011 | Drazan | |
| 2013/0241203 | A1 | 9/2013 | Kleen et al. | |
| 2014/0093757 | A1 | 4/2014 | Sakai et al. | |
| 2015/0167489 | A1 | 6/2015 | Heiligenstein et al. | |
| 2015/0308410 | A1 | 10/2015 | Goldstein | |
| 2017/0201113 | A1 | 7/2017 | Gazit | |
| 2019/0017443 | A1 | 1/2019 | Eifert | |

(Continued)

FOREIGN PATENT DOCUMENTS

| | | |
|---|---|---|
| CN | 113465432 | 10/2021 |
| DE | 102015111235 | 9/2016 |

(Continued)

*Primary Examiner* — Dana Ross
*Assistant Examiner* — Joe E Mills, Jr.
(74) *Attorney, Agent, or Firm* — Fish & Richardson P.C.

(57) ABSTRACT

Heat energy storage systems described herein can be used for long-term storage of large amounts of thermal energy. In some cases, such systems receive electrical energy from renewable energy sources such as solar or wind. Using novel techniques, the heat energy storage systems covert the electrical energy to thermal energy that is stored in hot materials such as molten silicon or any other material that can store large amounts of heat. The heat energy storage systems incorporate extremely good thermal insulation of the thermal energy storage tank that contains the hot materials. The systems are also configured to release thermal energy in an efficient manner to one or more electricity-producing steam turbines and/or to one or more industrial heating systems of manufacturing plants, using novel heat exchanger systems and techniques described herein. The energy storage systems described herein have higher overall real-world efficiencies than energy storage systems currently available.

23 Claims, 34 Drawing Sheets

(56) References Cited

U.S. PATENT DOCUMENTS

| | | | | |
|---|---|---|---|---|
| 2020/0132393 | A1 | 4/2020 | Phillips et al. | |
| 2021/0348554 | A1* | 11/2021 | Johnson | F02C 6/00 |
| 2022/0166287 | A1 | 5/2022 | Kim et al. | |
| 2023/0086892 | A1* | 3/2023 | Robertson | F28D 20/0056 219/201 |

FOREIGN PATENT DOCUMENTS

| | | |
|---|---|---|
| WO | WO 2018215808 | 11/2018 |
| WO | WO 2020244809 | 12/2020 |

* cited by examiner

ENERGY STORAGE SYSTEMS

BACKGROUND

Technical Field

This disclosure relates to novel energy storage systems for long-term energy storage and include extensive energy loss mitigation means to enhance the efficiency of the long-term energy storage. This disclosure also relates to the integration of such energy storage systems with renewable energy sources (e.g., solar energy and/or wind energy) and working-fluid heating systems (e.g., steam/water heating systems) that can power an electricity-producing steam turbine.

Background Information

The Earth receives energy from the Sun that is more than 10,000 times the energy that all humans on the Earth consume. Wind energy is a derivative of the energy from the Sun. Yet, energy-hungry societies depend mostly on energy from burning fossil fuels. There is strong international pressure to reduce the consumption of fossil fuels and to switch to renewable energy sources such as solar or wind power.

The cost of renewable energy is now roughly equal to or lower than the cost of energy generated by fossil fuels. However, a serious challenge of renewable energy is that electricity generated by solar panels and wind turbines cannot be stored economically for long periods of time. This boils down to the need for long-term economic methods of storing large amounts of the energy from the Sun.

It is critically important to have energy storage systems ("ESS") that can store renewable energy from solar panels and/or wind turbines for many weeks or a few months. Such long term storage of large amounts of renewable energy from solar panels and/or wind turbines is necessary if a society wants to drastically reduce its dependence on energy from fossil fuels. Currently, battery-based ESS are widely used as ESS of renewable energy. However, the performance of battery-based ESS quickly deteriorates, and its service life is less than 10 years. Moreover, battery-based ESS depend on supply-limited materials such as lithium and nickel. The disposal of huge amounts of expired battery-based ESS is environmental disaster. These well-known shortcomings of battery-based ESS is a major reason why 'clean' energy from solar panels and/or wind turbines cannot yet substitute or reduce significantly the extensive use of energy from burning fossil fuels.

SUMMARY

This disclosure describes novel ESS for long-term storage of large amounts of thermal energy in hot materials. In some cases, such ESS receives electrical energy from renewable energy sources such as solar panels and/or wind turbines. Using novel techniques described below, the ESS converts the electrical energy to thermal energy that is stored in hot materials such as molten silicon. The ESS described herein incorporate extremely good thermal insulation of the thermal energy storage container that contains the hot materials. The ESS includes multiple means for mitigating radiative, conductive, and convective heat losses. Accordingly, the thermal energy storage is highly efficient. The ESS is also configured to release its thermal energy in an efficient manner to a working-fluid (e.g., water/steam) that can power an electricity-producing steam turbine using novel heat exchanger systems and techniques that are described below. Accordingly, when the ESS described below is integrated with an energy source (e.g., a renewable energy source) and a steam turbine electricity generator system, the ESS can provide highly efficient energy receipt, storage, and delivery. This type of ESS can greatly enhance the practical viability of renewable energy sources such as wind and solar.

In some embodiments, the ESS described herein store thermal energy in molten silicon. Such ESS are capable of storing energy received from solar panels or wind turbines as thermal energy in molten silicon and include extensive thermal insulation of the molten silicon with multi layers of thermal radiation shielding sheets of Molybdenum and/or stainless steel in a vacuum chamber. Silicon melts at about 1,415° C. Silicon has a very high heat of fusion. In the ESS described herein, several unique and novel ideas are applied for the rigorous minimization of losses of thermal energy from the molten silicon, and equally rigorous maximization of the thermal efficiency of how the silicon receives energy from solar panels and wind turbines and how the silicon heats working-fluids such as water/steam in its heat exchange tank. A major goal of ESS described herein is the maximum utilization of the exceptionally high heat of fusion of silicon by means of elaborate prevention/mitigation of heat transfer through thermal radiation between key parts of the ESS, and rigorous minimization of the losses of thermal energy of silicon through heat conduction through material-to-material contacts of various components. The new ESS described herein may be referred to as "YKES2."

In one aspect, this disclosure is directed to an ESS that includes a vacuum chamber; a container located within the vacuum chamber; a thermal energy storage medium located within the container; a heater located within the vacuum chamber; a heat receiver located within the vacuum chamber; a first radiation shield that is movably reconfigurable between: (i) a first position that separates the heater from the container and (ii) a second position in which the heater is exposed to the container; and a second radiation shield that is movably reconfigurable between: (i) a first position that separates the heat receiver from the container and (ii) a second position in which the container is exposed to the heat receiver.

Such an ESS can optionally include one or more of the following features. The energy storage system may also include thermal radiation shielding located between an inner wall of the vacuum chamber and the container. The thermal radiation shielding may also be located between the inner wall of the vacuum chamber and the heater. The thermal radiation shielding may also be located between the inner wall of the vacuum chamber and the heat receiver In some embodiments, the thermal radiation shielding comprises multiple layers of sheet material that are spaced apart from each other. The energy storage system may also include a first thermal radiation reflector, wherein the heater is located between the first thermal radiation reflector and the container. The energy storage system may also include a second thermal radiation reflector, wherein the heat receiver is located between the second thermal radiation reflector and the container. The energy storage system may also include one or more support members disposed between a bottom of the container and a bottom inner wall of the vacuum chamber. The support members may elevate and separate the container from the bottom inner wall of the vacuum chamber. In some embodiments, each one of the one or more support members comprises multiple pieces of thermal insulating material in a stacked arrangement. The thermal insulating material may comprise zirconia. The energy storage system may also include thermal radiation shielding located between an inner bottom wall of the vacuum chamber and the container. The thermal energy storage medium may comprise silicon. In some embodiments, the heater comprises a resistive heating element. The heater and the heat receiver may be each spaced apart from the container. The energy storage system may also include a first actuator coupled to the first radiation shield and operative to move the first radiation shield between: (i) the first position that separates the heater from the container and (ii) the second position in which the heater is exposed to the container. The energy storage system may also include a second actuator coupled to the second radiation shield and operative to move the second radiation shield between: (i) the first position that separates the heat receiver from the container and (ii) the second position in which the container is exposed to the heat receiver.

In another aspect, this disclosure is directed to an ESS that includes: a vacuum chamber; a container located within the vacuum chamber; a thermal energy storage medium located within an interior of the container; a heater located within the vacuum chamber and spaced apart from the container; a heat receiver located within the vacuum chamber and spaced apart from the container; and a protrusion extending from an inner wall of the container and in contact with the thermal energy storage medium.

Such an ESS may optionally include one or more of the following features. In some embodiments, the protrusion is a pyramid structure. In some embodiments, the 3D shape of the protrusion is not limiting to a pyramid structure. For example, in some embodiments the 3D shape of the protrusion can be a conical structure with circular bottom base and sharp top or a structure with polygonal bottom base and sharp top. The volume of the protrusion may be at least 10% of a volume of the interior of the container. The energy storage system may also include multiple layers of thermal radiation shielding surrounding the container and within the vacuum chamber.

In another aspect, this disclosure is directed to an ESS that includes a vacuum chamber; a container located within the vacuum chamber; a thermal energy storage medium located within the container; one or more heaters located within the vacuum chamber; a first heat receiver located within the vacuum chamber and operatively coupled with a first electricity generation system or a first industrial heating system; and a second heat receiver located within the vacuum chamber and operatively coupled with a second electricity generation system or a second industrial heating system. The heat transfer from the thermal energy storage medium to the first heat receiver is controllable independently from heat transfer from the thermal energy storage medium to the second heat receiver.

Particular embodiments of the subject matter described in this document can be implemented to realize one or more of the following advantages. The YKES2 described herein can store and keep energy from solar panels and/or wind turbines as thermal energy in molten silicon for many weeks or several months. The economic service life of the YKES2 described herein is expected to be more than 25 years. The YKES2 described herein do not depend on supply-limited materials such as lithium or rare materials. The disposal of expired of YKES2 after a long service life will not create environmental problems. The density of energy (watt-hours per kilogram) of silicon in YKES2 is much higher than the density of energy stored in battery-based ESS. There is an economy of large-scale capacity of YKES2, since the energy stored is determined by the volume which scales as the cube of the linear dimension of the container, whereas energy loss is determined by surface area (that scales quadratically with the linear dimension).

The YKES2 described herein maximize the density of thermal energy per unit weight and per volume by maximally utilizing physical principles of vacuum thermal insulation that essentially eliminates heat losses due to conventional insulation systems. The YKES2 incorporate novel heat exchange systems and techniques between heating devices and the thermal energy storage medium, as well as between the thermal energy storage medium and a heat receiver of a working-fluid for a steam turbine. Such systems and techniques enhance the efficiency of the radiative heat transfer process while such processes take place, and minimize the heat losses and inefficiencies when the processes are completed.

Further, the YKES2 described herein are advantageously designed to include structural support members that are optimized to reduce heat losses due to conduction. Moreover, the YKES2 described herein include highly-effective radiant barriers that virtually eliminate heat losses due to radiation. Accordingly, the efficiency and storage time of the YKES2 described herein is greatly enhanced in comparison to such systems known to date.

The performance of the YKES2 described herein does not decline no matter how frequently it is charged and discharged with energy for over many years (e.g., 20 years or more). In contrast, the performance of widely used battery ESS gradually decline each year, and the service life is only about 5 years to 8 years on average. The YKES2 described herein are alternative energy storage systems that can replace certain current applications of battery-based energy storage systems (e.g., lithium battery energy storage systems) as a more economically viable and more environmentally friendly large scale and long-term system for storing energy from renewable energy sources.

Unless otherwise defined, all technical and scientific terms used herein have the same meaning as commonly understood by one of ordinary skill in the art to which this disclosure pertains. In addition, the materials, methods, and examples of the embodiments described herein are illustrative only and not intended to be limiting.

The details of one or more embodiments of the invention are set forth in the accompanying drawings and the description herein. The scope and applicability the ESS described herein is/are not limited by any of the particular numbers that are mentioned in this disclosure. Other features, objects, and advantages of the invention will be apparent from the description and drawings, and from the claims.

BRIEF DESCRIPTION OF THE DRAWINGS

Like reference numbers represent corresponding parts throughout.

DETAILED DESCRIPTION

Figure 1:
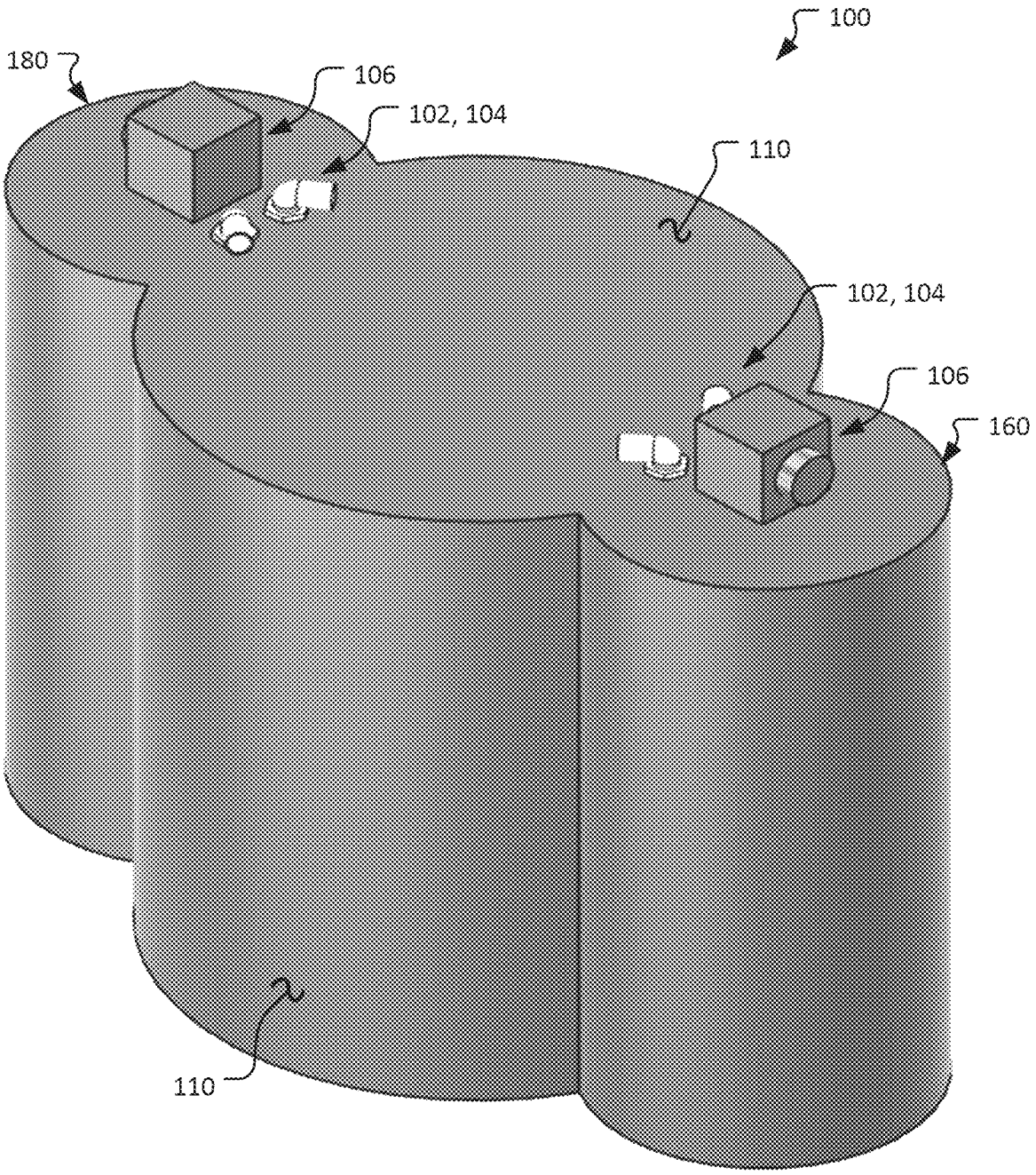
FIG. 1 is a perspective view of an example YKES2 in accordance with some embodiments described herein.

The YKES2, in its various forms and having its various features as described herein, can be used for long-term storage of large amounts of thermal energy in hot materials (e.g., molten silicon). In some cases, the YKES2 receives electrical energy from renewable energy sources such as solar panels and/or wind turbines. Using novel techniques described below, the YKES2 converts the electrical energy to thermal energy that is stored in the hot materials. The YKES2 described herein incorporate extremely good thermal insulation of the thermal energy storage container that contains the hot materials. The YKES2 includes multiple means for mitigating radiative, conductive, and convective heat losses. Accordingly, the thermal energy storage is highly efficient.

The thermal energy stored in YKES2 can be used for multiple different types of applications. A first example type of application is the heating of a working-fluid (water/steam) to power a steam turbine that generates electricity. Another example type of application is the heating of materials which pass through industrial heating processes at manufacturing plants and the like. The YKES2 is configured for both the aforementioned types of applications (as well as others), using novel heat exchanger systems and techniques that are described below.

Accordingly, when the YKES2 as described below is integrated with an energy source (e.g., a renewable energy source), it can provide highly efficient energy receipt, energy storage, and energy delivery for the above mentioned two types of applications. The two types of applications of thermal energy stored in YKES2 can greatly enhance the practical viability of renewable energy sources such as wind and solar.

There is a major difference between the first type of application and the second type of application. The first type of application includes the conversion of thermal energy of YKES2 into electricity. Therefore, about 60% or more of the thermal energy of YKES2 is wasted when it is converted into electric energy. This is unavoidable due to the fundamental thermodynamic laws of heat engine. On the other hand, the second type of application is the transfer of the thermal energy of the YKES2 to thermal energy that is used in industrial heating processes. The second type of application is not subject to the fundamental thermodynamic laws of a heat engine. Therefore, the efficiency of the second type of application can be 80%~90% or even higher. Its efficiency depends on efficient thermal insulation of the processes that transfer thermal energy of YKES2 to thermal energy of the working-fluid of industrial heating processes.

Currently, industrial heating processes at large manufacturing plants are typically provided by heat generated by the burning of fossil fuels. In an industrialized nation, the total fossil-based energy used for industrial heating processes at manufacturing plants is comparable to, or larger than, the total fossil-based energy used for generation of electricity.

When renewable energy is stored as thermal energy in YKES2 (not as chemical energy of a battery-based ESS, nor as kinetic of flywheel-based ESS), the renewable energy can be readily used for generation of electricity or for heating of industrial heating processes. In contrast, when renewable energy is stored as chemical energy of a battery-based ESS or as kinetic energy of a flywheel-based ESS, the conversion of the stored energy into thermal energy for industrial heating processes is less efficient than the transfer of thermal energy stored in the YKES2 into thermal energy for the same industrial heating processes. This is because the conversion of chemical energy into thermal energy or the conversion of kinetic energy into thermal energy is subject to the thermodynamic laws of conversion of energy from one form to another. For the second type of application, thermal energy stored in YKES2 is used as thermal energy for industrial heating. It is not subject to the same thermodynamic laws of conversion of energy from one form to another.

This is a new and novel feature of YKES2. Molten-salt based ESS can be used for the first type application and also the second type of application similarly to YKES2. However, the energy density stored in molten silicon is more than 10 times larger than the energy density of molten-salt. This means that the volume of molten salt is about 13 times or more larger than the volume of molten silicon for the storage of the same amount of thermal energy (molten silicon is more dense). This means that a high degree of thermal insulation of molten silicon is much more difficult and much more expensive than the same high degree of thermal insulation of molten silicon for storage of the same amount of thermal energy. This is another novel feature of YKES2.

Accordingly for the first type application, when the YKES2 described below is integrated with an energy source (e.g., a renewable energy source), a steam turbine electricity generator system, and flywheel energy storage systems ("FESS") (optionally), the YKES2 can provide highly efficient energy receipt, storage, and delivery. This type of YKES2 can greatly enhance the practical viability of renewable energy sources such as wind and solar. For example, the YKES2 described herein can be advantageously integrated into broader systems of energy management, such as the hybrid energy storage systems described in U.S. patent application Ser. No. 17/530,219 filed on Nov. 18, 2021. In particular, the YKES2 described herein can be integrated into the disclosed hybrid energy storage systems by substituting the YKES2 for the molten salt energy storage system (e.g., reference number 120) that is a subsystem of the overall hybrid energy storage systems described therein. Integrating the YKES2 described herein in such a hybrid energy storage system provides a novel system that includes a hot body energy storage system, a steam temperature regulating system, a steam turbine system, and an ESS as an optional fourth subsystem. Such a hybrid energy storage system provides long-term storage of large amounts of energy received from solar and/or wind energy sources, and long-term continuous delivery of electricity to users when the electricity generated from the solar and/or wind energy sources is unavailable or interrupted due to causes such as day-and-night cycles, daily changes of weather, long periods of unfavorable weather such as several days of rains in summer and snowstorms in winter, or abrupt failures of the power grid of a city, building(s), a campus, and the like. Accordingly, U.S. patent application Ser. No. 17/530,219 is hereby incorporated by reference in its entirety and for all purposes.

For the second type of application, the inventor of the YKES2 described herein is not aware of any actual cases in which the thermal energy of molten silicon that is collected from renewable energy such as solar panels or wind turbines is used to heat industrial heating processes. Accordingly, it seems that the second type of applications of YKES2 is an entirely new and novel applications of renewable energy collected from solar panels and/or wind turbines.

Next, the major features of YKES2 will be succinctly described in reference to FIGS. 1-49. Following that, additional details regarding the YKES2 described herein will be provided.

FIG. 1 depicts an example heat energy storage system 100 (or YKES2 100). The YKES2 100 includes a vacuum chamber 110. Extending through the walls of the vacuum chamber 110 are electrical connections 102 and working fluid connections 104, which will be described further below. Additionally, radiation shield actuators 106 are visible, which will also be described further below.

In this view of the YKES2 100, essentially only the exterior wall surfaces of the vacuum chamber 110 are visible. The interior components of the YKES2 100 are depicted in the following figures.

The YKES2 100 includes the vacuum chamber 110 in order to enhance the thermal insulation of the YKES2 100. That is, the vacuum within the vacuum chamber 110 serves to reduce energy (heat) losses that could otherwise occur due to convective and conductive heat transfer.

The YKES2 100 is scalable to essentially any desired size. For example, in some embodiments the height of the YKES2 100 ranges from 1 meter to 3 meters, or 2 meters to 5 meters, or 3 meters to 6 meters, or 5 meters to 10 meters, or more than 10 meters, without limitation. The larger the size of the YKES2 100, the greater the thermal storage capacity.

Figure 2:
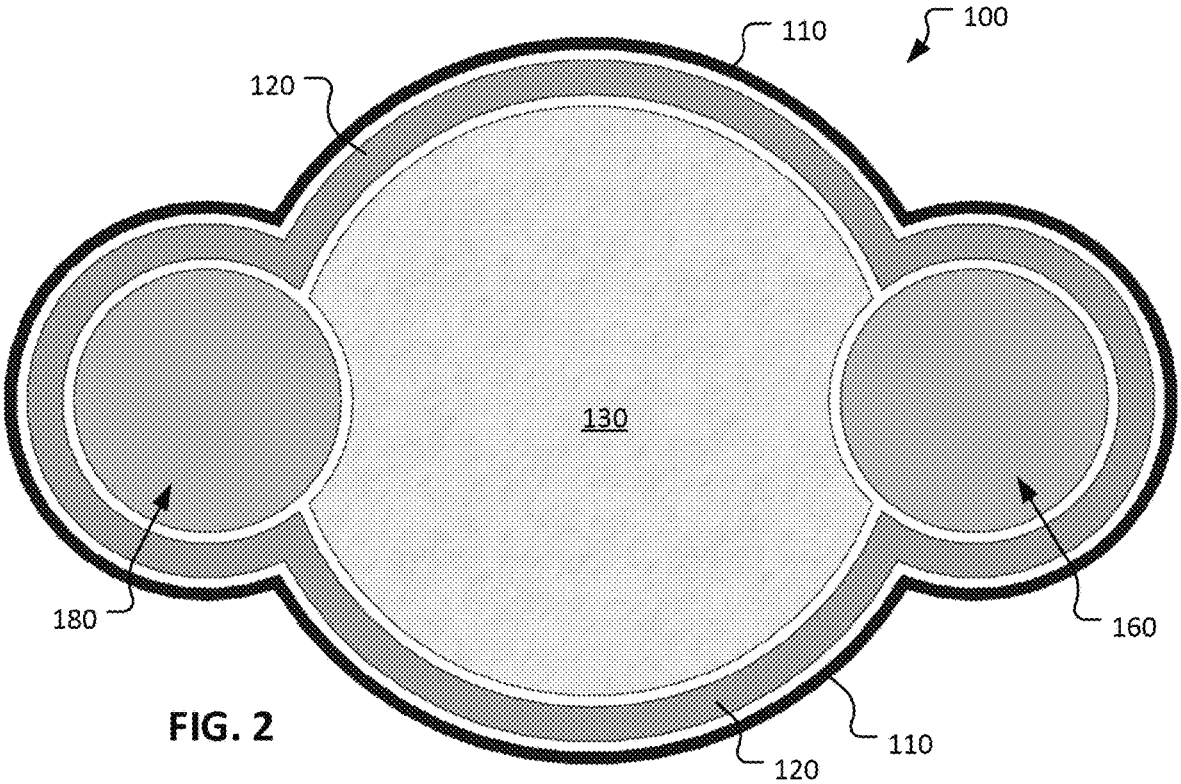
FIG. 2 is a transverse cross-sectional schematic view of the YKES2 of FIG. 1.

FIG. 2 shows a schematic transverse cross-section view of the YKES2 100. The YKES2 100 includes the vacuum chamber 110, thermal radiation shielding 120, a container 130, a heater assembly 160, and a heat receiver assembly 180. The thermal radiation shielding 120, the container 130, the heater assembly 160, and the heat receiver assembly 180 are all located within the vacuum chamber 110. The thermal radiation shielding 120 is located between an inner wall of the vacuum chamber 110 and the container 130, between the inner wall of the vacuum chamber 110 and the heater assembly 160, and between the inner wall of the vacuum chamber 110 and the heat receiver assembly 180. Moreover, the thermal radiation shielding 120 is also located between the top of the vacuum chamber 110 and: (i) the container 130, (ii) the heater assembly 160, and (iii) the heat receiver assembly 180. Still further, the thermal radiation shielding 120 is also located between the bottom of the vacuum chamber 110 and: (i) the container 130, (ii) the heater assembly 160, and (iii) the heat receiver assembly 180. Accordingly, the thermal radiation shielding 120 is interposed between all of the inner walls of the vacuum chamber 110 and: (i) the container 130, (ii) the heater assembly 160, and (iii) the heat receiver assembly 180. Because of that, there is very minimal radiative heat transfer to the vacuum chamber 110 from the components and assemblies that are located therein.

Figure 3:
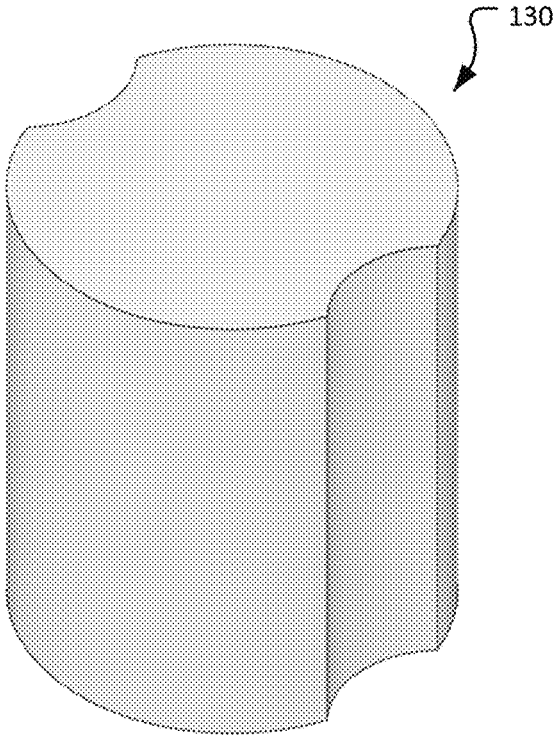
FIG. 3 is a perspective view of a thermal energy storage container of the YKES2 of FIG. 1.
Figure 4:
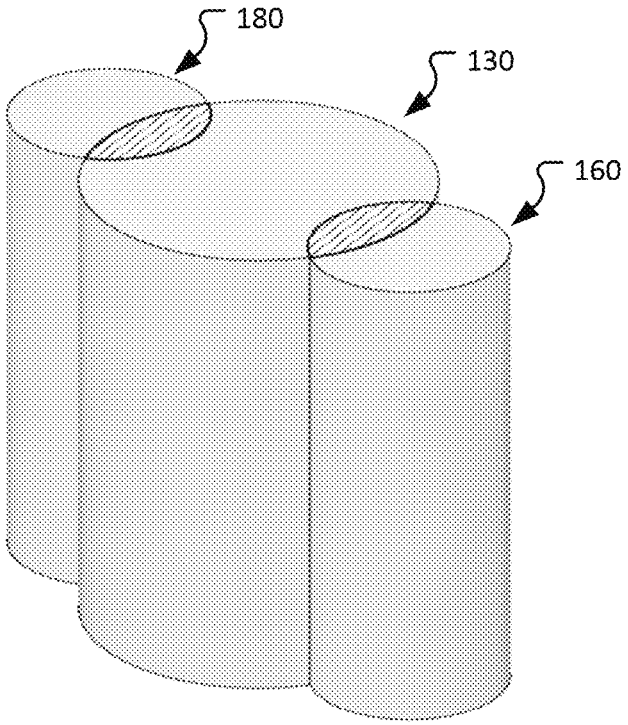
FIG. 4 shows an example combination of three cylinders that overlap and intersect each other.
Figure 6:
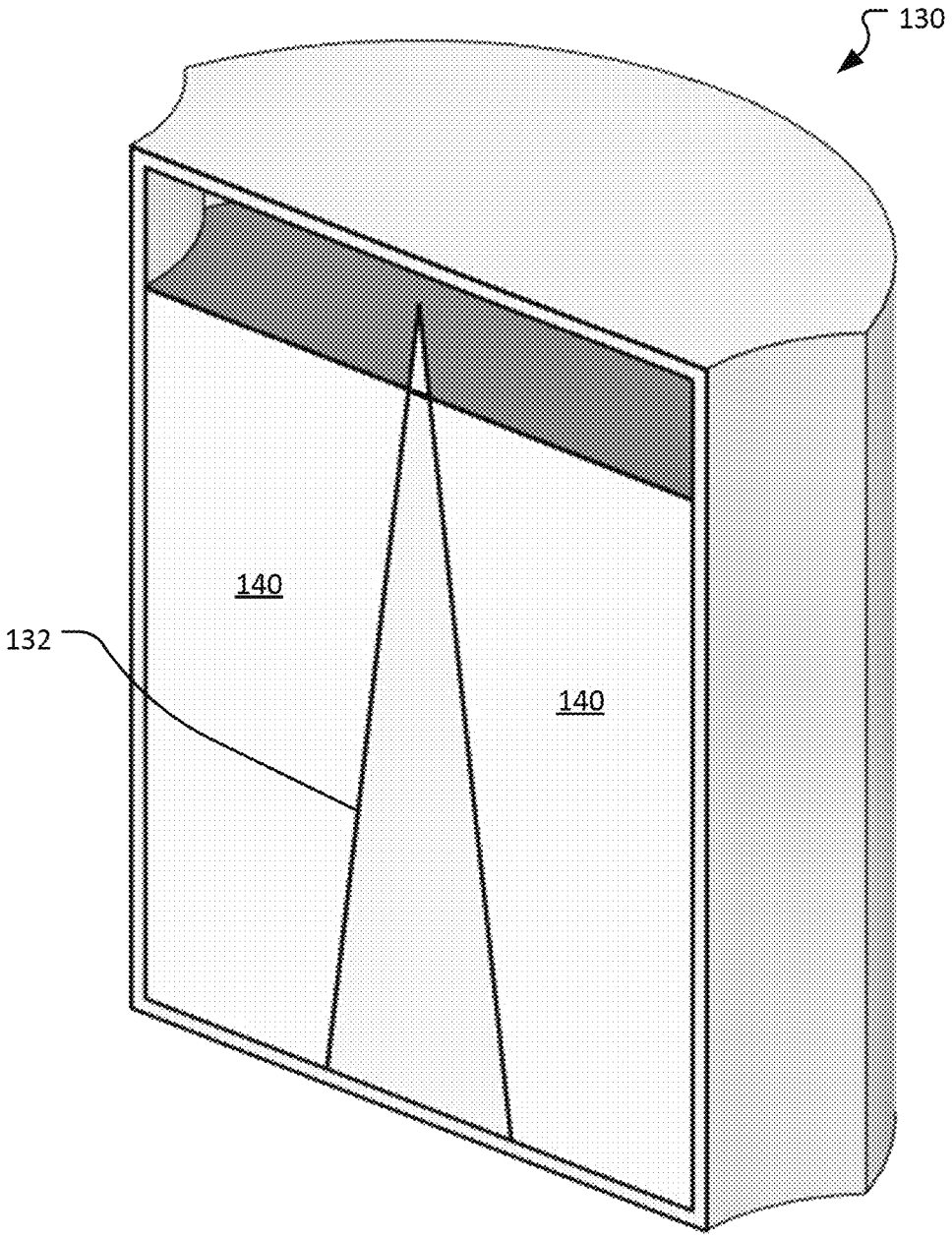
FIG. 6 is a perspective view of a longitudinal cross-section of the thermal energy storage container of FIG. 3 and including a thermal energy storage medium within the container.

FIG. 3 shows a perspective view of the container 130. A thermal energy storage medium is contained within the container 130 (e.g., as depicted in FIG. 6). In this embodiment, the container 130 is shaped as a cylinder with two concave longitudinal portions that are cut-out from the cylinder. FIG. 4 schematically shows how, in this embodiment of the YKES2 100, the heater assembly 160 and the heat receiver assembly 180 effectively extend into the two concave longitudinal cut-out portions of the container 130.

Figure 5:
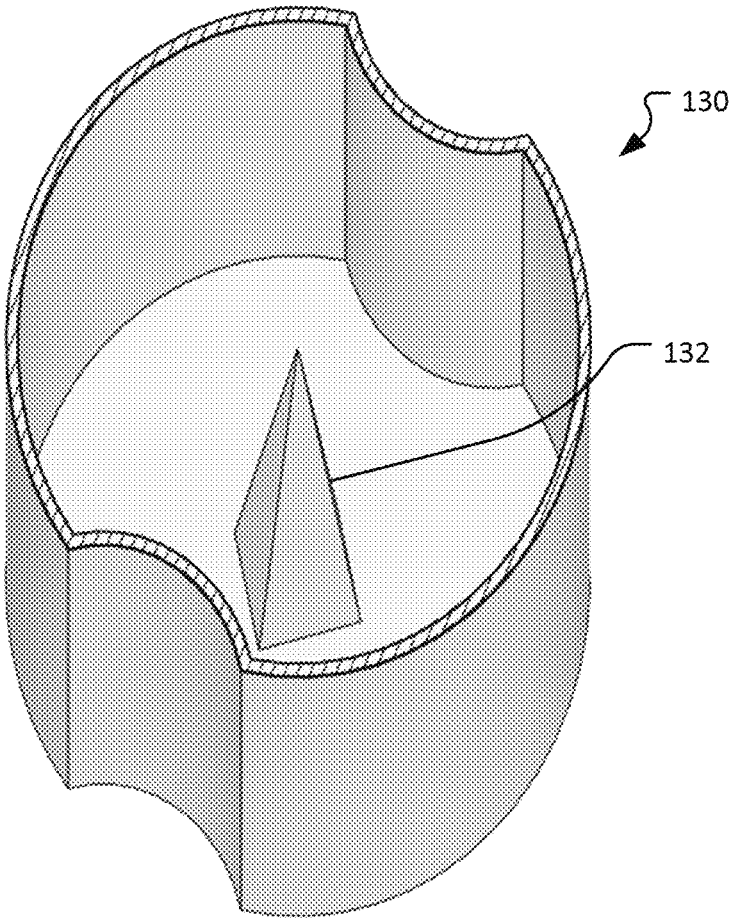
FIG. 5 is a perspective view of the thermal energy storage container of FIG. 3 without a top portion.
Figure 7:
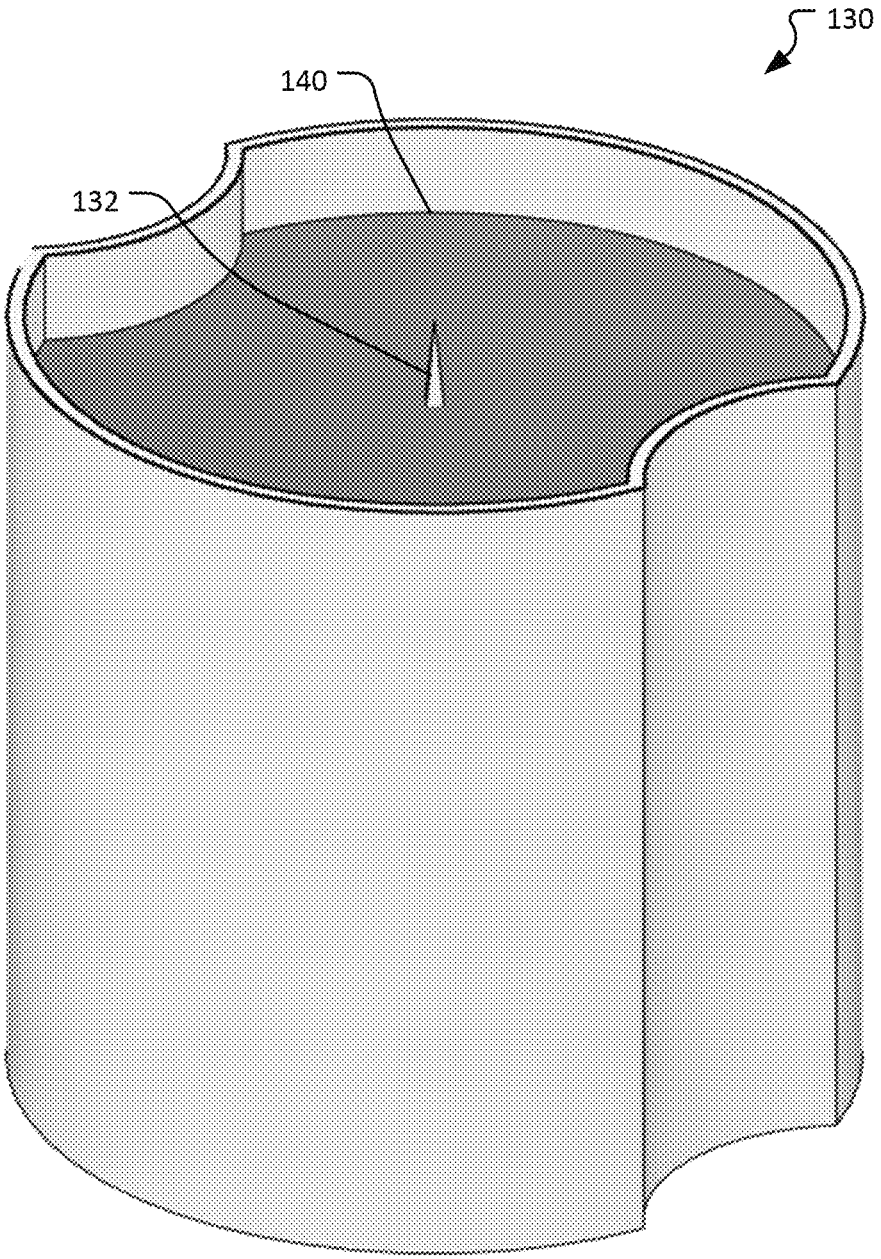
FIG. 7 is a perspective view of the thermal energy storage container of FIG. 3 without a top portion and including a thermal energy storage medium within the container.

FIG. 5 shows an example of the interior of the container 130. In this example, a protrusion 132 extends from the bottom inner wall surface of the container 130 up towards the top of the container 130. In this non-limiting example, the protrusion 132 is shaped like a four-sided pyramid structure. FIG. 6 shows a longitudinal cross-section view of the container 130 and the protrusion 132. In addition, a thermal energy storage medium 140 is shown within the container 130. The thermal energy storage medium 140 can be a material such as, but not limited to silicon. FIG. 7 shows another view of the container 130, protrusion 132, and the thermal energy storage medium 140.

FIGS. 8-13 are a series of figures that illustrate an example construction of the heater assembly 160 of the YKES2 100. A same or very similar construction can be used for the heat receiver assembly 180.

Figure 8:
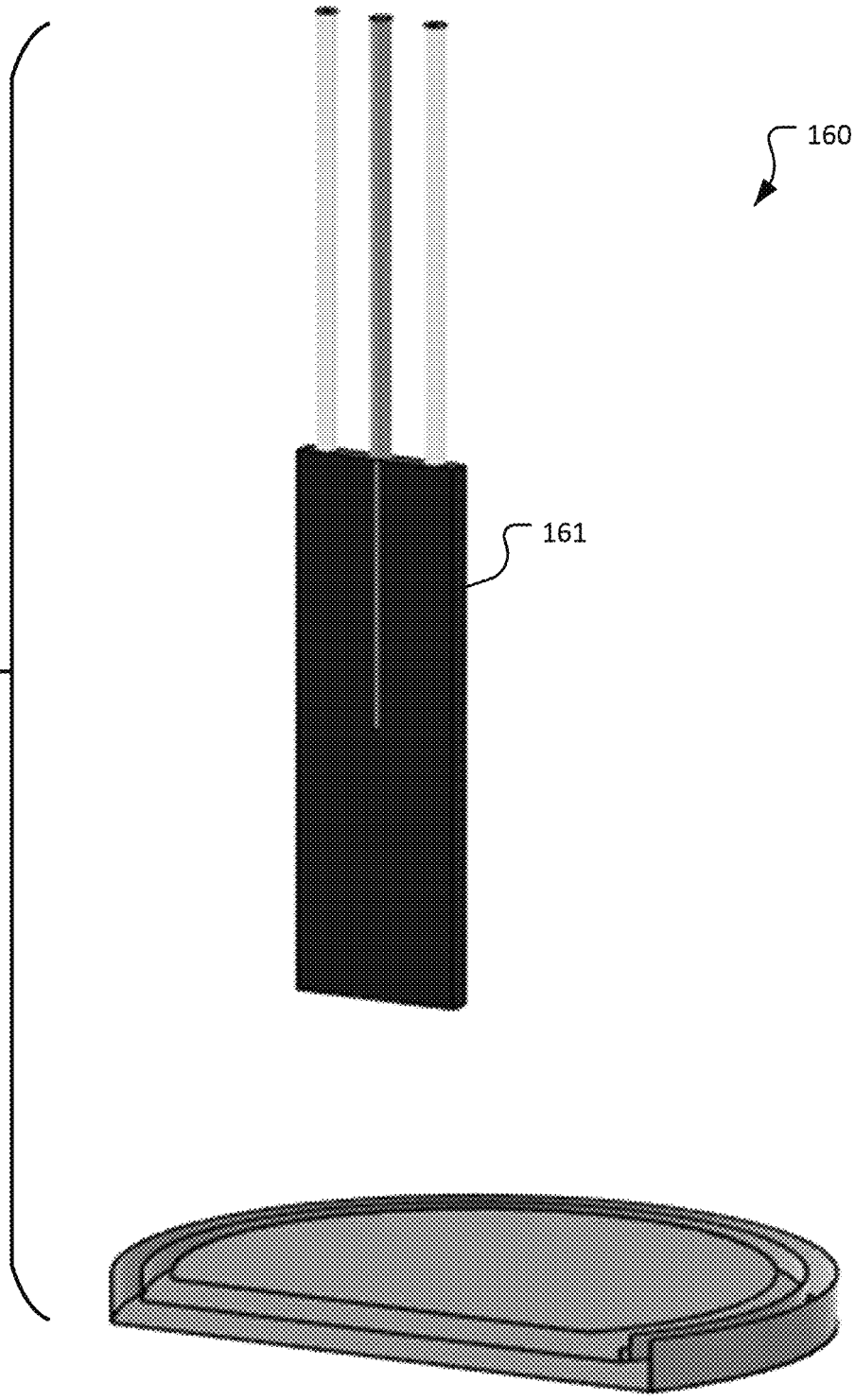
FIG. 8 is a perspective view of a portion of a heater assembly that can be used with the YKES2 of FIG. 1.

As shown in FIG. 8, the heater assembly 160 includes a heater 161. In some embodiments, the heater 161 is an electrical resistance heater (e.g., an Ohmic heater). In some embodiments, the heater 161 is supplied with electricity from a renewable energy source such as solar, wind, etc. When supplied with electricity, the temperature of the heater 161 increases.

Figure 9:
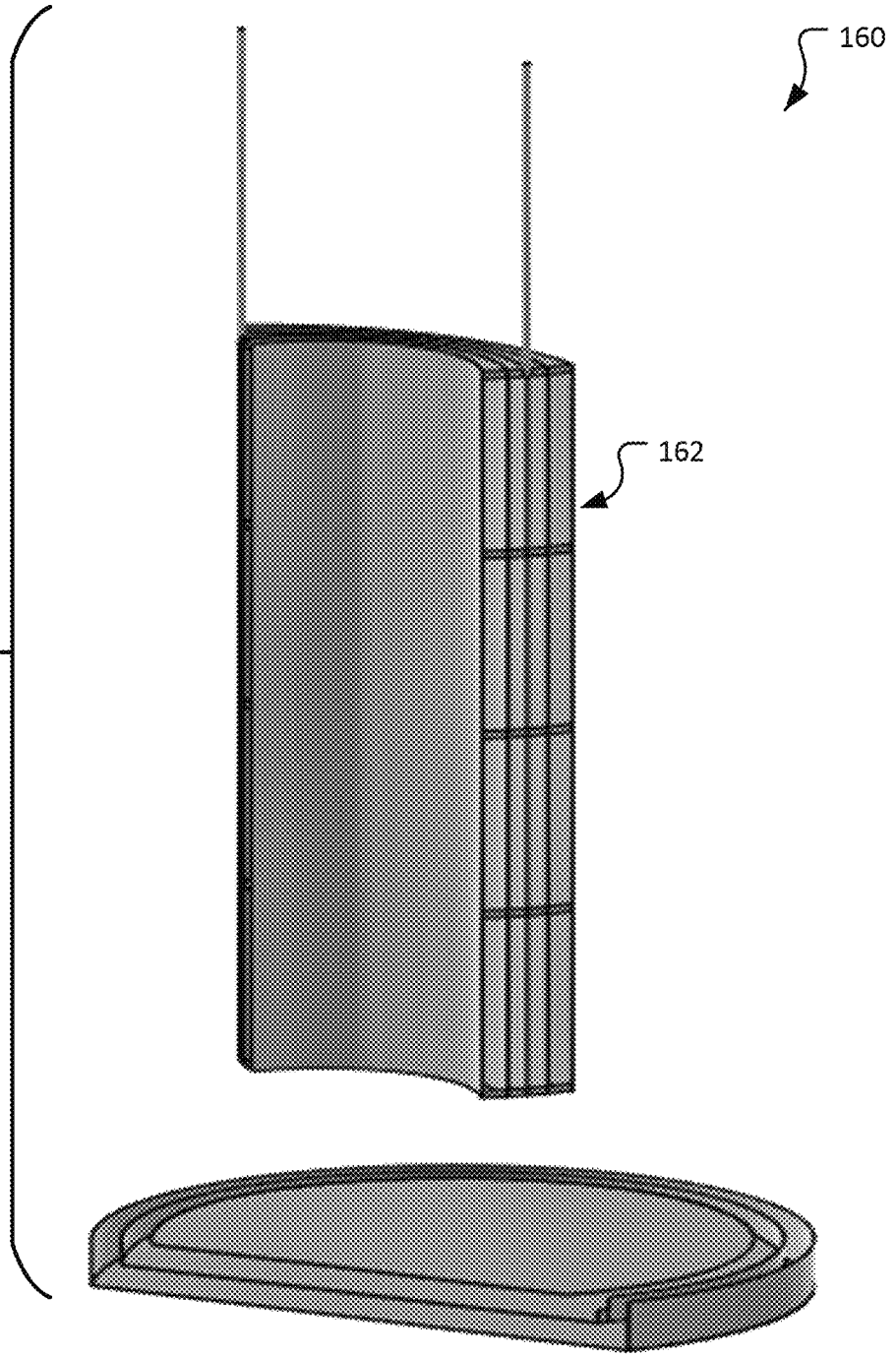
FIG. 9 is a perspective view of another portion of the heater assembly that can be used with the YKES2 of FIG. 1.

As shown in FIG. 9, the heater assembly 160 also includes a thermal radiation reflector 162. In some embodiments, the thermal radiation reflector 162 is positioned 'behind' the heater 161 (in relation to the container 130). The thermal radiation reflector 162 receives radiation from the heater 161 and reflects that radiation toward the container 130. Accordingly, the thermal radiation emitted from the heater 161 is directed toward the container 130 to the full extent reasonably possible.

Figure 10:
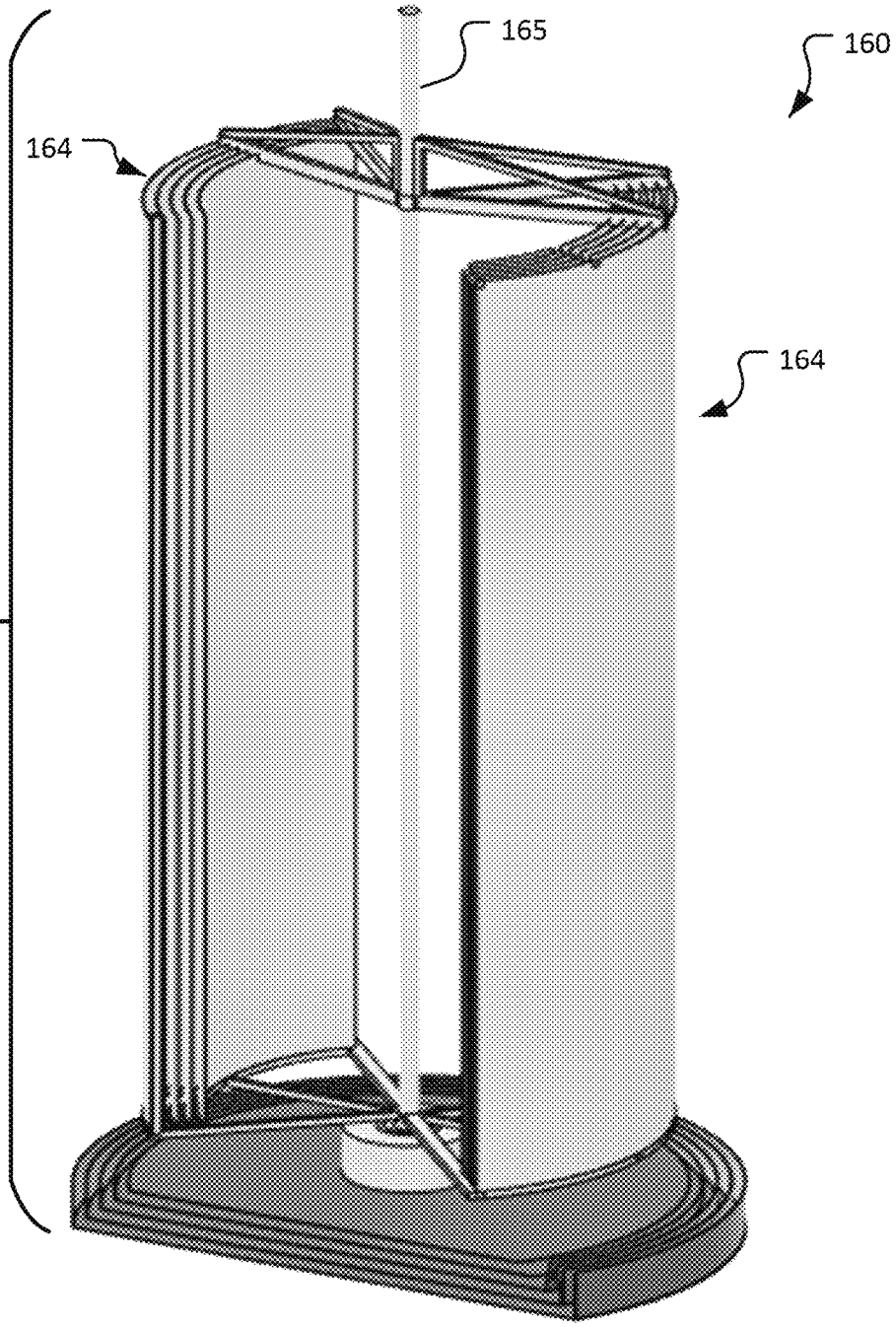
FIG. 10 is a perspective view of another portion of the heater assembly that can be used with the YKES2 of FIG. 1.

As shown in FIG. 10, the heater assembly 160 also includes a radiation shield 164. As described further below, the radiation shield 164 is movably reconfigurable between: (i) a first position that separates the heater 161 from the container 130 and (ii) a second position in which the heater 161 is exposed to the container 130. The reconfiguration of the radiation shield 164 is actuated by a power train that includes a shaft assembly 165 that can transmit mechanical force from one or more actuators (e.g., motors) located outside of (e.g., on top of) the vacuum chamber 110 to move the radiation shield 164.

Figure 11:
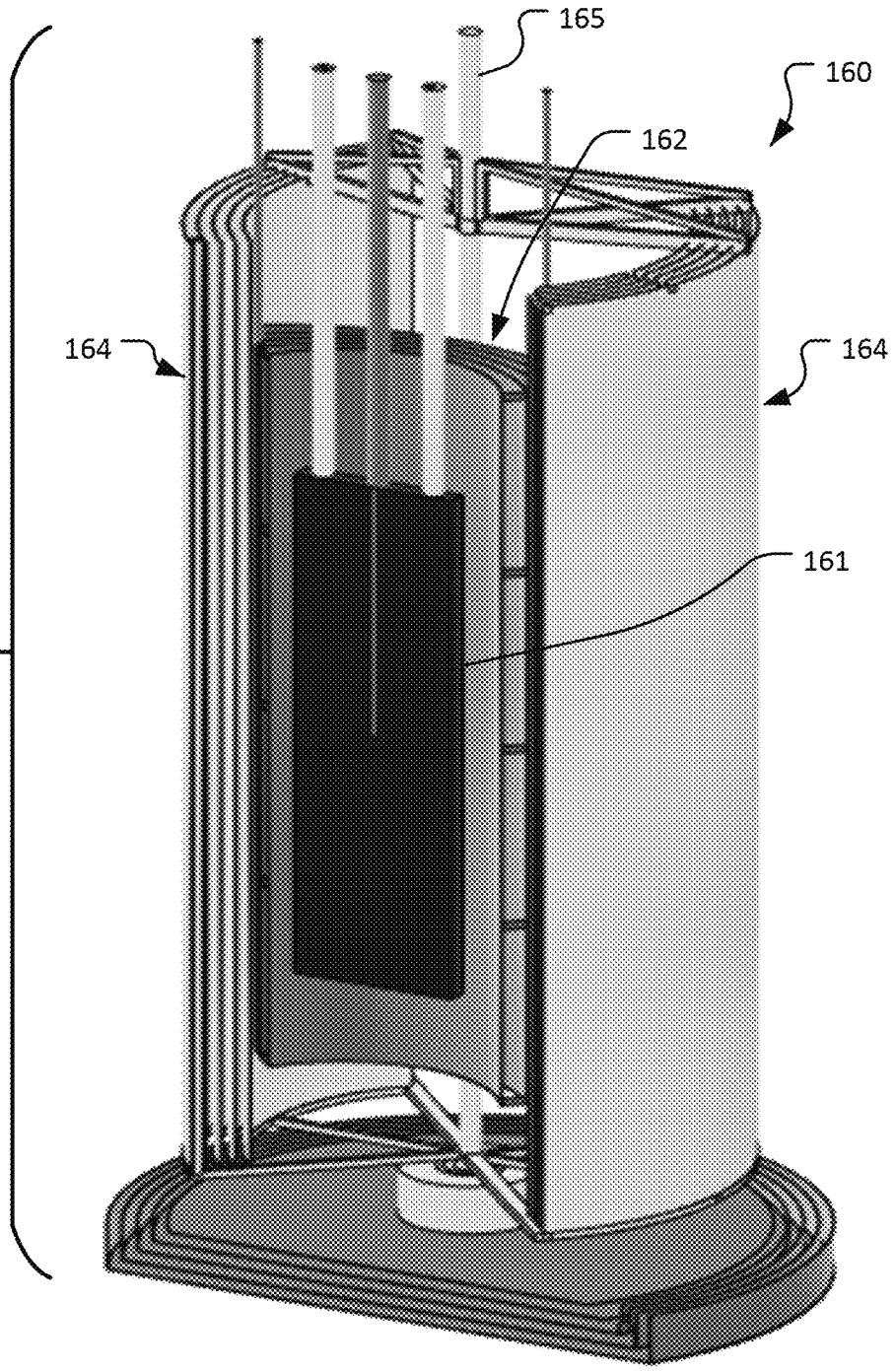
FIG. 11 is a perspective view of the portions shown in FIGS. 8-10 in combination with each other.

FIG. 11 shows a combination of the heater 161, the thermal radiation reflector 162, and the radiation shield 164. It can be seen that the position of the radiation shield 164 is allowing the heater 161 and the thermal radiation reflector 162 to be exposed in this arrangement (which means exposed toward the container 130).

Figure 12:
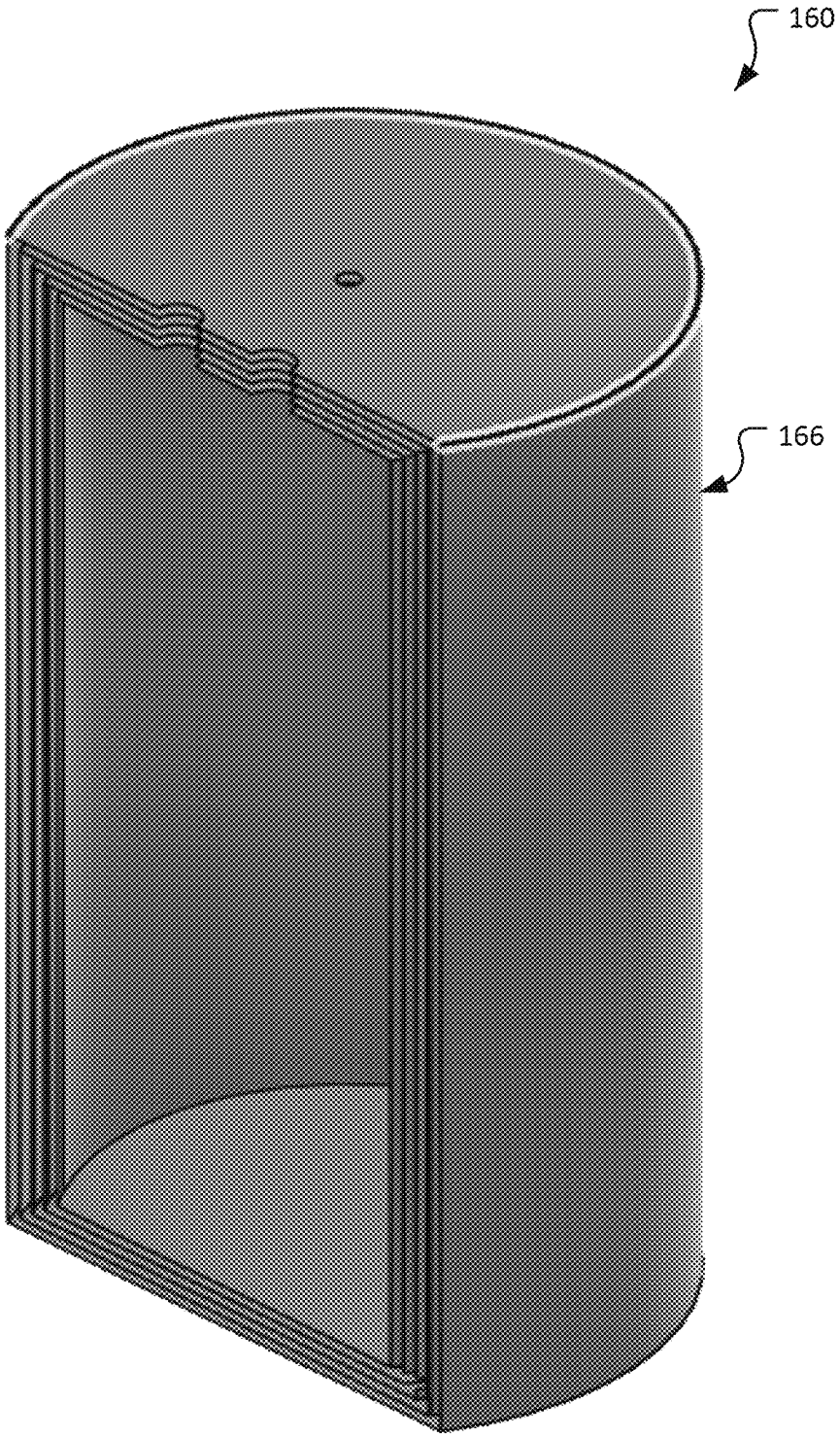
FIG. 12 is a perspective view of a radiation shield that can substantially cover the heater assembly that is used with the YKES2 of FIG. 1.

As shown in FIG. 12, the heater assembly 160 also includes thermal radiation shielding 166. The thermal radiation shielding 166 is disposed around the other components of the heater assembly 160 (around the components shown in FIG. 11). The outer walls of the thermal radiation shielding 166 face (but are separated from) the inner walls of the vacuum chamber 110.

Figure 13:
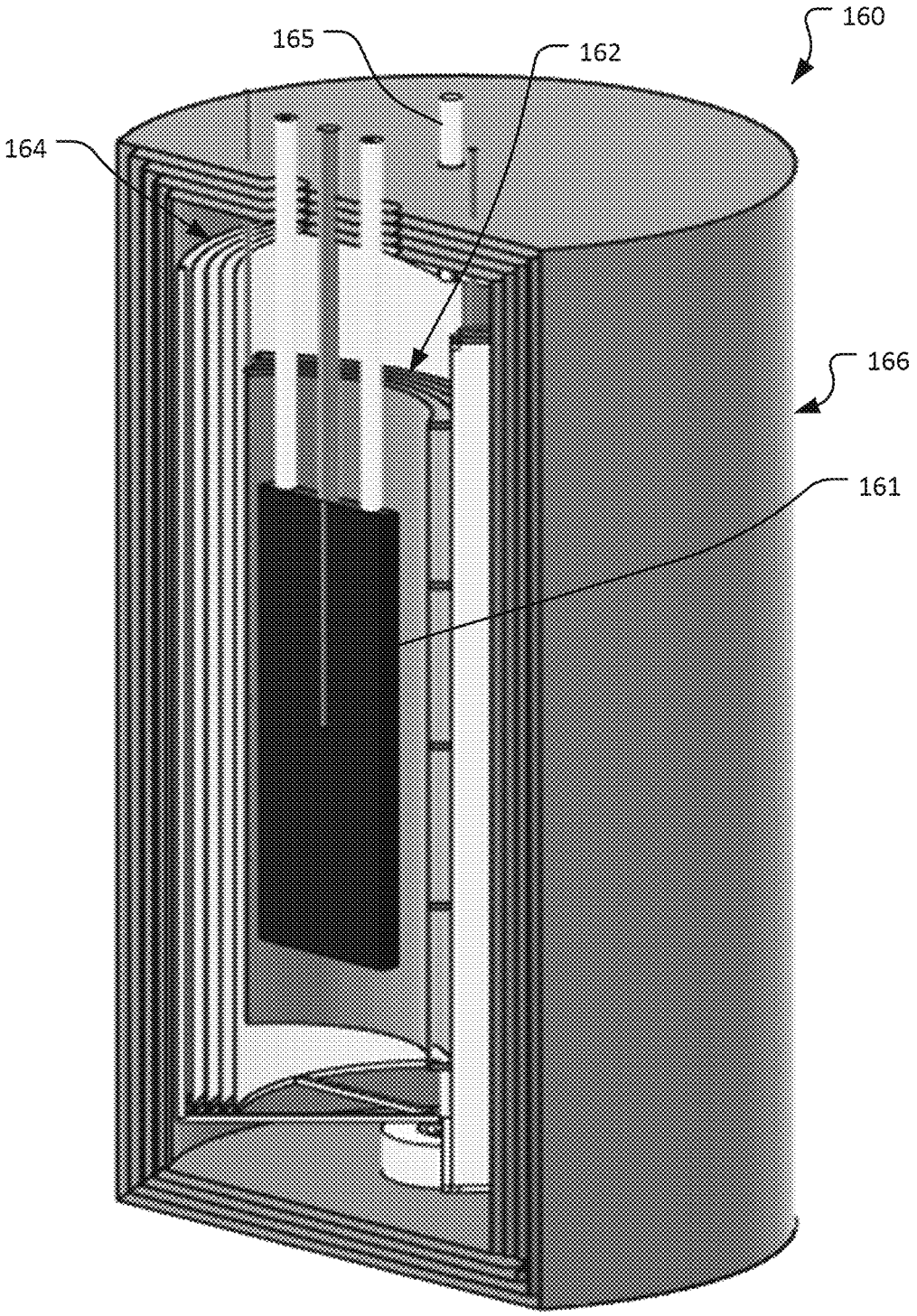
FIG. 13 is a perspective view of the portions shown in FIGS. 8-10 and 12 in combination with each other.

FIG. 13 shows the entire heater assembly 160.

Figure 14:
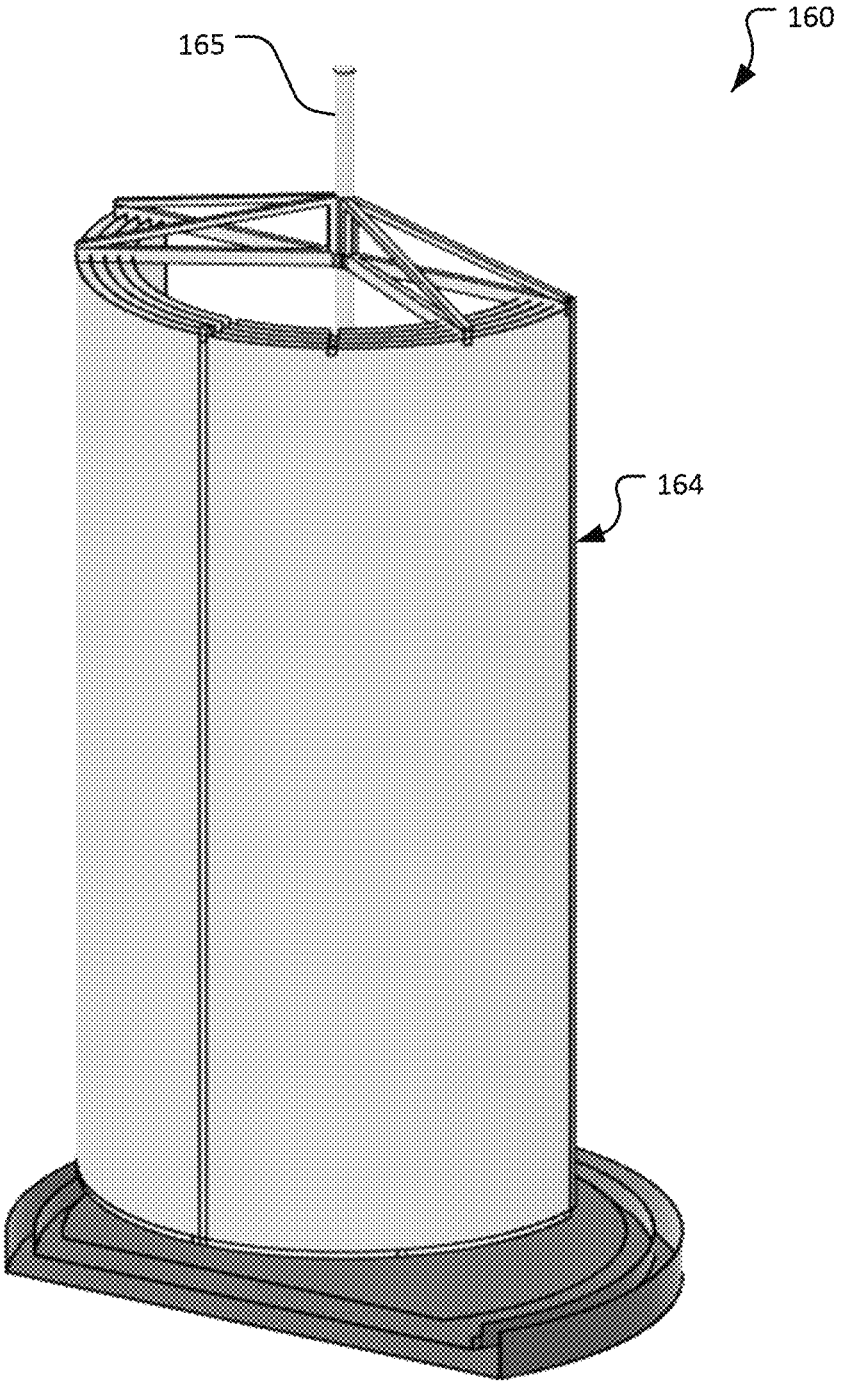
FIG. 14 is a perspective view of the portion shown in FIG. 10 after reconfiguration to a closed arrangement.
Figure 15:
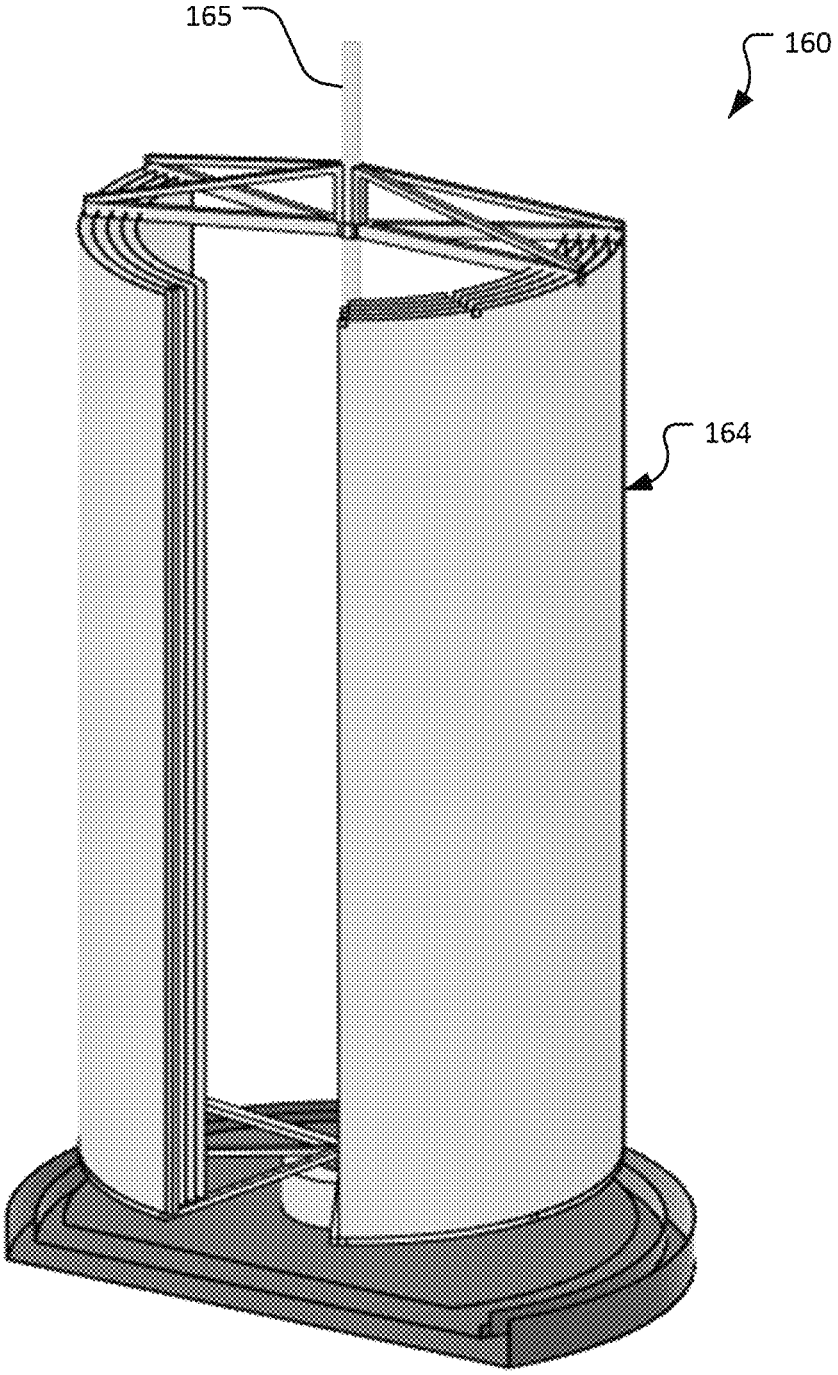
FIG. 15 is a perspective view of the portion shown in FIG. 10 after reconfiguration to a partially open arrangement.
Figure 16:
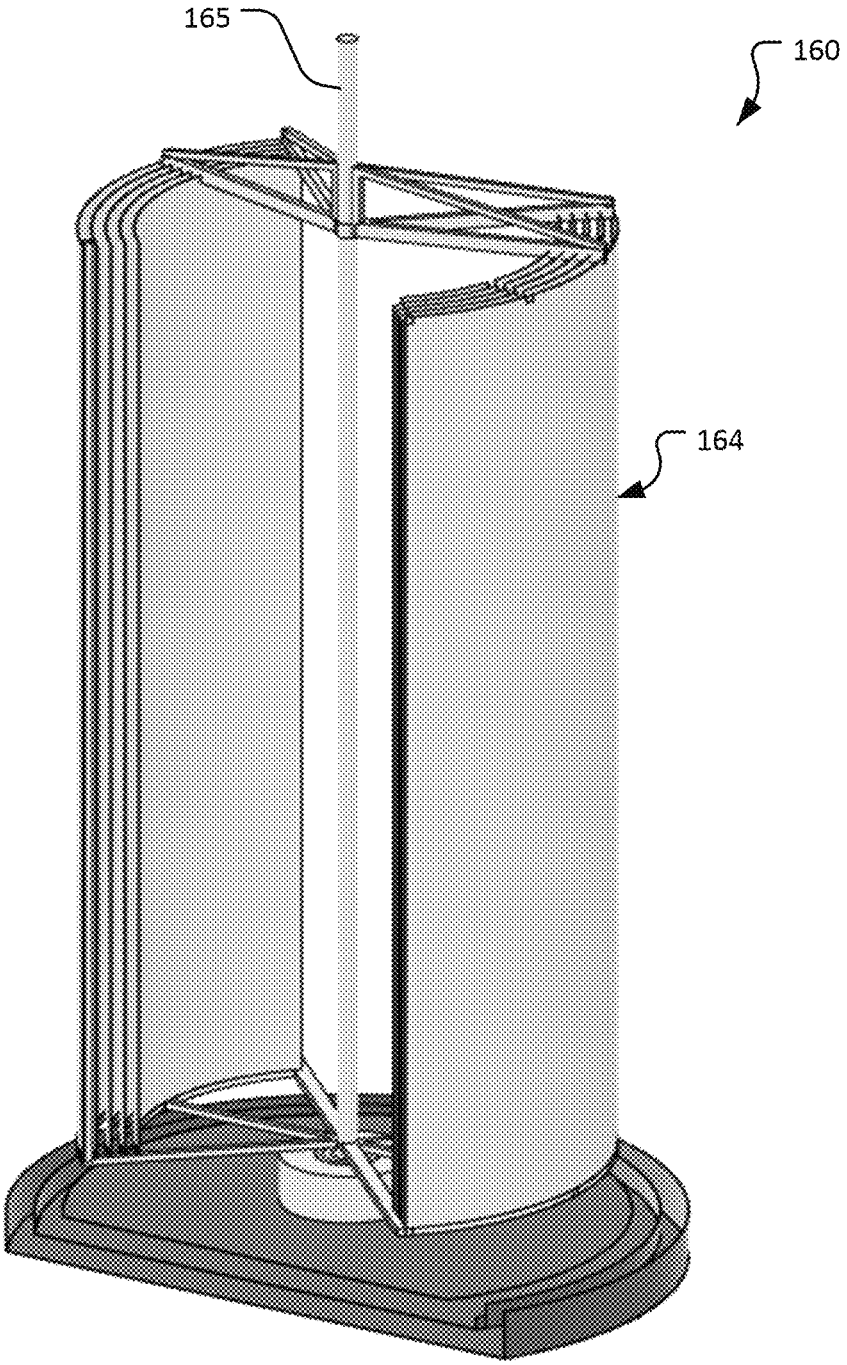
FIG. 16 is a perspective view of the portion shown in FIG. 10 in a fully open arrangement (as also shown in FIG. 10).

FIGS. 14-16 show the radiation shield 164 of the heater assembly 160 in various positions. FIG. 14 shows the radiation shield 164 in the closed position in which the heater 161 is separated from the container 130. FIG. 15 shows the radiation shield 164 in the partially open position in which the heater 161 is partially exposed to the container 130. FIG. 16 shows the radiation shield 164 in the fully open position in which the heater 161 is fully exposed to the container 130.

Figure 17:
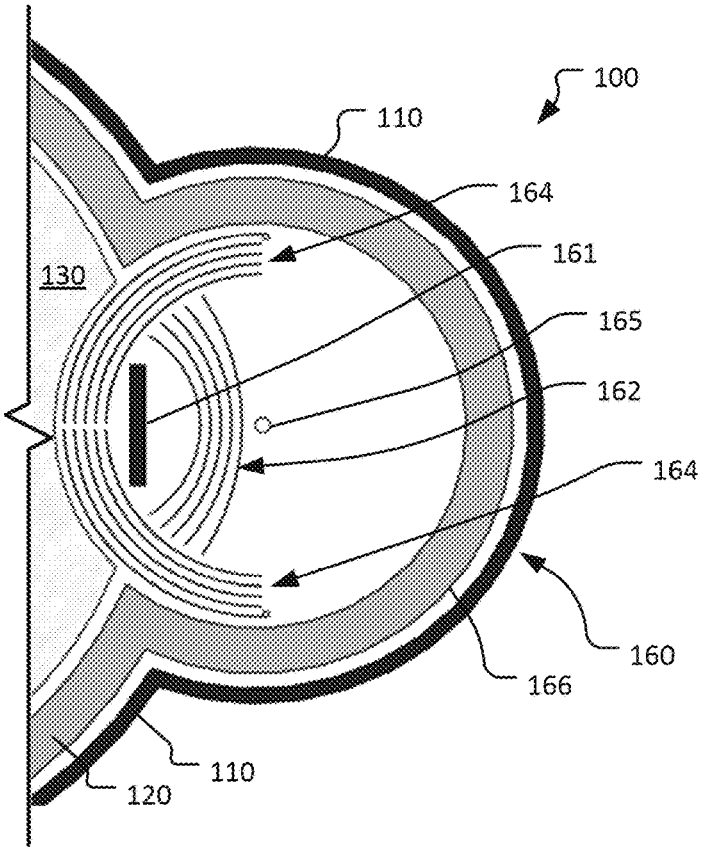
FIG. 17 is a schematic transverse cross-section view of the heater assembly in the closed arrangement.
Figure 18:
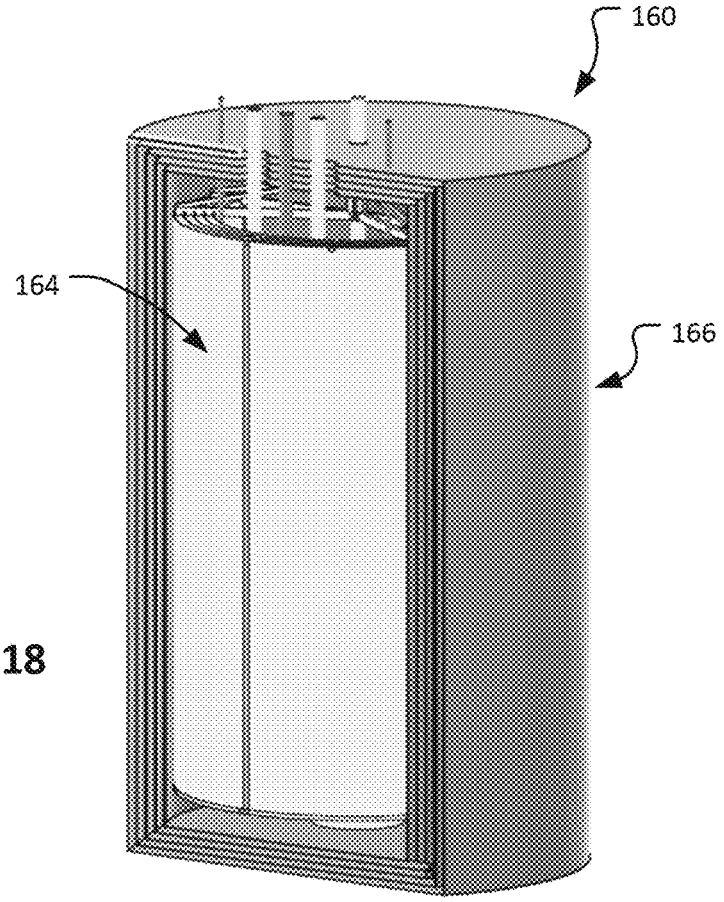
FIG. 18 is a perspective view of the heater assembly in the closed arrangement.

FIG. 17 shows a cross-sectional view of the heater assembly 160 with the radiation shield 164 in the closed position. In this configuration, energy losses from the container 130 towards the heater assembly 160 are minimized because the radiation shield 164 is in the closed position. FIG. 18 is a perspective view of the heater assembly 160 with the radiation shield 164 in the closed position.

Figure 19:
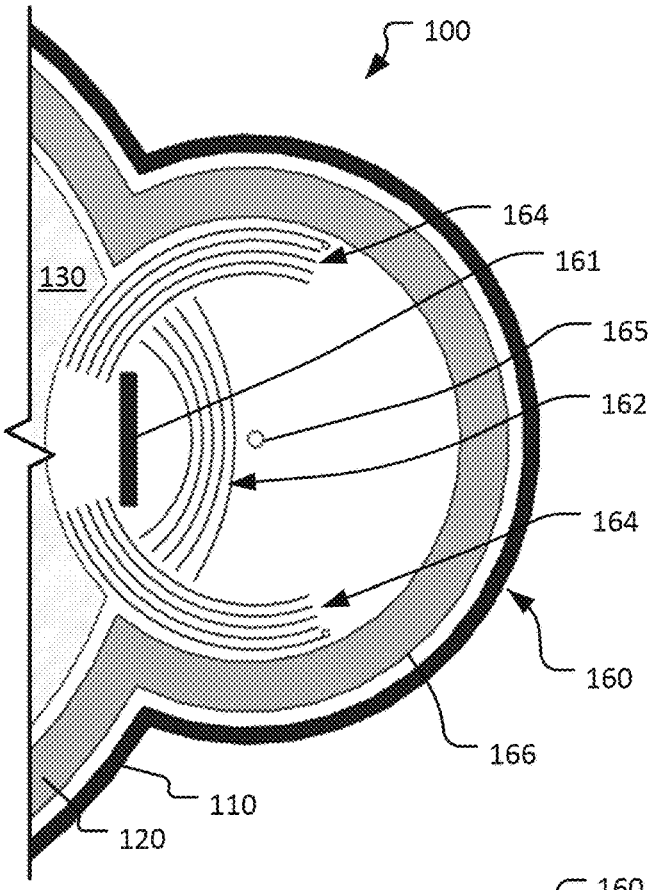
FIG. 19 is a schematic transverse cross-section view of the heater assembly in the partially open arrangement.
Figure 20:
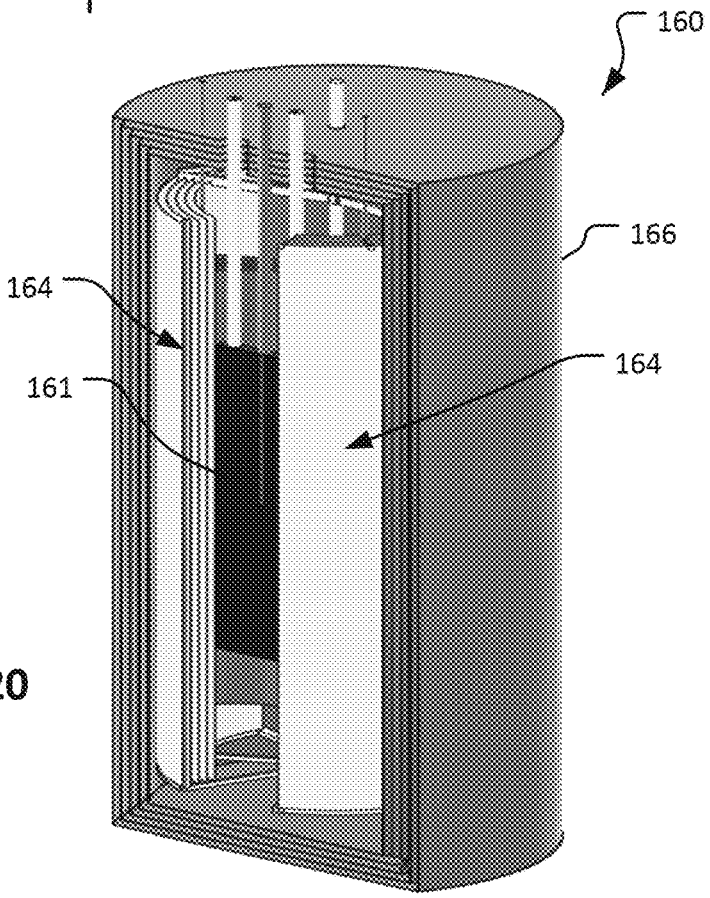
FIG. 20 is a perspective view of the heater assembly in the partially open arrangement.

FIG. 19 shows a cross-sectional view of the heater assembly 160 with the radiation shield 164 in the partially open position. FIG. 20 is a perspective view of the heater assembly 160 with the radiation shield 164 in the partially open position.

Figure 21:
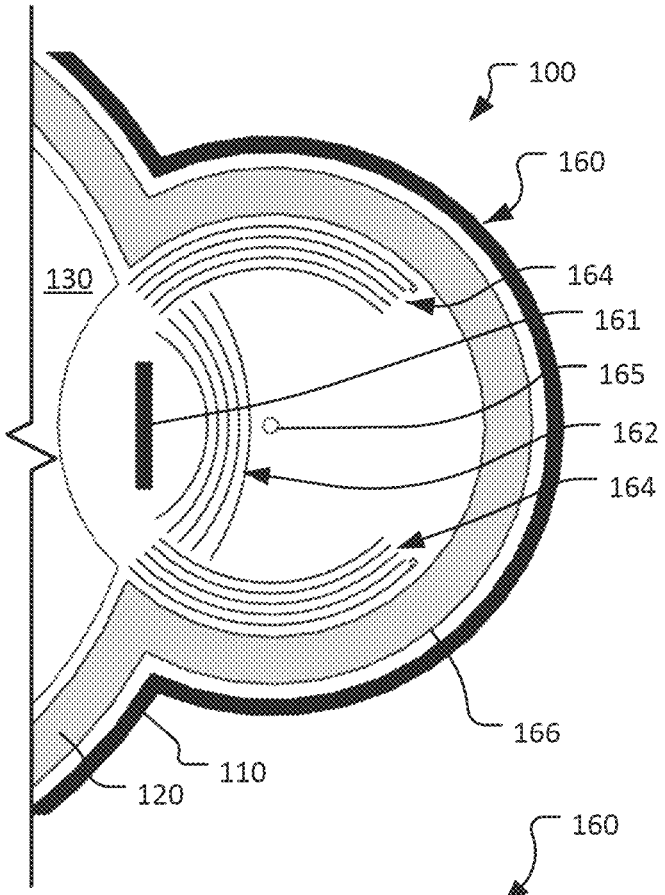
FIG. 21 is a schematic transverse cross-section view of the heater assembly in the fully open arrangement.
Figure 22:
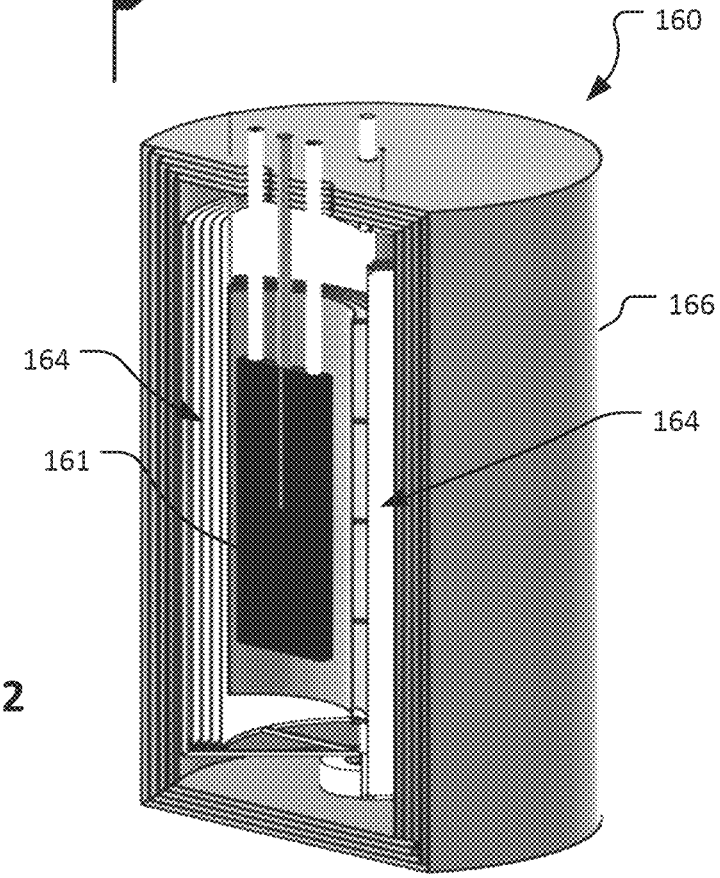
FIG. 22 is a perspective view of the heater assembly in the fully open arrangement.

FIG. 21 shows a cross-sectional view of the heater assembly 160 with the radiation shield 164 in the fully open position. In this configuration, energy transfer from the heater assembly 160 to the container 130 is maximized because the radiation shield 164 is in the fully open position. FIG. 22 is a perspective view of the heater assembly 160 with the radiation shield 164 in the fully open position.

Figure 23:
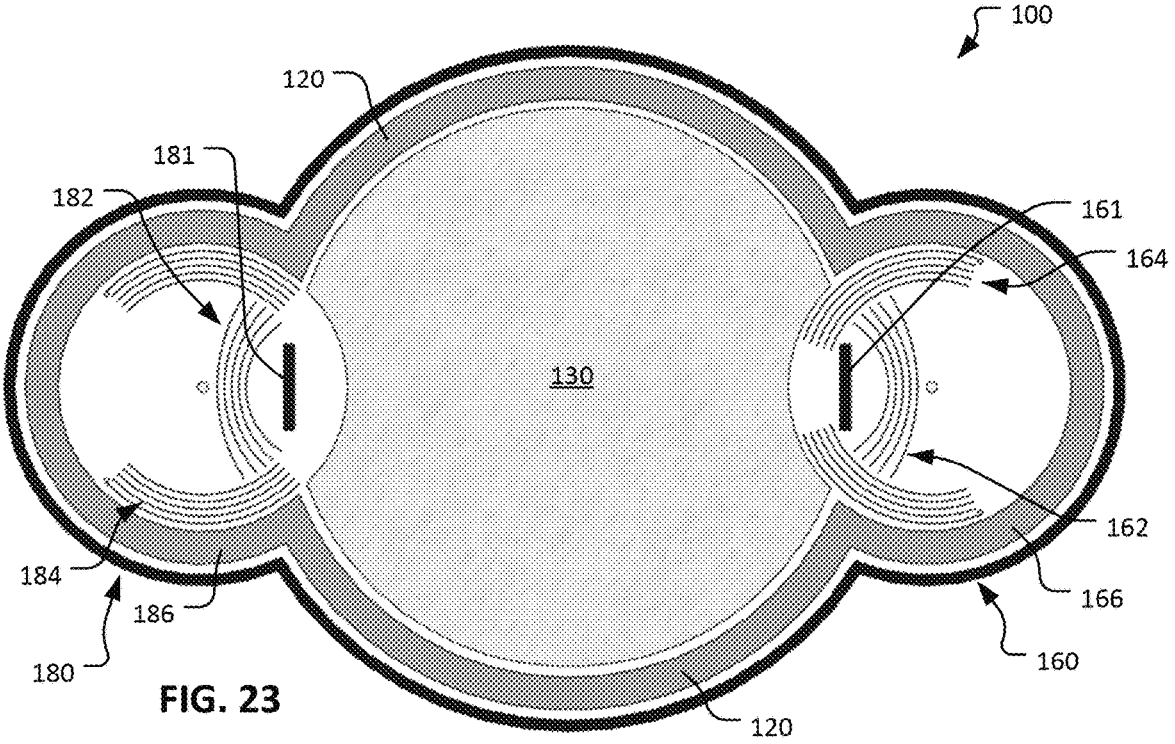
FIG. 23 is a schematic transverse cross-section view of the YKES2 of FIG. 1 with the heater assembly in the partially open arrangement and the heat receiver assembly in the fully open arrangement.

In FIG. 23, the radiation shield 164 of the heater assembly 160 is in the partially open position, and the radiation shield 184 of the heat receiver 180 is in the fully open position.

Figure 24:
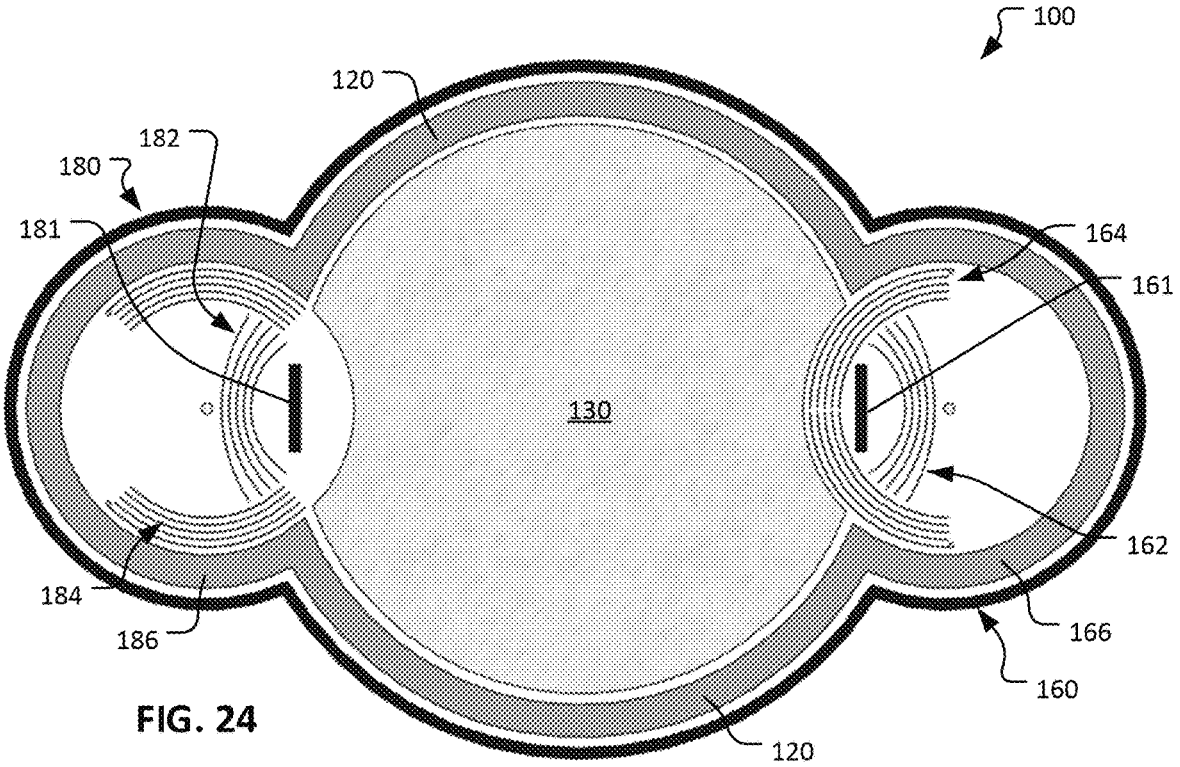
FIG. 24 is a schematic transverse cross-section view of the YKES2 of FIG. 1 with the heater assembly in the fully closed arrangement and the heat receiver assembly in the fully open arrangement.

In FIG. 24, the radiation shield 164 of the heater assembly 160 is in the closed position, and the radiation shield 184 of the heat receiver 180 is in the fully open position.

Figure 25:
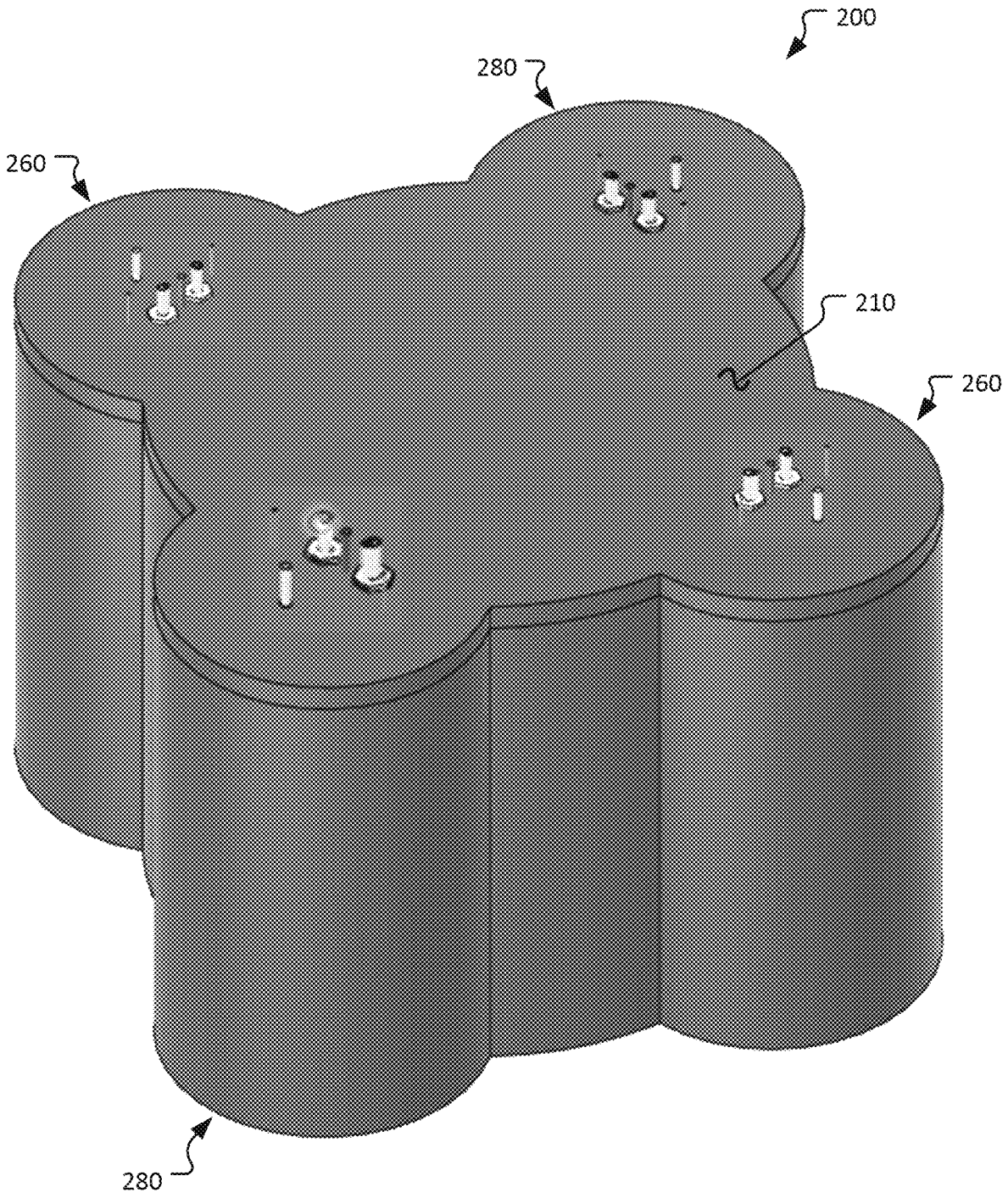
FIG. 25 is a perspective view of another example YKES2 in accordance with some embodiments described herein.

FIG. 25 shows another example embodiment of a YKES2 200. The YKES2 200 is similar to the YKES2 100, except that the YKES2 200 includes two heater assemblies 260 and two heat receivers 280 that are all within a vacuum chamber 210. In some embodiments, the heat transfer from the thermal energy storage medium to the first heat receiver 280 is controllable independently from heat transfer from the thermal energy storage medium to the second heat receiver 280.

Figure 26:
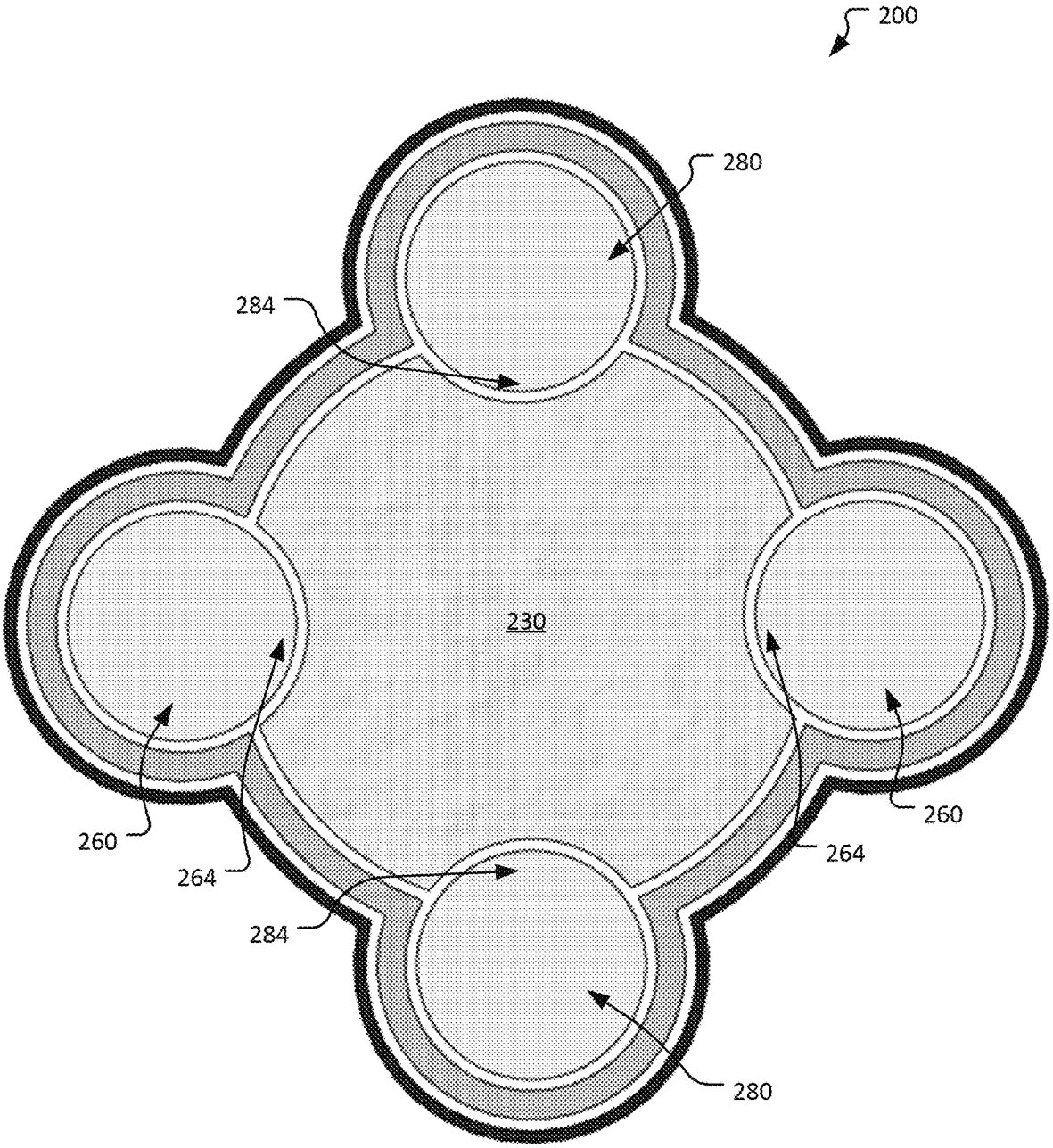
FIG. 26 is a transverse cross-sectional schematic view of the YKES2 of FIG. 25.

FIG. 26 shows a transverse cross-section of the YKES2 200. Here a container 230 is visible. The container 230 includes a thermal energy storage medium (e.g., silicon) stored therein. Each of the heat transfer receivers 280 includes radiation shield 284. Each radiation shield 284 is independently controllable from the other. Accordingly, the heat transfer from the thermal energy storage medium 230 to the first heat receiver 280 is controllable independently from heat transfer from the thermal energy storage medium 230 to the second heat receiver 280. This is advantageous because, for example, a first electricity generation system or a first industrial heating system operative coupled to the first heat receiver 280 can be controlled independently of a second electricity generation system or a second industrial heating system operatively coupled to the second heat receiver 280. While in the depicted embodiment the YKES2 200 includes two of the heater assemblies 260, in some embodiments the YKES2 200 includes a single heater assembly 260.

Figure 27:
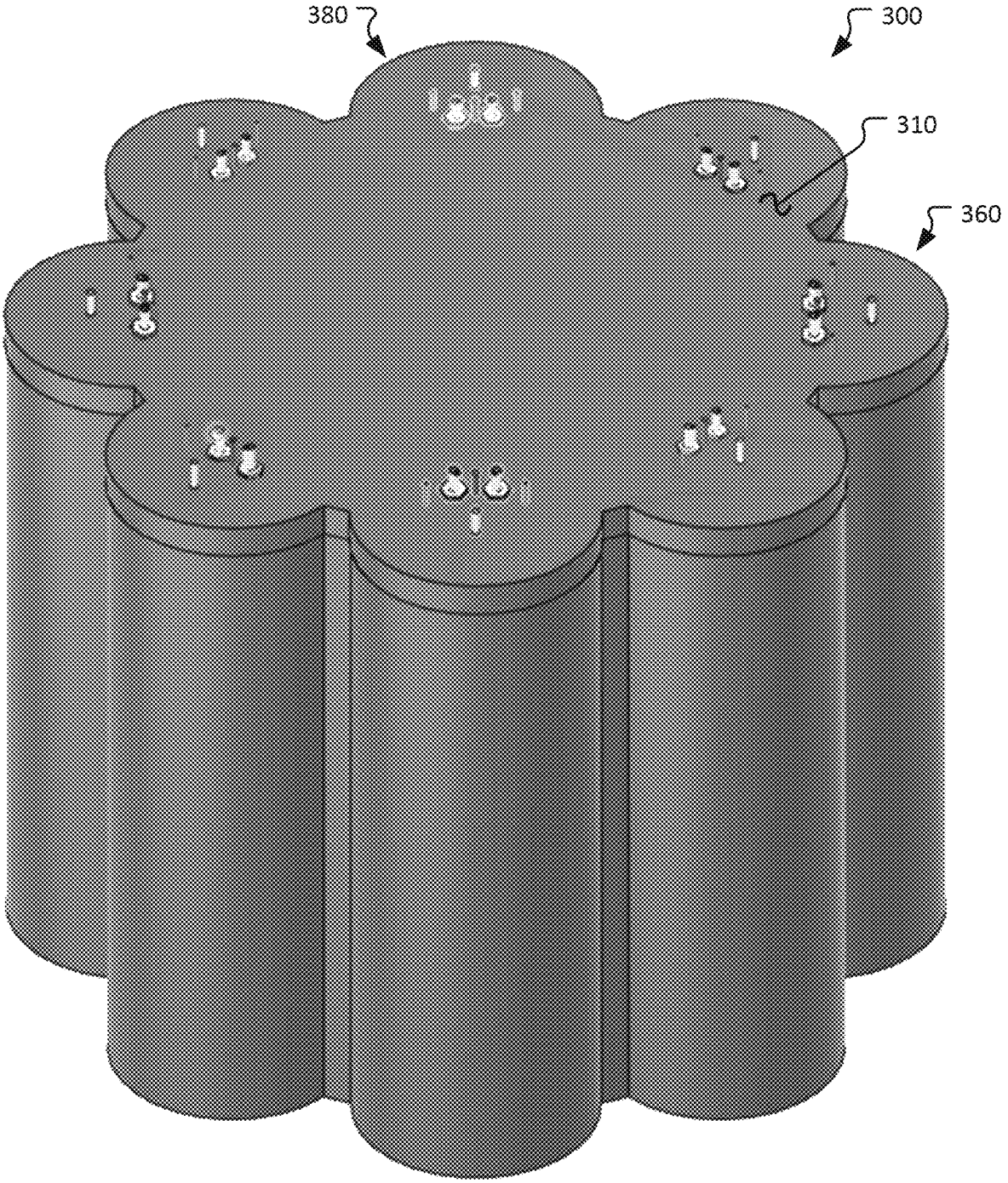
FIG. 27 is a perspective view of another example YKES2 in accordance with some embodiments described herein.

FIG. 27 shows another example embodiment of a YKES2 300. The YKES2 300 is similar to the YKES2 100, except that the YKES2 300 includes a total combination of eight heater assemblies 360 and heat receivers 380 that are all within a vacuum chamber 310. That is, in some embodiments there is 1 heater assembly 360 and 7 heat receivers 380, or 2 heater assemblies 360 and 6 heat receivers 380, or 3 heater assemblies 360 and 5 heat receivers 380, or 4 heater assemblies 360 and 4 heat receivers 380, or 5 heater assemblies 360 and 3 heat receivers 380, or 6 heater assemblies 360 and 2 heat receivers 380, or 7 heater assemblies 360 and 1 heat receivers 380.

Figure 28:
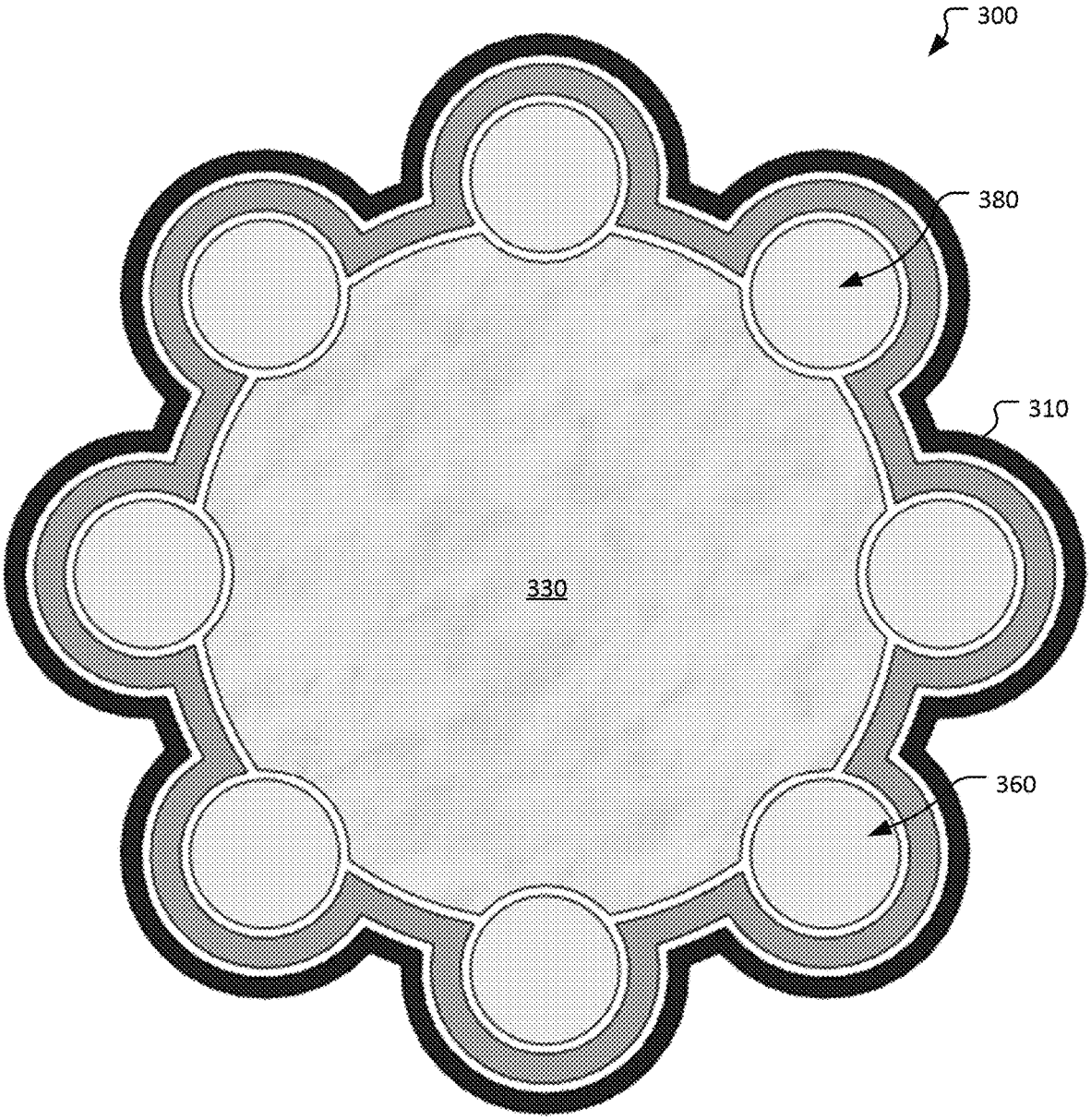
FIG. 28 is a transverse cross-sectional schematic view of the YKES2 of FIG. 27.

FIG. 28 shows a transverse cross-section of the YKES2 300. Here a container 330 is visible. The container 330 includes a thermal energy storage medium (e.g., silicon) stored therein.

Figure 29:
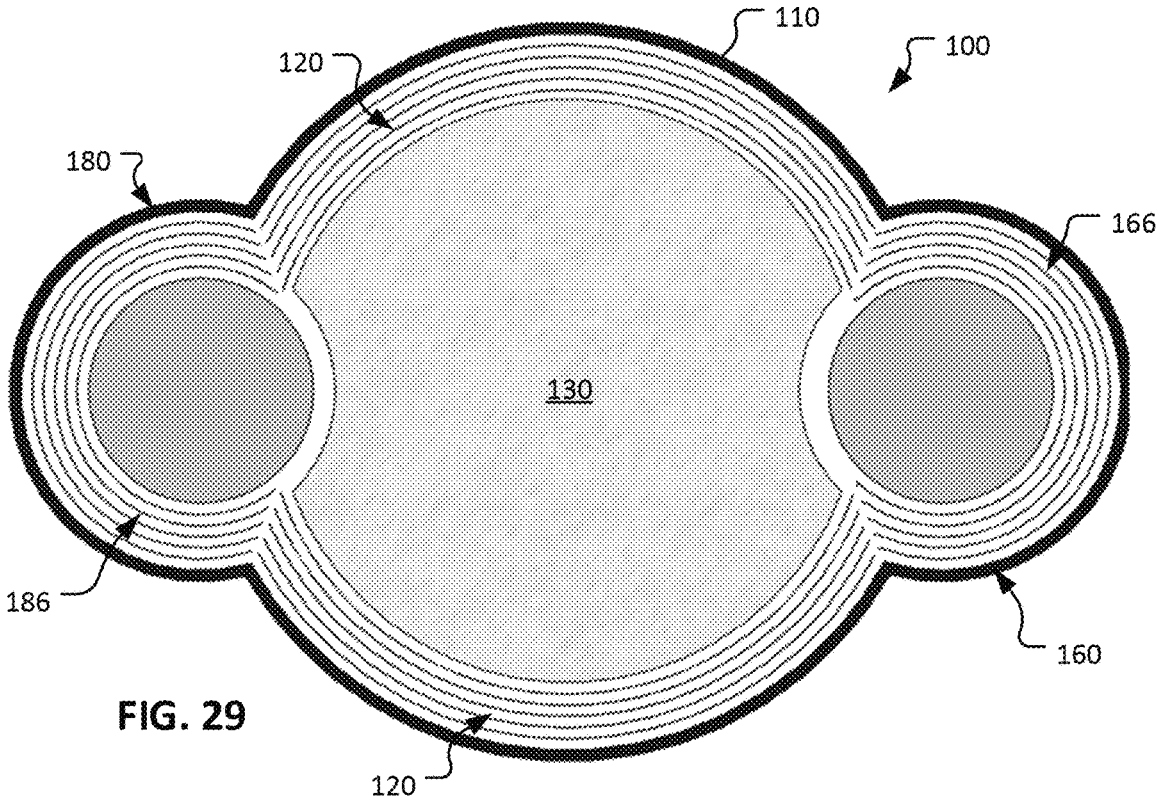
FIG. 29 is another schematic transverse cross-section view of the YKES2 of FIG. 1.
Figure 30:
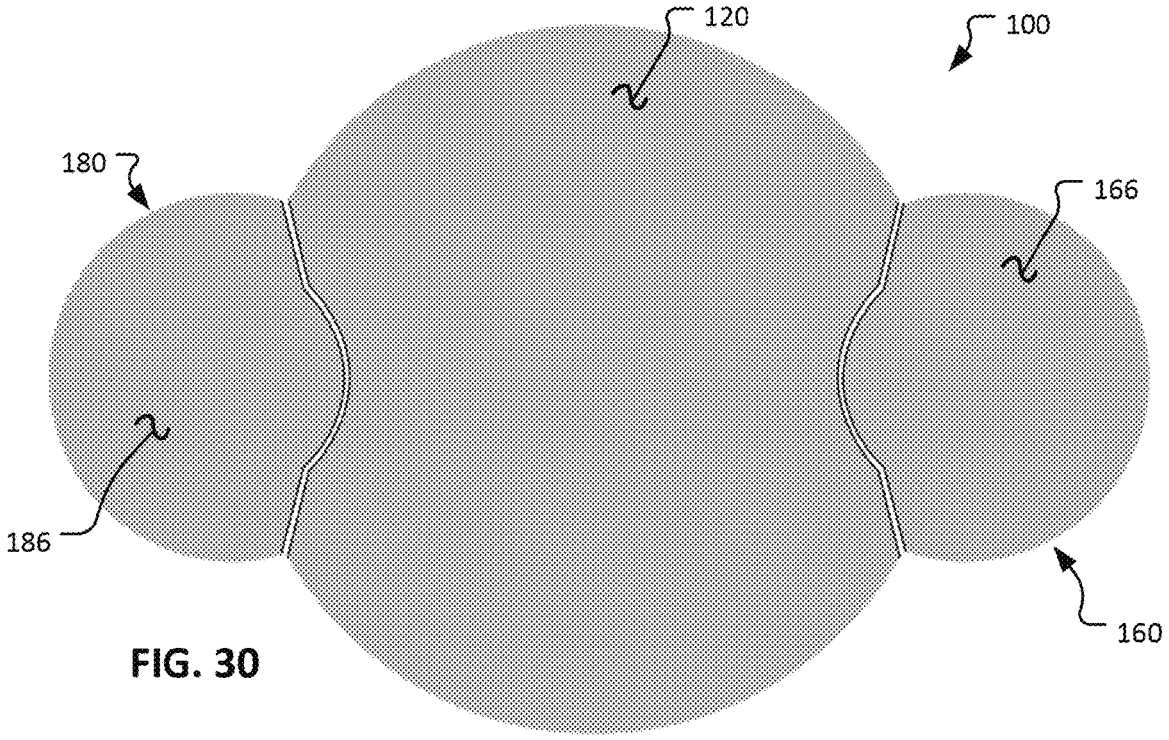
FIG. 30 is another schematic view of the YKES2 of FIG. 1.
Figure 31:
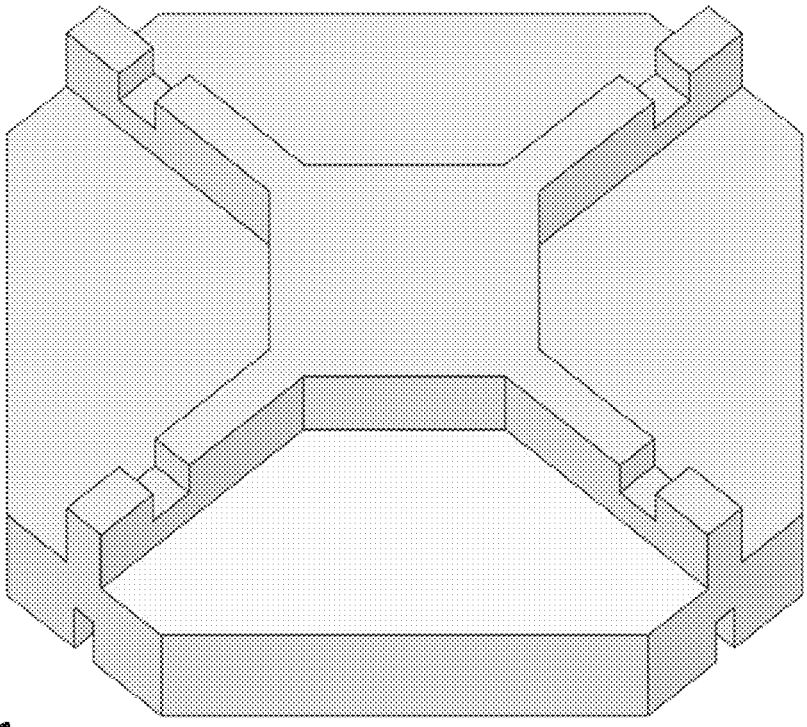
FIG. 31 is a perspective view of first type of support member that can be used for the YKES2 described herein.
Figure 32:
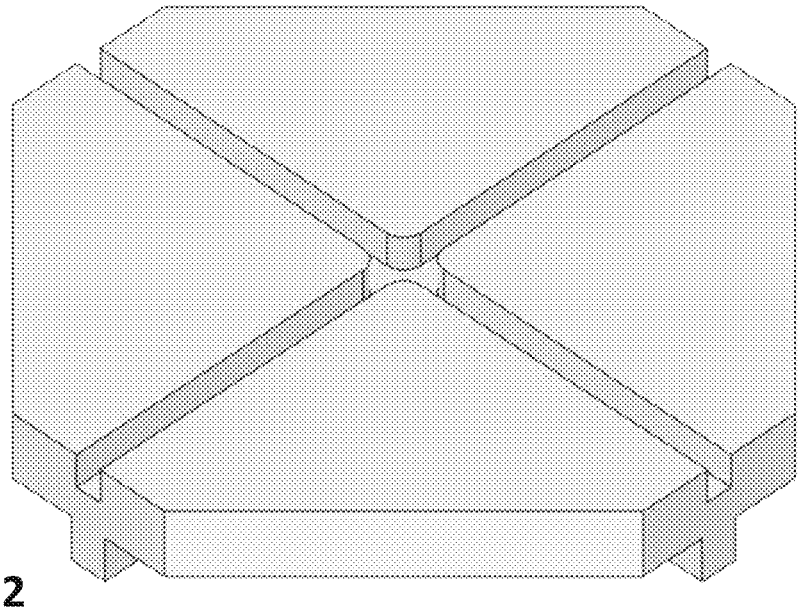
FIG. 32 is a reverse view of the support member of FIG. 31.
Figure 33:
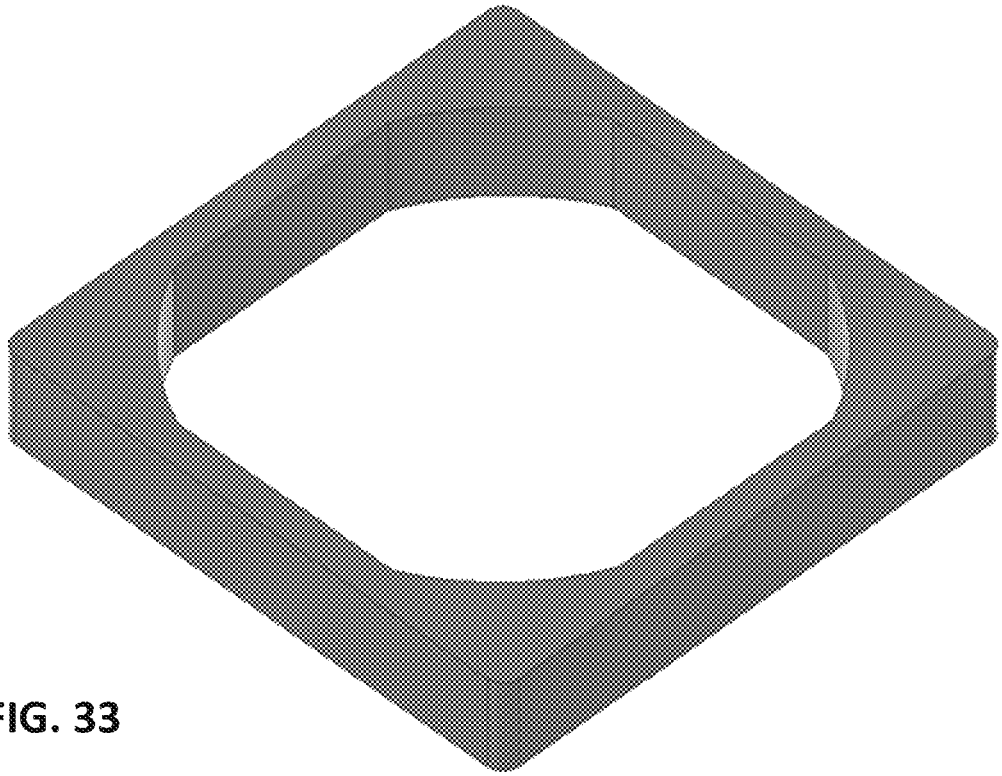
FIG. 33 is a perspective view of another type of support member that can be used for the YKES2 described herein.
Figure 34:
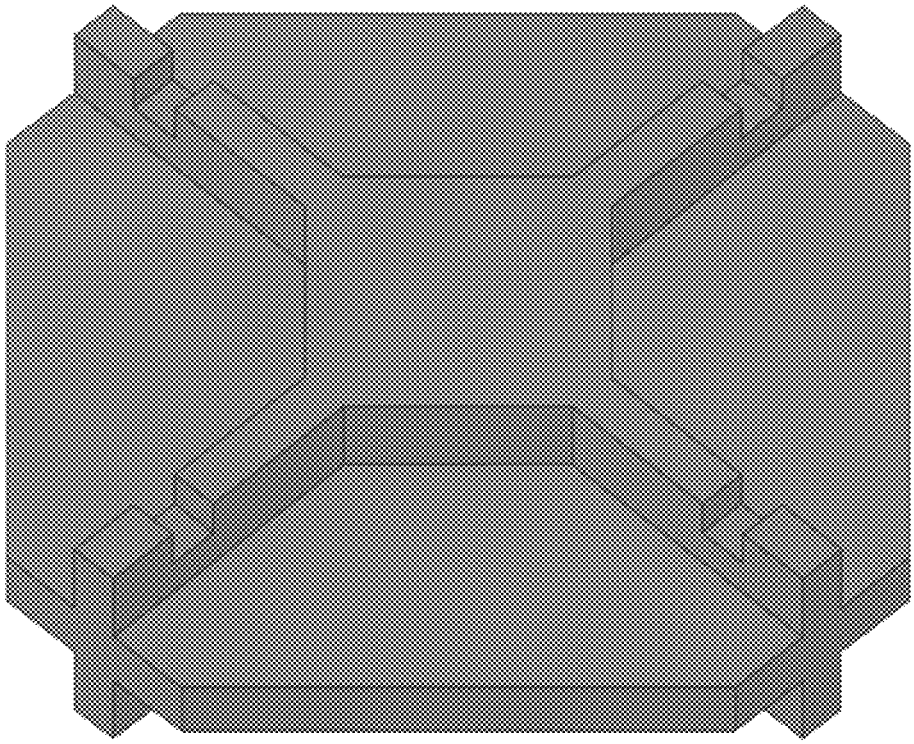
FIG. 34 is a perspective view of another type of support member that can be used for the YKES2 described herein.

Referring again to the YKES2 100, FIG. 29 shows how there is thermal radiation shielding 120/166/186 along all of the inner walls of the vacuum chamber 110. FIG. 30 shows that there are only very narrow gaps between the thermal radiation shielding 120/166/186.

FIGS. 31-34 show various exemplary types of support members that are used in the YKES2 as described further below. The support members are designed to minimize conductive heat transfer. In some embodiments, the material of which the support members are constructed has low thermal conductivity (high thermal resistivity). For example, in some embodiments the support members are made of zirconia (Zirconia dioxide). In addition, the support members are designed to have a minimal amount of surface area contact between each other (again to reduce conductive heat transfer).

Figure 35:
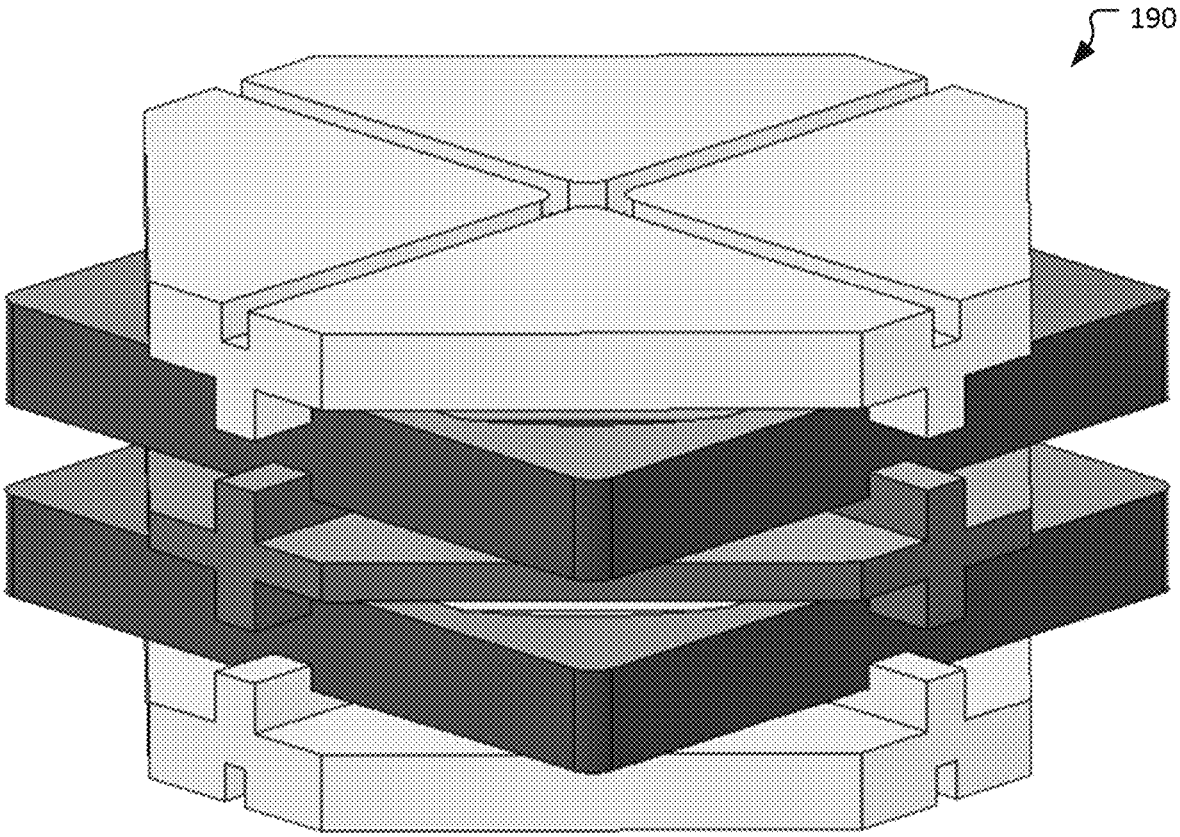
FIG. 35 is a perspective view of a stacked arrangement of the support members.
Figure 36:
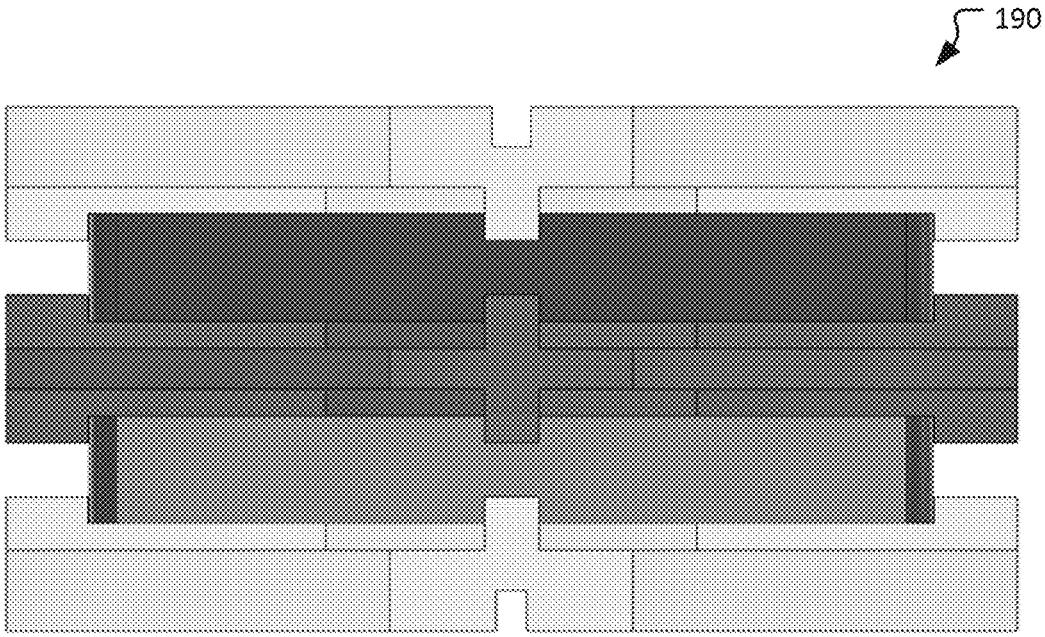
FIG. 36 is a side view of the stacked arrangement of the support members.

FIGS. 35 and 36 show the support members in an example stacked arrangement (i.e., stacked support members 190).

Figure 37:
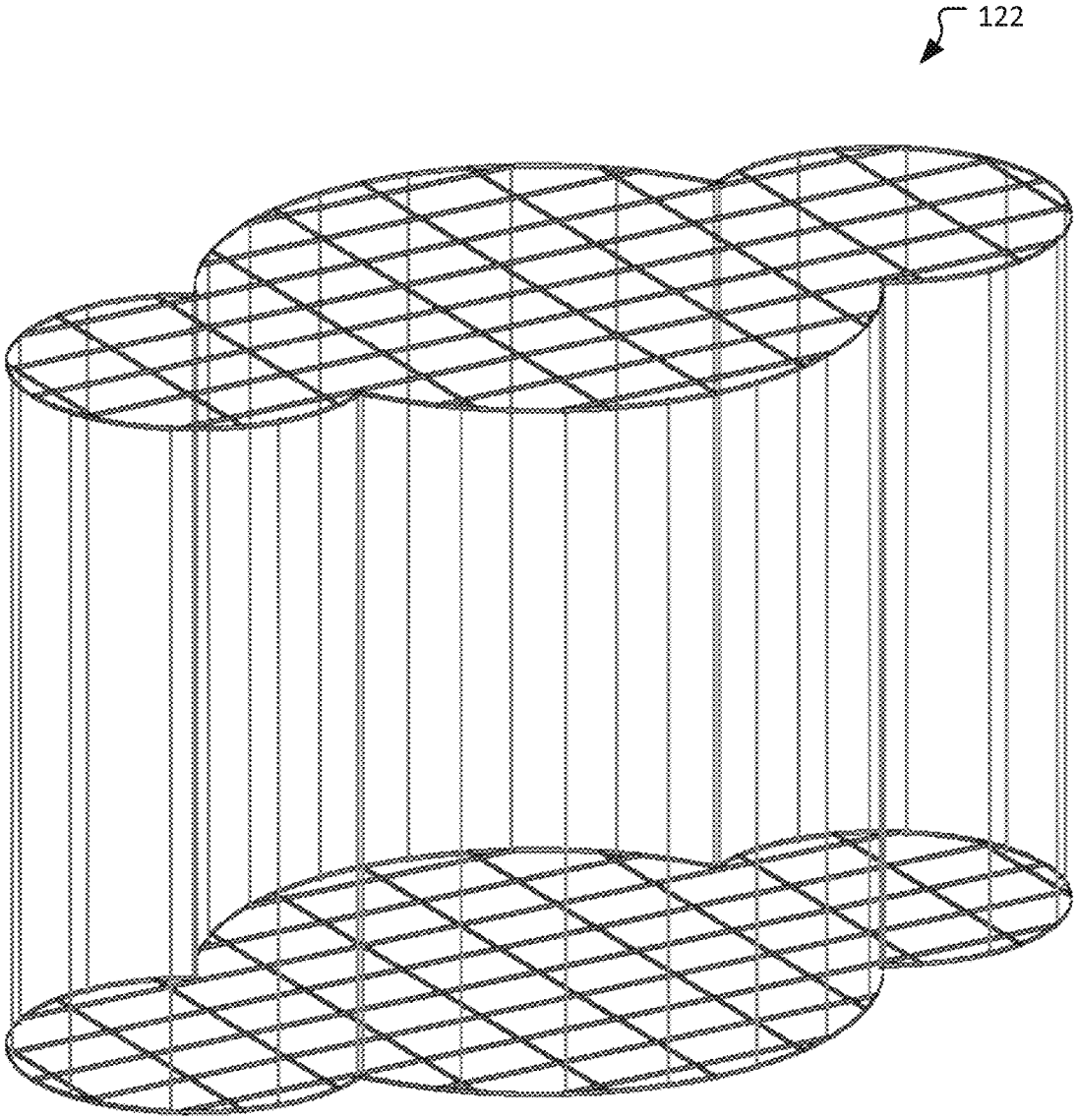
FIG. 37 is a perspective view of a radiation shield support structure that can be used for the YKES2 described herein.

FIG. 37 illustrates an example radiation shield support structure 122 that can be used for the YKES2 100. In some embodiments, multiples of the radiation shield support structure 122 are used for a single YKES2 100. In such a case, the multiple radiation shield support structures 122 are nested within each other.

Figure 38:
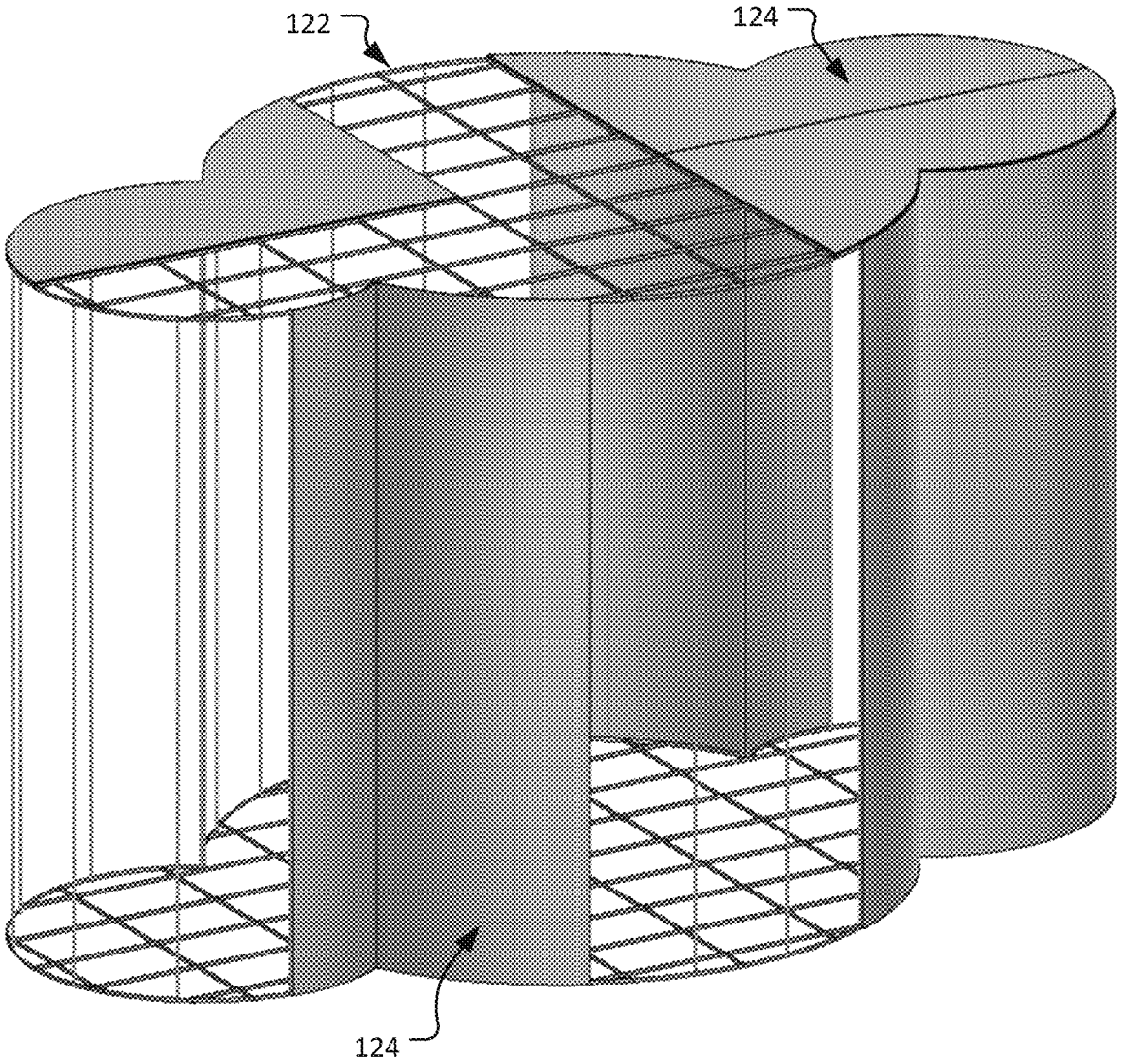
FIG. 38 is a perspective view of the radiation shield support structure of FIG. 37 with some radiation shields attached thereto.

FIG. 38 shows the radiation shield support structure 122 with some radiation shield panels 124 attached thereto. In the final arrangement used for the YKES2 100, the radiation shield support structure 122 is fully covered by the radiation shield panels 124, and multiple such assemblies are nested within each other to create the thermal radiation shielding 120 of the YKES2 100. In some embodiments, the radiation shield panels 124 are made of Molybdenum and/or stainless steel.

Figure 39:
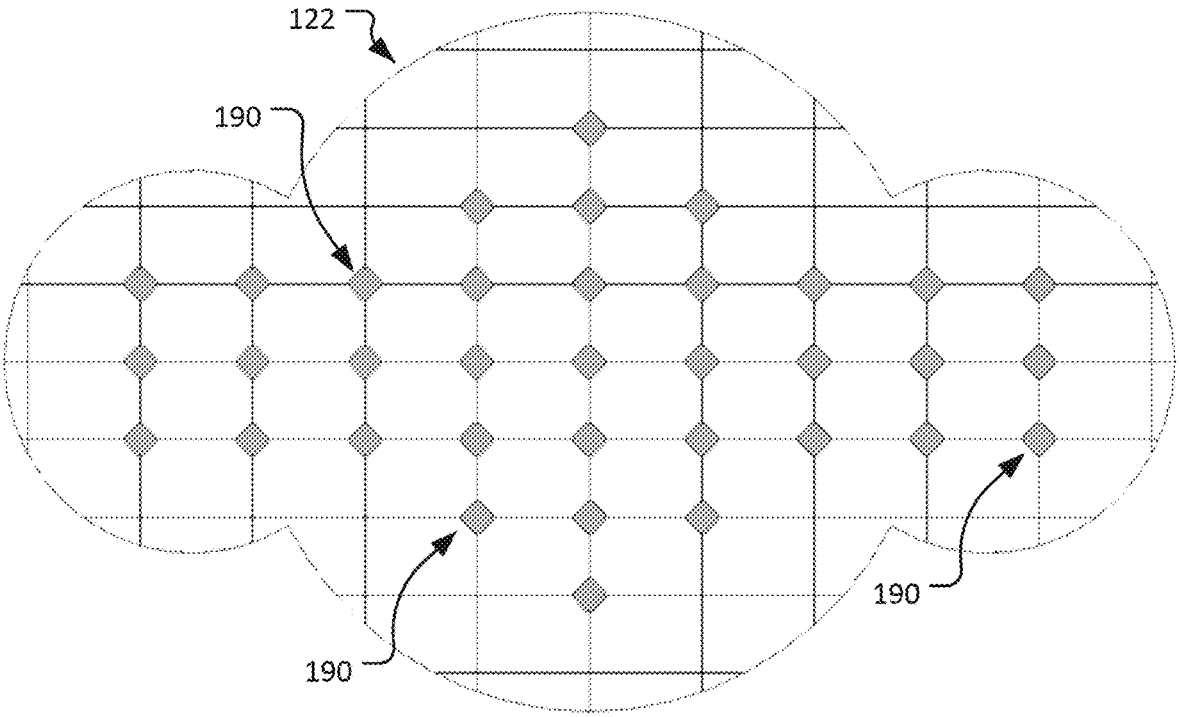
FIG. 39 shows a bottom portion of the radiation shield support structure of FIG. 37 in combination with multiple support members.

FIG. 39 shows a bottom view of the radiation shield support structure 122 and multiple stacked support members 190 that are used to physically support the radiation shield support structure 122. The use of the stacked support members 190 provides the necessary structural support while minimizing the conductive heat transfer.

Figure 40:
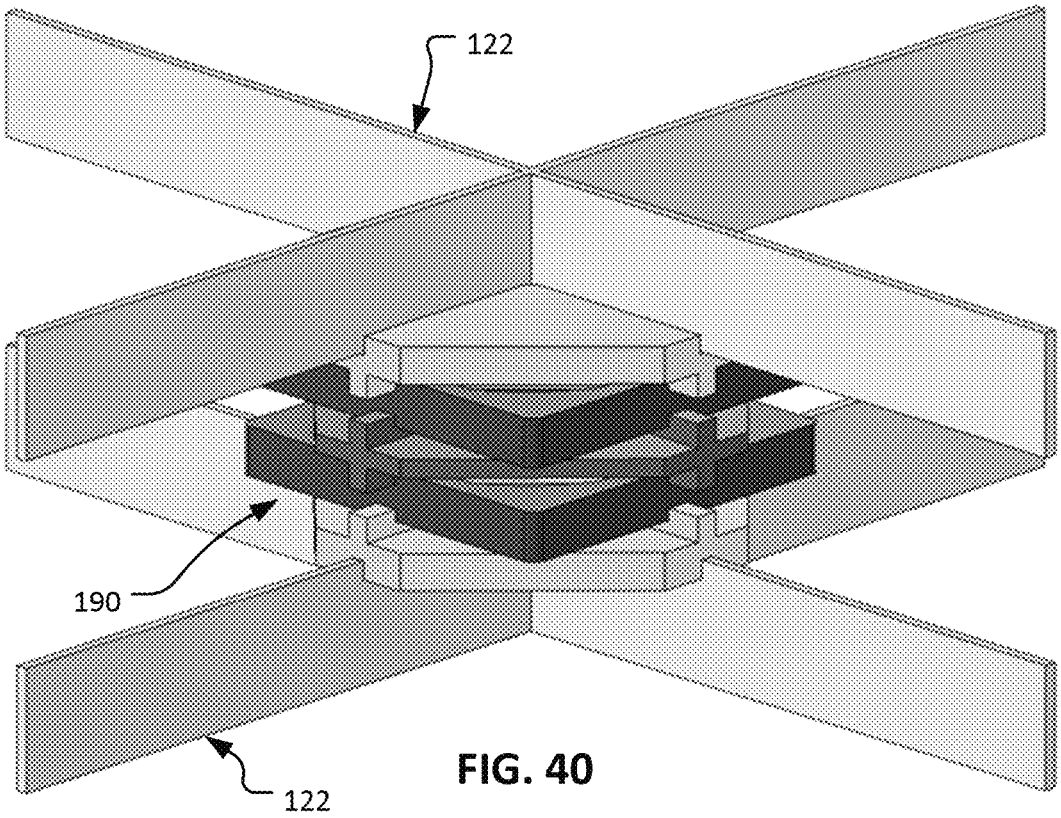
FIG. 40 shows a perspective view of the bottom portions of two of the radiation shield support structure of FIG. 37 that are separated by a stack of multiple support members.
Figure 41:
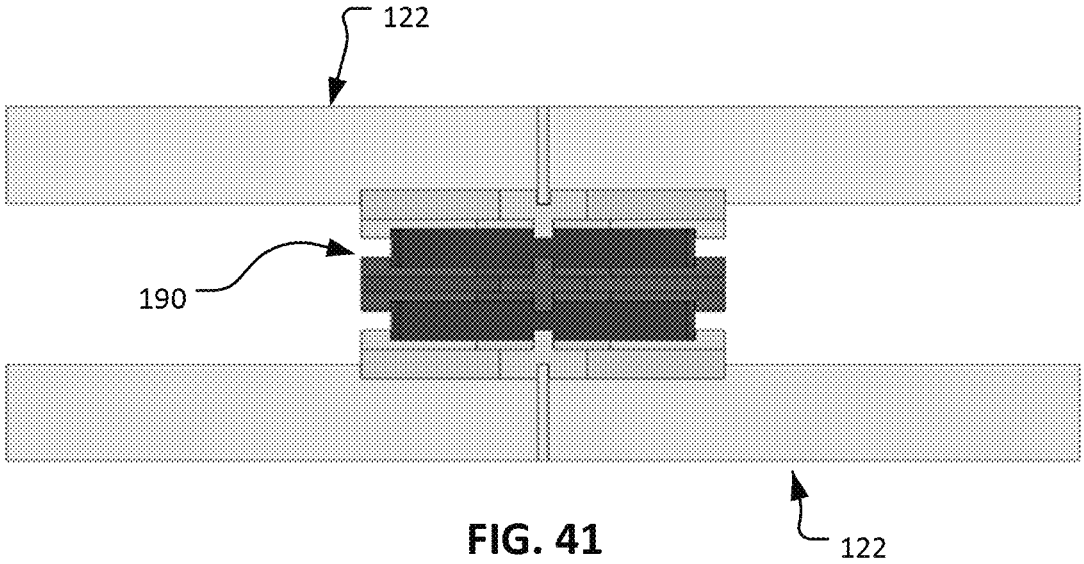
FIG. 41 shows a side view of the arrangement of FIG. 40.

FIGS. 40 and 41 show additional views of the stacked support members 190 positioned between two of the bottoms of the radiation shield support structures 122. While not shown in these figures, radiation shield panels 124 can also be interposed in the depicted arrangement (e.g., mounted to the radiation shield support structures 122).

Figure 42:
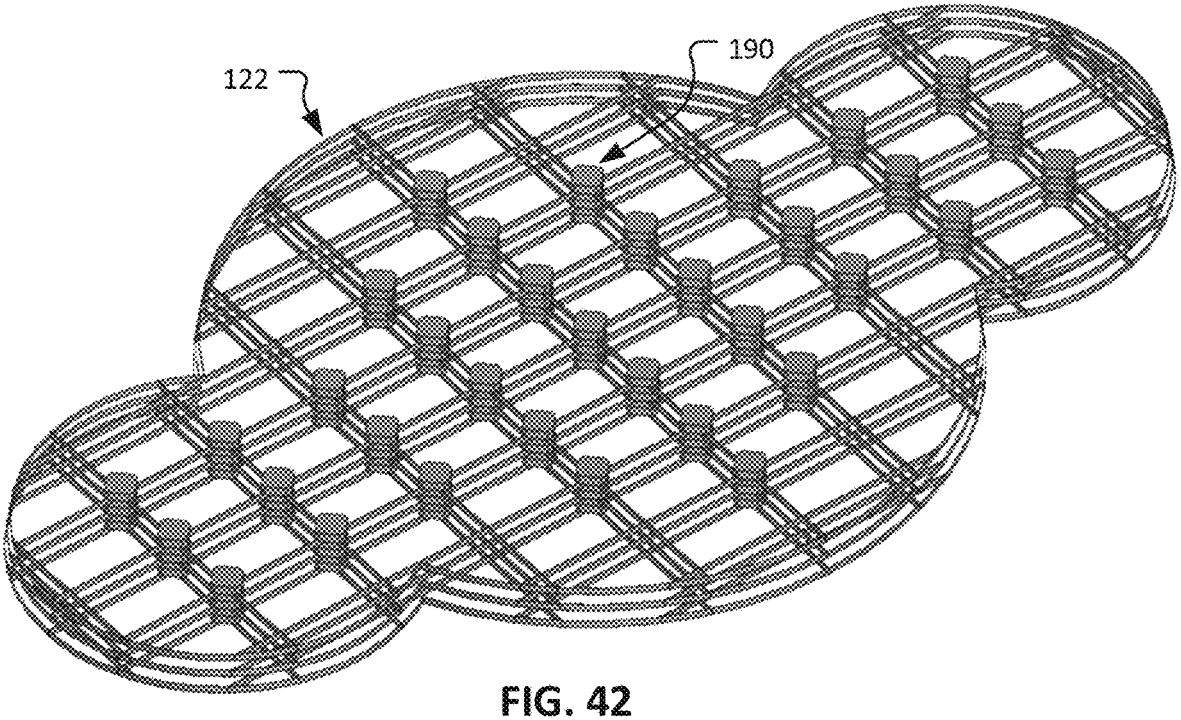
FIG. 42 shows a perspective view of the bottom portions of three of the radiation shield support structure of FIG. 37 that are separated by a stack of multiple support members along with additional stacks of the multiple support members on top.
Figure 43:
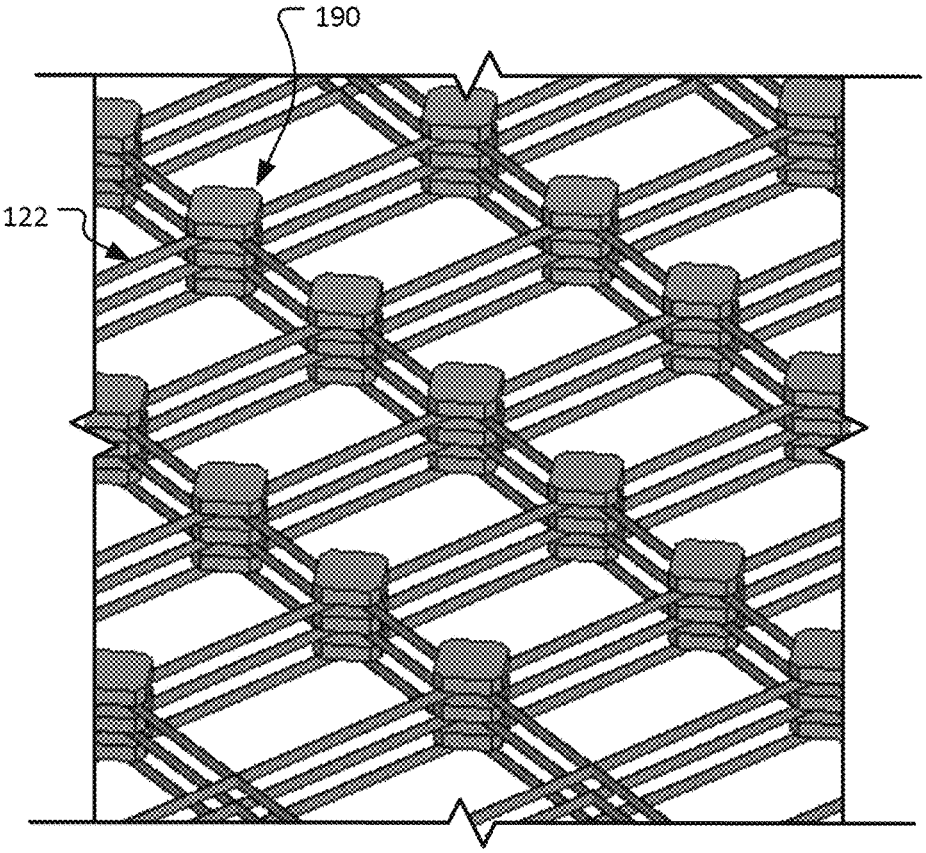
FIG. 43 is an enlarged view of a portion of FIG. 42.

FIGS. 42 and 43 show additional views of three layers of the stacked support members 190 positioned between the bottoms of the radiation shield support structures 122. While not shown in these figures, radiation shield panels 124 can also be interposed in the depicted arrangement (e.g., mounted to the radiation shield support structures 122).

Figure 44:
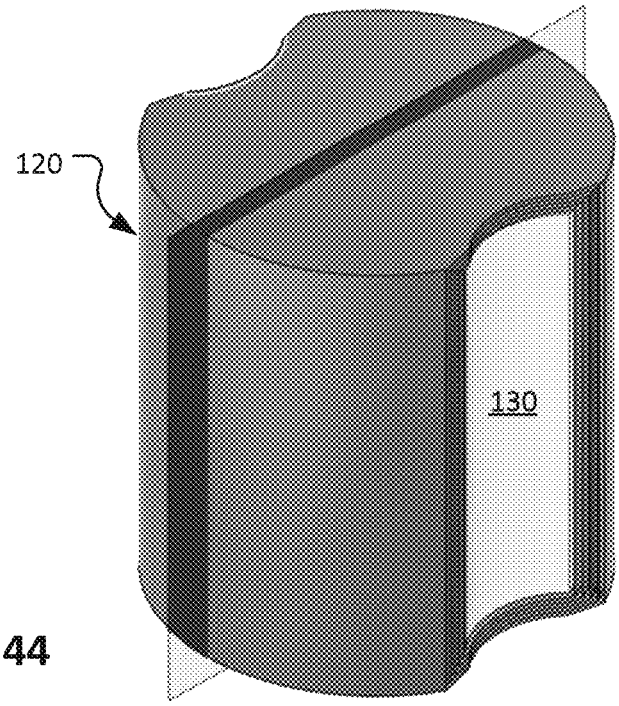
FIG. 44 is a perspective view of the thermal energy storage container of FIG. 3 partially surrounded by radiation shields and showing a longitudinal cut-plane.

FIG. 44 shows the container 130 encapsulated within the thermal radiation shielding 120 of the YKES2 100.

Figure 45:
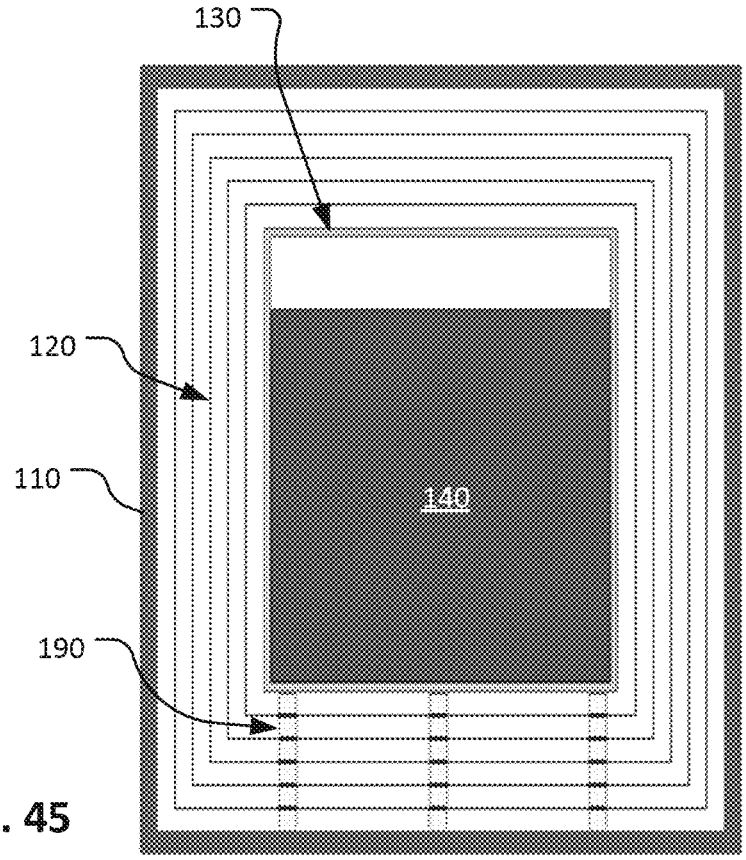
FIG. 45 is a schematic longitudinal cross-section of the thermal energy storage container of FIG. 44 and also showing the vacuum chamber.

FIG. 45 shows a longitudinal cross-section view of the assembly of FIG. 44. The multiple stacked support members 190 that are used to physically support the radiation shield support structure 122 and the container 130 are also shown.

Figure 46:
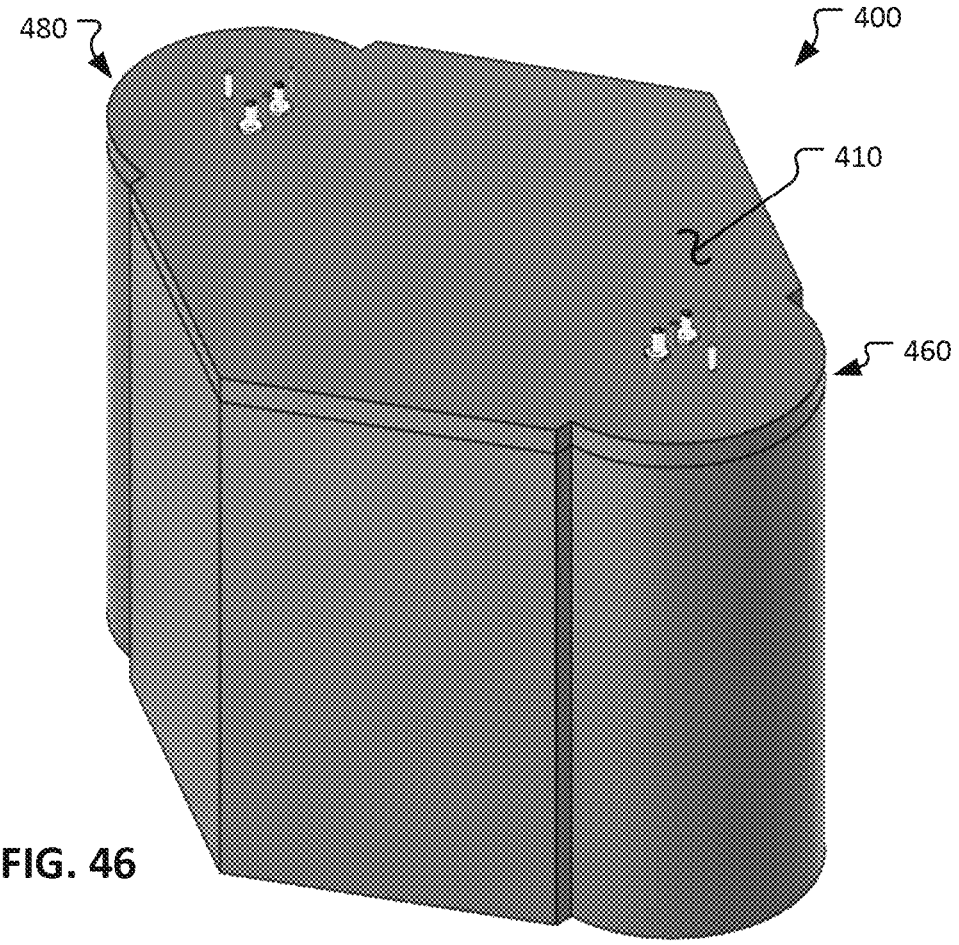
FIG. 46 is a perspective view of another example YKES2 in accordance with some embodiments described herein.
Figure 47:
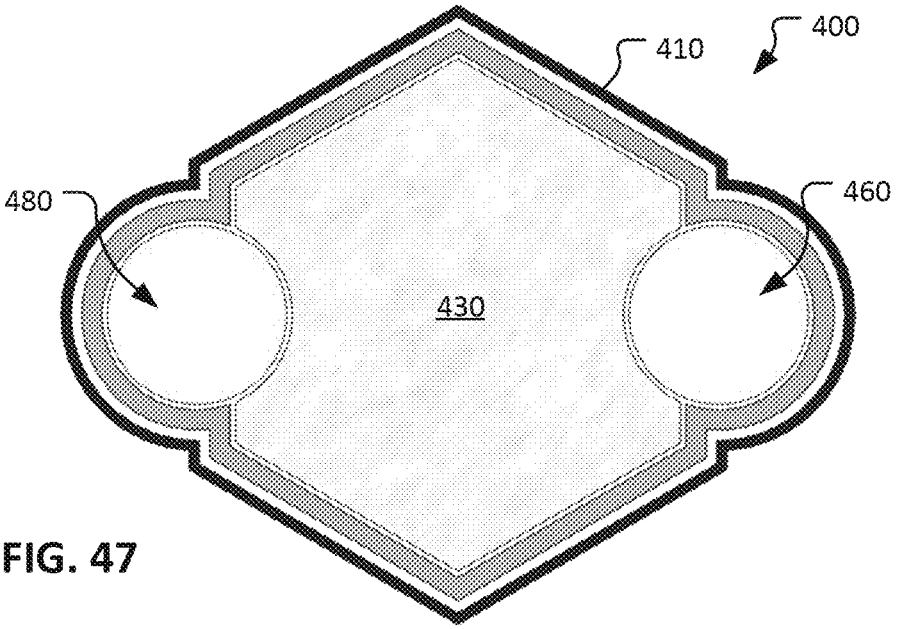
FIG. 47 is a transverse cross-sectional schematic view of the YKES2 of FIG. 46.

FIGS. 46 and 47 show another example embodiment of a YKES2 400. The YKES2 400 is similar to the YKES2 100, except the shape of the vacuum chamber 410 and the container 430 of the YKES2 400 is different than the vacuum chamber 110 and the container 130 of the YKES2 100. The container 430 of the YKES2 400 may have a larger volume than the container 130 of the YKES2 100.

Figure 48:
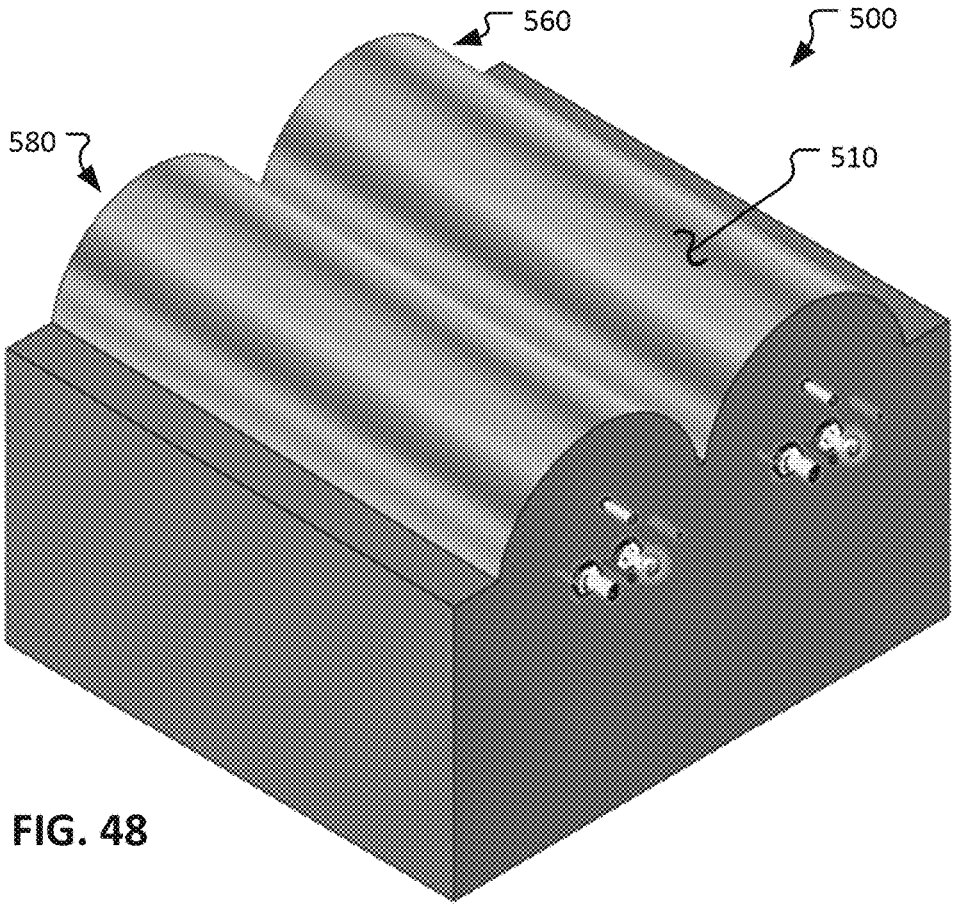
FIG. 48 is a perspective view of another example YKES2 in accordance with some embodiments described herein.
Figure 49:
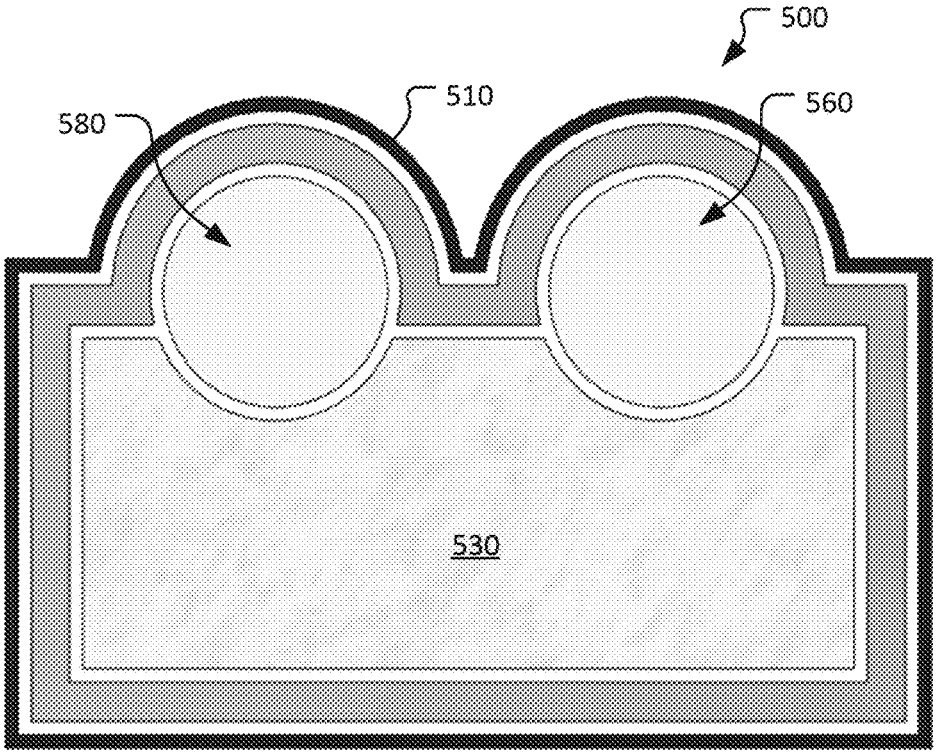
FIG. 49 is a transverse cross-sectional schematic view of the YKES2 of FIG. 48.

FIGS. 48 and 49 show another example embodiment of a YKES2 500. The YKES2 500 operates similar to the YKES2 100. However, the arrangement of the heater assembly 560, the heat receiver assembly 580, and the container 530 of the YKES2 500 is different than the heater assembly 160, the heat receiver assembly 180, and the container 130 of the YKES2 100.

Additional Details Regarding Ykes2 Features and Configurations

YKES2 is a newly invented energy storage system that can store and maintain renewable energy harvested from solar panels and/or wind turbines as thermal energy in a heat storage medium such as molten silicon for long-term and continuous supply of energy to users (e.g., for many weeks or a few months). Silicon melts at about 1,415° C. The heat of fusion of silicon is 496 watthours/Kg, while the heat of fusion for solar salt is 45 watthours/Kg, and that of water is 99 watthours/Kg. One of the main strategies of YKES2 is the maximum utilization of the exceptionally large heat of fusion of silicon, an extensive thermal insulation by multiple layers of thermal radiation shielding sheets of metal, and a vigorous minimization of loss of thermal energy of silicon with unique and novel ideas and physical embodiments of the novel ideas.

The long term storage of silicon at a temperature of 1,400° C.~1,500° C. and the efficient use of the stored thermal energy require creative solutions of technical challenges no one has solved until YKES2. The technical challenges to be solved are described herein, and unique and novel solutions of the technical challenges or unique and novel minimizations of the technical challenges to negligible levels are descried in the following sections. Brief descriptions of the technical challenges and how some of technical challenges are solved and how some of technical challenges are reduced to negligible levels are presented as below. Hot solid silicon and/or molten silicon contained in a crucible will be collectively called "Si-Crucible," for convenience.

A high degree of thermal insulation of molten silicon is needed to keep the thermal energy of Si-Crucible for many weeks or a few months. This is accomplished in YKES2 by extensive use of multiple layers of thermal radiation shielding, which enclose the Si-Crucible in a vacuum chamber. The shielding materials must be capable of withstanding the high temperature of the Si-Crucible. Examples of metals which may be used as shielding materials are molybdenum, tungsten, niobium, tantalum, and rhenium or alloys thereof. Refractory ceramics may also be considered, such as alumina, magnesia, aluminosilicates, silicon carbide, and other ceramic compositions. These examples of shielding materials are not limiting. Multiple layers of thermal radiation shielding sheets will be called 'Global Multiple Layers of Radiation Shielding' or simply 'G-Shielding', for convenience. In one embodiment, G-Shielding consists of 10~15 layers of sheets of Molybdenum for inner layers and 10~15 layers of sheets of stainless steel for outer layers of G-Shielding. Where one can transition from highly refractory materials (inner layers) to lesser refractory materials is not limiting. It is dependent on specific G-Shielding designs and applications. The choices of Molybdenum and stainless steel as radiation shielding sheets are also not limiting.

YKES2 maximizes the transfer of thermal energy from an Ohmic heater to the Si-Crucible and minimizes the loss of thermal energy of the Si-Crucible caused by thermal radiation of heat from the Si-Crucible to the Ohmic heater and heat conduction from the Ohmic heater to outside, when the Ohmic heater is idle. A goal is to maximize the energy transfer through thermal radiation from the Ohmic heater to the Si-Crucible when the Ohmic heater is heated by electric current from solar panels and/or wind turbines. The term Ohmic heater as used herein is defined as any device that converts electric energy to heat. Traditional resistance heaters and induction heaters are non-limiting examples of such Ohmic heaters. Another goal is to minimize the loss of thermal energy of the Si-Crucible to the outside through thermal radiation via the Si-Crucible to the Ohmic heater and from the Ohmic heater to electrical wires which connect the Ohmic heater to outside, when Ohmic heater is (idle) not heated by electricity from solar panels and/or wind turbines. YKES2 reduces such loss of thermal energy of Silicon to a negligible level.

YKES2 provides an optimum rate of thermal radiation of thermal energy from the Si-Crucible to a working-fluid such as water/steam in the heat receiver (e.g., heat exchange tank) and minimizes the loss of thermal energy from the Si-Crucible to the heat exchange tank and heat conduction from the heat exchange tank to outside via pipes of the heat exchange tank. This is to control the rate of energy transfer from the Si-Crucible to the heat exchange tank so that the working-fluid (such as steam/water) is heated to an optimal temperature of the working-fluid, and also to minimize the loss of thermal energy of the Si-Crucible to the outside through heat conduction via the heat exchange tank of the working-fluid and pipes of the working-fluid connected to the heat exchange tank. Such losses of thermal energy of the Si-Crucible to the outside occurs always even when thermal energy transfer from Si-Crucible to the working-fluid in the heat exchange tank is not being done. YKES2 reduces such loss of thermal energy of the S-Crucible to a negligible level.

YKES2 minimize the losses of thermal energy of the Si-Crucible due to heat conduction by using advanced support structures for the Si-Crucible and the G-Shielding of YKES2. The levitation of the Si-Crucible and the G-Shielding in the middle of a vacuum chamber is not possible. Instead, the Si-Crucible and the G-Shielding must be physically supported by weight-stress bearing structures which support the Si-Crucible and the G-Shielding in the empty space of a vacuum chamber. The weight of the Si-Crucible and each layer of G-Shielding must be supported and structurally secured by weight/stress bearing skeletal structures made of materials such as Molybdenum and stainless steel. The heat conduction from the Si-Crucible due to direct physical contact between the support structures and the Si-Crucible, and each layer of G-Shielding, and between the support structures and the outer-most layer of G-Shielding and inner wall of the vacuum chamber is unavoidable. However, such heat conduction is reduced to negligible level in YKES2.

YKES2 use environmentally friendly, chemically stable, non-toxic materials. This is done by careful selection of certain types of metals such as Molybdenum and stainless steel, and certain types of ceramics such as Zirconia and Alumina, and Silicon Carbide. No environmentally harmful chemicals, and no rare materials are used for YKES2.

For the purpose of additional description, hereafter the YKES2 is divided into four functional domains: namely, Si-Crucible, T-Heater, T-Steam, and G-Shielding. FIG. 1 shows a 3D (3-dimensional) view of the example YKES2 100. The surface of YKES2 100 shown is the outer walls of the vacuum chamber 110. FIG. 1 also shows electric leads, pipes, and mechanical gears an electric motor on top surface of the vacuum chamber 110. FIG. 2 shows a schematic 'map' of the four functional domains of YKES2 100, when it is cut in half horizontally by an imaginary horizontal plane. Each functional domain performs one or a few specific functions of YKES2. We call the four functional domains: 'E-Storage' 130, T-Heater 160, 'T-Steam' 180, and 'G-Shielding' 120 for convenience. E-Storage 130 is the domain in which thermal energy of hot or molten silicon is stored. T-Heater 160 is the domain in which YKES2 100 receives electric current from solar panels and/or wind turbines that heats an Ohmic heater and the Ohmic heater sends thermal radiation to E-Storage 130 to heat silicon in E-Storage 130. T-Steam 180 is the domain in which a working-fluid such as water/steam is heated by thermal radiation it receives from E-Storage 130 and the heated working-fluid is sent to users who use the thermal energy. G-Shielding 120 is multiple layers of radiation shielding sheets of certain metals for long term storage of thermal energy of silicon in E-Storage 130. G-Shielding 120 also provides thermal insulation for T-Heater 160 and T-Steam 180. The four functional domains are enclosed in the vacuum chamber 110. Each of the four functional domains of YKES2 100 is individually described in the following sections.

Thermal Energy Storage (E-Storage).

'Si-Crucible' and 'E-Storage' are used interchangeably. 'E-Storage" is used to emphasize it as one of the four functional domains of YKES2. 'Si-Crucible' is used to emphasize it as a bulk of materials that stores thermal energy.

FIG. 3 shows a 3D view of E-Storage 130. It is a specially shaped crucible that contains silicon with its lid on it. The reason for this specially shaped E-Storage 130 is as follows. FIG. 4 shows three interpenetrating cylinders of different diameters which have the same heights. The cylinder in the middle has larger diameter than diameters of the two other cylinders. Some portions of the two smaller cylinders interpenetrate into the center-located cylinder at two opposite sides of the center-located cylinder. One part of center-located cylinder is interpenetrated by the left-side cylinder. Another part of center-located cylinder is interpenetrated by the right-side cylinder. The third part is the part of the center-located cylinder that is not interpenetrated by the two smaller cylinders.

FIG. 3 shows a 3D view of the center-located cylinder that is not penetrated by the two smaller cylinders. This is what we call 'Si-Crucible' 130 and also 'E-Storage' 130. It is a crucible 130 that contains hot solid silicon, or molten silicon or a combination of hot solid silicon and molten silicon. The crucible 130 has a lid on its top. A preferred, but not limiting, material of the crucible 130 that contains molten silicon is Silicon Carbide. Other materials such as alumina or graphite can also be considered for specific applications. The cylindrically concaved surfaces of E-Storage 130 are surfaces where Si-Crucible 130 receives thermal radiation from the Ohmic heater of T-Heater 160, and also where Si-Crucible sends its thermal radiation to heat water/steam in a built-in heat exchange tank of T-Steam 180. The special shape of cylindrically concave surfaces of Si-Crucible 130 provides efficient exchange of thermal radiation between Si-Crucible 130 and the Ohmic heater and also between Si-Crucible 130 and the heat exchange tank. Unique features of the shape of the Si-Crucible 130 and consequential efficient thermal radiation transfer in vacuum between the Si-Crucible and Ohmic heater in the T-Heater 160 and between the Si-Crucible 130 and heat exchange tank in T-Steam 180 are described in later sections.

FIG. 5 shows a 3D view of an empty Si-Crucible 130. There is a pyramid-like structure 132 that protrudes from the bottom surface of the crucible 130. The height of the 'pyramid' 132 is slightly less than height of inner wall of the crucible 130. The total volume of the 'pyramid' 132 is roughly equal to 10% of total interior volume of the crucible 130. The density of molten silicon is about 10% higher than density of solid silicon. Therefore, when molten silicon solidifies at about 1,415° C. as it cools, it expands about 10% of its volume. A crucible 130 without the 'pyramid' 132 that contains molten silicon may crack when the molten silicon transforms into solid silicon and its volume expands. Solidified chunks of silicon will float to the top surface easily with the presence of the 'pyramid' 132 in the crucible 130. A crucible 130 of large internal volume may have two or more 'pyramids' 132 in the crucible 130. The 'pyramid' 132 in the crucible 130 is a novel solution to this problem that stems from volume expansion of silicon when it transforms from liquid to solid. FIG. 6 is a 3D longitudinal cross-section view of a crucible with its lid that is filled with molten silicon 140 to about 80% of height of its internal wall.

YKES2 minimizes thermal radiation from silicon to the Ohmic Heater (T-Heater 160). The concept and design of how the T-Heater 160 works constitutes key and novel features of YKES2. The function of the T-Heater 160 is to receive energy from solar panels and/or wind turbines and to radiate its thermal energy of its Ohmic Heater to the Si-Crucible 130.

In some embodiments, the T-Heater 160 consists of three main parts. As shown in FIG. 8, the first main part of the T-Heater 160 is a built-in Ohmic heating unit 161 (Ohmic heater 161). The Ohmic heater 161 receives electric current from solar panels and/or wind turbines, and the electric current heats the Ohmic heater 161. The heated Ohmic heater 161 emits thermal radiation which arrives at the Si-Crucible 130 and heats the silicon 140 in the Si-Crucible 130. Please note that the geometry of the cylindrically concaved surface of E-Storage 130 which faces the Ohmic heater 161 increases the efficiency of the heat transport by thermal radiation from the Ohmic heater 161. Preferred materials, not limiting, for Ohmic heaters 161 are tungsten and molybdenum or appropriate alloys thereof.

As shown in FIG. 9, the second main part of the T-Heater 160 is a set of non-movable thermal radiation shielding sheets 162 which are approximately aligned to each other. This set of non-movable thermal radiation shielding sheets is thermally reflective, and can also be referred to herein as 'Bouncing Shielding Sheets of Thermal Radiation' or simply 'B-Shielding' 162 for convenience. The role of B-Shielding 162 is to maximally shield thermal radiation from the Ohmic heater 161 in directions which are not toward the Si-Crucible 130. It effectively bounces the thermal radiation from the Ohmic heater back toward the Ohmic heater 161 and the E-Storage 130. With B-Shielding 162, the thermal radiation of the Ohmic heater 161 is more effectively directed toward the E-Storage 130.

As shown in FIG. 10, the third main part of the T-Heater 160 is two units of rotatable multi layers of radiation shielding sheet 164*s*. We will call one of the two units of rotatable multi layers of radiation shielding sheets 'Rotatable Radiation Shielding Layers' or 'R-Shielding' 164. R-Shielding 164 is an important and novel feature of YKES2 100. The two units of R-Shielding 164 are mechanically connected to a vertical 'rod' 165. The two units of R-Shielding 164 are supported by 'mechanical arms' of the vertical rod 165. FIG. 11 shows an assembly of the Ohmic heater 161, the B-Shielding 162, and two units of R-Shielding 164.

FIG. 12 shows a portion of G-Shielding 166 that provides thermal insulation of the T-Heater 160. FIG. 13 shows a 3D view of the T-Heater 160 that contains the Ohmic heater 161, B-Shielding 162, and two units of R-Shielding 164 when the three parts are snuggled into the portion of G-Shielding 166.

Please note that the multiple layers of radiation shielding sheets (G-Shielding 120/166) which enclose entire assembly of E-Storage 130, T-Heater 160, and T-Steam 180 are fixed and are not movable (not rotatable). In contrast, the two units of R-Shielding 164 are movable (rotatable). One unit of R-Shielding 164 is a set of multiple layers of parallel aligned and cylindrically curved radiation shielding sheets of Molybdenum and stainless steel, which spans a fraction of arc of a circle that is greater than 45 degrees and less than 120 degrees. Two units of R-Shielding 164 occupy a certain fraction of a full circle (360 degrees) mutually exclusively. In other words, the two units of R-Shielding 164 do not over-lap on their circular track. The two units of R-Shielding 164 rotate in opposite direction on their common circular track. If one unit of R-Shielding 164 rotates clockwise, the other unit of R-Shielding 164 rotates counterclockwise, and vice versa. Rotations of the two units R-Shielding 164 are synchronized by same mechanical gears which are driven by one electric motor. The two units of R-Shielding 164 are separated by a certain angle along their common circular track. Otherwise, the two R-Shielding 164 are essentially identical.

FIGS. 14-16 show 3D views of three different positions of the two units of R-Shielding 164 on their circular track. FIG. 14 is a 3D view of two units of R-Shielding 164 which almost touch on their circular track. FIG. 15 is a 3D view of two units of Shielding 164 which are separated to some degree on their circular track. FIG. 16 is a 3D view of two units of R-Shielding 164 which are the farthest apart on their circular track. FIG. 16 clearly shows how the two units of R-Shielding 164 are mechanically connected to a straight vertically oriented 'rod' 165 which is the axis of rotation of the two units of R-Shielding 164.

FIGS. 17 and 18 show an arrangement when two units of R-Shielding 164 almost touch on their circular track. FIG. 17 is a schematic top view of the T-Heater 160 with the two units of R-Shielding 164 in the said positions. A portion of the Si-Crucible 130, a portion of G-Shielding 120/166, and a portion of wall of vacuum chamber 110 are also shown.

FIG. 18 is the same two units of R-Shielding 164 in the same positions which are snuggled into a portion of G-Shielding 166 which thermally insulates the T-Heater 160. In this case, the thermal radiation between the Ohmic heater 161 of the T-Heater 160 and the Si-Crucible 130 is blocked. In other words, the pathway for the thermal radiation between the Ohmic heater 161 of the T-Heater 160 and the Si-Crucible 130 is 'closed' by the two units of R-Shielding 164.

FIGS. 19 and 20 show an arrangement of the T-Heater 160 in which the two units of the R-Shielding 164 are separated apart from each other to some degree on their circular track. A portion of Si-Crucible 130, a portion of G-Shielding 120/166, and a portion of the wall of the vacuum chamber 110 are also shown in FIG. 19. FIG. 20 shows the two units of R-Shielding 164 in the partially open positions and snuggled into the said portion of G-Shielding 166. In this case, the thermal radiation between the Ohmic heater 161 of the T-Heater 160 and the Si-Crucible 130 is partially blocked (or partially open). In other words, the thermal radiation between the Ohmic heater 161 of the T-Heater 160 and the Si-Crucible 130 is 'partially closed' or 'partially open'.

FIGS. 21 and 22 show an arrangement of the T-Heater 160 in which the two units of R-Shielding 164 are separated the farthest apart on their circular track. A portion of the Si-Crucible 130, a portion of G-Shielding 120/166, and a portion of wall of the vacuum chamber 110 are also shown in FIG. 21. FIG. 22 shows the two units of R-Shielding 164 in the said positions and snuggled into the portion of G-Shielding 166. In this case, the thermal radiation between the Ohmic heater 161 of the T-Heater 160 and the Si-Crucible 130 is not blocked at all. In the words, the thermal radiation between the Ohmic heater 161 of the T-Heater 160 and the Si-Crucible 130 is fully 'open'.

The rotational movement of the two units of R-Shielding 164 involves friction between the surfaces in contact. Since the two units of R-Shielding 164 rotate on their circular track around an axis of rotation, there are frictions between two relatively moving surfaces of solids in contact. The two units of R-Shielding 164 are mechanically connected to two vertically oriented concentric axes of rotation. The two concentric vertical axes of rotation are connected to a single axis of rotation through a mechanical coupling between the two concentric axes of rotation and the single axis of rotation by simple mechanical gears.

For convenience, the combination of two concentric axes of rotation and the single axis of rotation which are mutually interlocked as an assembly will be called 'V-Rod' 165 for convenience. The two units of R-Shielding 164 rotate in opposite directions on their circular track around V-Rod 165 as their common axis of rotation. Lower part of V-Rod 165 passes through holes of each bottom layers of G-Shielding 120/166 and reaches to a concave pit on bottom surface of the vacuum chamber 110. The concave pit on bottom surface of vacuum chamber 110 where the bottom end of V-Rod 165 'sits on' is made of a combination of alumina and Zirconia for their hardness at high temperature. The upper part of V-Rod 165 passes through holes of each layer of G-Shielding 166 and a hole on the top wall of the vacuum chamber 110. The top part of V-Rod 165 is a single 'rod' that passes through a hole on top surface of the vacuum chamber 110. The hole of the vacuum chamber 110 where the top part of V-Rod 165 passes through from inside of the vacuum chamber 110 to outside of the vacuum chamber 110 is 'vacuum sealed' by a ferromagnetic vacuum sealing device.

Friction between the two surfaces of solids in contact generates heat and cause wear-and-tear of the solids. Such generation of heat and wear-and-tear of surfaces of solids in contact are unavoidable. But this is not a problem for the YKES2 described herein. There are at least two reasons why.

The first reason is that angular velocity of rotation of the two units of R-Shielding 164 when they actually rotate is very low. Therefore, angular velocity of V-Rod 165 is also very low. The angular velocity of two units of R-Shielding 164 and that of V-Rod 165 is only about 1~2 RPMs (revolutions per minute). Therefore, the friction between V-Rod 165 and any surfaces it has direct contact is negligible. The second reason is that the rotations of two R-Shielding 164 occur in internal space of YKES2 where temperature is much lower than temperature of E-Storage 130, since most of the intense thermal radiation from the Si-Crucible 130 is shielded by the B-Shielding 162 where the rotation of V-Rod 165 occurs. This is another important role of the B-Shielding 162.

For example, the temperature in a region of YKES2 where V-Rod 165 is located is expected to be about 500° C. (a rough estimation) or lower, when temperature of the Si-Crucible 130 can be as high as 1,500° C. At a temperature of about 500° C., the surface hardness of Molybdenum, Zirconia, alumina, and even stainless steel is not weakened. The V-Rod 165 and all surfaces which have direct contact with the V-Rod 165 are made of Molybdenum, stainless steel, Zirconia, or alumina. For these two reasons, any problems of friction between V-Rod 165 and surfaces of the vacuum chamber 110 are negligible. Therefore, a variety of mechanical gears such as no-lubrication rotors or gears can be used for rotation of the two units of R-Shielding 164. This is a unique and novel feature of YKES2.

The R-Shielding 164 of the T-Heater 160 and T-Steam 180 has different types of movements. Above, it is described how the circular movement of the two units of R-Shielding 164 on a horizontal circular track can control 'power of thermal radiation' (amount of energy transferred through thermal radiation per unit time) between the Si-Crucible 130 and the Ohmic heater 161 of the T-Heater 160 and also between the Si-Crucible 130 and the working-fluid of the T-Steam 180. However, the control 'mechanism' of power of thermal radiation is not limited to the control 'mechanism' facilitated by the two rotatable units of R-Shielding 164 as described above. For example, a single unit of R-Shielding 164 may be moved vertically up-and-down on a straight vertically track to control the power of radiation exchanged between the Si-Crucible 130 and the Ohmic heater 161 of the T-Heater 160, and/or between the Si-Crucible 130 and the working-fluid of the T-Stream 180, provided that the size of the single unit of R-Shielding 164 is large enough to 'block' thermal radiation between the Si-Crucible 130 and the T-Heater 160 and between the Si-Crucible 130 and the T-Steam 180 (when it is moved down to a location between the Ohmic heater 161 and the Si-Crucible 130, or between the heat exchange tank of T-Steam 180 and the Si-Crucible 130). In another example, two units of R-Shielding 164 may be rotated in opposite directions simultaneously on a single circular track that is horizontal and congruently curved with the layers of G-Shielding 166. But such rotations of two units of R-Shielding 164 would require complicated mechanical designs. The rotatable movement of the two units of R-Shielding 164 as described herein is the preferred design for YKES2.

Thermal radiation passes from the Si-Crucible 130 to the heat receiver (e.g., heat exchange tank) in the T-Steam 180. The structure of functional parts the T-Steam 180 is almost identical with that of the T-Heater 160, except that the thermal radiation occurs between the E-Storage 130 and a built-in heat receiver (e.g., a heat exchanger or a heat exchange tank in the T-Steam 180). The function of the T-Steam 180 is to send thermal radiation from the E-Storage 130 to the built-in heat receiver in T-Steam 180 to a working-fluid (e.g., to heat steam/water) in the heat exchange tank and properly adjust the rate of heat transfer from the E-Storage 130 to the steam/water in the heat exchange tank to control or adjust the temperature of outgoing steam.

The rate of the thermal radiation between the Ohmic heater 161 of the T-Heater 160 and the Si-Crucible 130 is controlled by simple rotations of the two units of R-Shielding 164. The thermal radiation from the Si-Crucible 130 to the heat exchange tank of the T-Steam 180 is controlled by the same rotation of the two units of R-Shielding 164 as described above in the context of the T-Heater 160. The only difference for T-Steam 180 is that the Ohmic heater 161 of the T-Heater 160 is replaced by a heat receiver (e.g., a heat exchange tank) that contains a working-fluid for T-Steam 180. Otherwise, the way that thermal radiation passes between the heat exchange tank of T-Steam 180 and the Si-Crucible 130 is controlled in the same as the way thermal radiation between the Ohmic heater 161 of T-Heater 160 and the Si-Crucible 130 is controlled.

The two units of R-Shielding 164 and B-Shielding 162 play unique and versatile functions in YKES2. Such key features and functions of the two units of the R-Shielding 164 and the B-Shielding 162 can be further described in reference to the two schematic graphics of FIGS. 23 and 24. The Si-Crucible 130, G-Shielding 120/166, and the wall of the vacuum chamber 110 are shown schematically, and the positions and orientations of the three parts of the T-Heater 160 and T-Steam 180 are also shown. In FIG. 23, a unit of T-Heater 160 is attached to the right side of the E-Storage 130 and a unit of T-Steam 180 is attached to the left side of the E-Storage 130. In both the T-Heater 160 and the T-Steam 180, the positions of the two units of R-Shielding 164 on their circular track and the fixed positions of B-Shielding 162 and the Ohmic heater 161 of T-Heater 160 and the heat exchange tank 181 of the T-Steam 180 are shown in FIG. 24.

FIG. 23 shows an arrangement in which the Ohmic heater 161 in T-Heater 160 can send a portion of its thermal radiation to E-Storage 130 without partial obstruction due to the partially 'open' positions of the two units of R-Shielding 164, while the heat exchange tank 181 of the T-Steam 180 can fully receive thermal radiation from E-Storage 130 due to the fully 'open positions of the two units of R-Shielding 184. FIG. 24 shows a different arrangement in which the Ohmic heater 161 of T-Heater 160 does not send its thermal radiation to E-Storage 130 because of the obstruction of the R-Shielding 164, while the thermal radiation from E-Storage 130 to the heat exchange tank 181 of T-Steam 180 is fully unobstructed. The example configurations of FIGS. 23 and 24 show the remarkable versatility of YKES2 as a new ESS. The T-Heater 160 and the T-Steam 180 of YKES2 can operate mutually independently for optimum performance of each of the T-Heater 160 and the T-Steam 180. This is a novel feature of YKES2 as a new ESS.

In some embodiments, YKES2 can also have benefits from having multiple units of T-Steam and/or T-Heater connected to one large E-Storage. Such benefits of YKES2 become greater when two or more units of T-Steam are attached to one large E-Storage. In some embodiments, one large E-Storage and one unit of T-Heater may be combined with two or more units of T-Steam. The rate of heating of the working-fluid in one unit of T-Steam can be controlled to heat the working-fluid in each heat exchange tank to a certain predetermined temperature. For example, water/steam in one unit of T-Steam may be heated to certain temperature that is optimal for a certain application of the outgoing steam, while the working-fluid in another unit of T-Steam may be heated to another optimally desired temperature. Since the rate of heating of steam/water in each unit of T-Steam can be controlled independently, a YKES2 of large capacity can heat steam/water or working-fluid in each unit of T-Steam independently and simultaneously for each of many units of T-Steam. One can imagine that one large centrally located YKES2 that heats a number of separate working-fluids in number of separate industrial processes at different temperatures at a large industrial plant complex. This kind of application of a large capacity YKES2 will significantly reduce or eliminate large scale consumption of energy from fossil fuels at a large industrial manufacturing or petrochemical complexes. As an example, FIGS. 25 and 26 show a 3D view of a YKES2 200 that has a large capacity of E-Storage, two units of T-Heaters 260, one for collection of energy from solar panels and another for collection of energy from wind turbines, and two units of T-Steam 280 to heat one industrial heating process at its optimal temperature of, say, 900° C., and another T-Steam 280 to heat another industrial process at its optimal temperature of, say, 500° C. FIGS. 27 and 28 show another example YKES2 300 of large capacity that has one large E-Storage and can have two units of T-Heater 360 and six units of T-Steams 380 (or any other combination of T-Heaters 360 and T-Steams 380). This YKES2 300 can be used, for example, to receive energy from solar panels and independently energy from wind turbines, while it can heat six different industrial heating processes at six different temperatures concurrently and independently for each industrial heating process of a large industrial plant.

The YKES2 described herein have a high degree of thermal insulation from the global multiple layers of Radiation Shielding (G-Shielding) 120/166/186.

The entire assembly of E-Storage 130, one or more units of T-Heater 160, and one or more units of T-Steam 180 are wrapped by multiple layers of radiation shielding metal sheets (G-Shielding) 120/166/186 in a vacuum chamber 110, except a few necessary openings which allow passages of electrical wires for the Ohmic heater 161, wires of measurements instruments, pipes of steam/water (or other work fluid) connected to heat exchange tanks, all of which pass through holes of each layer of G-Shielding 120/166/186. In some embodiments, the preferred vacuum level is between 10^^−3 and 10^^−4 Torr. The pressure level of the vacuum is sufficiently high enough to prevent volatilization of molten silicon and the various refractory shielding and crucible materials in use by YKES2. The pressure level is also sufficiently low to provide a dramatically reduced thermal conductivity of any remaining air or atmosphere in the vacuum chamber. Such vacuum levels are achievable in large containers.

As shown in FIGS. 29 and 30, the example YKES2 100 has one unit of E-Storage 130 at the center and one unit of T-Heater 160 and one unit of T-Steam 180 on opposite sides of E-Storage 130. The key parts of YKES2 100, e.g., the E-Storage 130, the T-Heater 160 and its components, and the T-Steam 180, and its accessary components such as electric wires, pipes of working-fluid, and most portions of V-Rod are enclosed in the vacuum chamber 110. FIG. 29 shows a schematic cross-section view of the YKES2 100 when it is cut in half horizontally by an imaginary horizontal plane. It shows only 5 layers of G-Shielding 120/166/186 for visual clarity. In reality, the G-Shielding 120/166/186 consists of about 10~15 inner layers of thermal radiation shielding sheets made of Molybdenum and about 10~15 outer layers of thermal radiation shielding sheets made of stainless steel. With such numbers of radiation-shielding layers in a vacuum, the loss of thermal energy from the Si-Crucible 130 can be reduced to a negligible level in YKES2 100.

FIG. 29 shows that there are 'small' gaps which divide each layer of G-Shielding into its three domains (120, 166, and 186). FIG. 30 shows a schematic top view of the horizontal surfaces of a layer of G-Shielding that is divided by two narrow gaps into the three domains of G-Shielding 120, 166, and 186. Other components such as the wall of the vacuum chamber 30 are not shown in FIG. 30 for clarity. Each layer of G-Shielding is divided into the three domains 120, 166, and 186 as shown in FIG. 30.

The first domain of G-Shielding 120 is a part of G-Shielding which surrounds the surface of the Si-Crucible 130 except its cylindrically concave surfaces which are open for exchange thermal radiation with the Ohmic heater 161 of T-Heater 160 and with the heat receiver (e.g., heat exchange tank) of T-Steam 180. The second domain of G-Shielding 166 is a part of G-Shielding which surrounds the surface of the T-Heater 160 except for the open region of the T-Heater 160 where the T-Heater 160 exchanges thermal radiation with the cylindrically concaved surfaces of the Si-Crucible 130. The third domain of G-Shielding is a part of G-Shielding 186 which surrounds the surface of the T-Steam 180 except for the open region of the T-Steam 180, where the T-Steam 180 exchanges thermal radiation with the cylindrically concaved surfaces of the Si-Crucible 130.

The three domains of G-Shielding 120, 166, and 186 are physically separated from each other with narrow gaps between the domains. The size of the narrow gaps is only a few millimeters. But these gaps are important. Due to the narrow gaps, a layer of G-Shielding is not contiguous. It is divided into the three domains. The first domain of G-Shielding 120 shields thermal radiation from Si-Crucible 130, the second domain of G-Shielding 166 shields thermal radiation from T-Heater 160, and the third domain of G-Shielding 186 shields thermal radiation from T-Steam 180. Obviously, the thermal radiation from T-Heater 160 and T-Steam 180 are weaker than the thermal radiation from Si-Crucible 130, since the temperature of the Si-Crucible 130 is much higher than the temperatures of T-Heater 160 or T-Steam 180.

If the layers of G-Shielding are not physically divided by the narrow gaps, there will be heat conduction from the first domain of G-Shielding 120 to the second domain of G-Shielding 166 and also to the third domain of G-Shielding 186. For example, there will be heat conduction from the $10^{th}$ layer of the first domain of G-Shielding 120 to the $10^{th}$ layer of the second domain of G-Shielding 166, and also to the $10^{th}$ layer of the third domain of G-Shielding 186, if there were no gaps which divide the $10^{th}$ layer of G-Shielding into three domains 120, 166, and 186. This applies to any layer of the G-Shielding 120, 166, and 186.

The power of thermal radiation is proportional to the fourth power of the absolute temperature of a solid object. Therefore, it is important that the layers of the second domain of G-Shielding 166 and the layers of the third domain of G-Shielding 186 are not heated to higher temperatures by heat conduction from the first domain of G-Shielding 120. The presence of the narrow gaps (physical separations) between the three different domains of G-Shielding 120, 166, and 186 prevent heat conduction from the hotter first domain of G-Shielding 120 to the cooler second 166 and third 186 domains of G-Shielding. Incorporation of the narrow gaps in each layer of G-Shielding 120, 166, and 186 is a novel feature of YKES2.

The YKES2 described herein utilize measures resulting in vigorous minimization of losses of thermal energy from the Si-Crucible 130 through heat conduction via material-to-material contacts of supportive structure of the Si-Crucible 130 and the G-Shielding 120, 166, and 186. There is non-radiative heat conduction from the Si-Crucible 130 to the wall of vacuum chamber 110 through material-to-material contacts of support structures that support the structural integrity and weight of the Si-Crucible 130 and the weight of all layers of G-Shielding 120, 166, and 186. YKES2 employs novel designs which reduce to a negligible level the losses of thermal energy from the Si-Crucible 130 through this unavoidable heat conduction. The novel designs and its physical embodiments are described in the following.

The Si-Crucible 130 is enclosed by the G-Shielding 120 in a vacuum chamber 110 that gradually cools due to two channels of loss of thermal energy from the Si-Crucible 130. Convective heat losses of the YKES2 are entirely negligible since the vacuum in the vacuum chamber 110 of YKES2 is strong enough. One channel is thermal radiation from the Si-Crucible 130, and the other is heat conduction through physical material-to-material contacts of its support structures. The loss of thermal energy from the Si-Crucible 130 due to thermal radiation can be minimized to a negligible level by applying G-Shielding 120, 166, and 186 in a vacuum chamber 110. The provisions of YKES2 to prevent or minimize such radiative losses are thoroughly described herein.

The other channel is the loss of thermal energy from the Si-Crucible 130 through heat conduction via material-to-material contacts of the YKES2 support structures of the Si-Crucible 130 and with each layer of G-Shielding 120, 166, and 186. The Si-Crucible 130, and the G-Shielding 120, 166, and 186 cannot be levitated in the middle of a vacuum chamber. In the real world, the Si-Crucible 130 and the G-Shielding 120, 166, and 186 which enclose the Si-Crucible 130 must be supported by certain physical structures (scaffolds) which hold and support the Si-Crucible 130 and the G-Shielding 120, 166, and 186 in the middle of empty space of the vacuum chamber 110. The structures that support the Si-Crucible 130 and the G-Shielding 120, 166, and 186 have direct material-to-material contacts with the Si-Crucible 130 and with each layer of the G-Shielding 120, 166, and 186. Therefore, there is the natural potential for heat conduction from the Si-Crucible 130 to the outside via many routes of material-to-material contact of the support structures of the Si-Crucible 130 and each layer of G-Shielding 120, 166, and 186. Some loss of thermal energy from the Si-Crucible 130 due to this heat conduction is unavoidable. But it is minimized to a negligible level in YKES2. This is accomplished as described immediately below.

In YKES2, the support structures are provided by a stack of specially shaped solid objects made of a thermally insulative material such as Zirconia. The specially shaped Zirconia pieces become components of an assembled stack of Zirconia pieces.

FIGS. 31-34 shows 3D views of four differently shaped pieces of solid Zirconia. The four differently shaped Zirconia pieces can be mutually interlocked to become effectively one piece of Zirconia block. FIGS. 35 and 36 show a 3D view of an assembly of interlocking Zirconia pieces and a side view of the assembly (also referred to as a stack). There is a '+' shaped groove on the top surface of the assembly of Zirconia pieces, and another '+' shaped groove on the bottom surface of the assembly. The '+' shaped grooves on the top and bottom surfaces are special features of the assembly of the interlocked Zirconia pieces which allow an assembly of interlocked Zirconia pieces to interlock with a 'cross-intersection' of a horizontal skeletal structure of bottom layer of G-Shielding, as described further herein. How an assembly of Zirconia pieces and a 'cross-intersection' of horizontal skeletal structure of bottom layer of G-Shielding interlock will be described in the next subsection. An assembly of interlocked Zirconia pieces shown in FIGS. 35 and 36 can also be referred to as a 'Zirconia Block' for convenience.

YKES2 includes skeletal structures or frameworks made with inter-connected rods and beams of Molybdenum and stainless steel to hold and support the Si-Crucible 130 and each layer of G-Shielding 120, 166, and 186. Each layer of G-Shielding 120, 166, and 186 is created when a 3D skeleton of interconnected rods and beams is wrapped by thin sheets of Molybdenum or thin sheets of stainless-steel. Vertical components of the skeletal structure are referred to herein as 'rods', and horizontal components of the skeletal structure are referred to herein as 'beams' for convenience.

FIG. 37 shows a 3D view of an example skeletal structure 122 of interconnected rods and beams. This skeletal structure 122 shown is before radiation shielding sheets of Molybdenum or Stainless Steel are attached to it. FIG. 38 shows the skeletal structure 122 with some portions of a layer of G-Shielding 120, 166, and 186 attached thereto. This is a 3D view of a layer of G-Shielding 120, 166, and 186. In FIG. 38, some portions of the contiguously covered surface with thin sheets of Molybdenum or Stainless Steel are shown without the sheets purposely to convey an understanding of the construction of a layer of the G-Shielding 120, 166, and 186.

FIG. 39 shows a schematic 2D top view of a bottom horizontal skeletal structure 122 of cross-intersecting beams. The two mutually cross-intersecting beams creates a '+' shaped cross-intersecting beams. Numerous locations of Zirconia Blocks 190 at the bottom horizontal skeletal structure of a layer of G-Shielding 120, 166, and 186 are shown. FIG. 40 shows a detailed 3D view of one Zirconia Block 190 that is mechanically interlocked with a cross-intersecting horizontal beams at top surface of the Zirconia Block 190 and with a cross-intersecting horizontal beams at bottom surface of the Zirconia Block 190. FIG. 41 shows a detailed 2D side of the same Zirconia Block 190 and the same two cross-intersecting horizontal beams.

FIG. 42 shows a 3D view of three consecutive neighboring horizontal skeletal structures 122 of three consecutive layers of G-Shielding 120, 166, and 186. FIG. 42 also shows numerous vertical columns of Zirconia Blocks 190 at many cross-intersecting of the horizontal beams. FIG. 43 shows a portion of FIG. 42 with more details of the vertical columns of Zirconia Blocks 190 across three horizontal skeletal structures of beams. There are three units of Zirconia Blocks 190 shown in each vertical column of Zirconia Blocks 190. The vertical columns of Zirconia Blocks 190 are mechanically interlocked with the three layers of the horizontal skeletal structures 122 of three layers of G-Shielding 120, 166, and 186.

FIG. 44 shows a 3D view of a Si-Crucible 130 and G-Shielding 120 with a vertical cut-plane. FIG. 45 shows when the Si-Crucible 130 and G-Shielding 120 are cut in half vertically along the cut-plane. Gaps between layers of G-Shielding 120 in FIG. 45 are exaggerated for visual clarity. It shows only three vertical columns of Zirconia Blocks 190 which support weight of Si-Crucible 130 and the weight of the layers of G-Shielding 120 for visual clarity. In a real YKES2, there can be about 20~30 vertical columns of Zirconia Blocks 190 which support the weight of the Si-Crucible 130 and weight of 20~30 layers of G-Shielding 120. It is clear from FIG. 45 that all routes of heat conduction from the Si-Crucible 130, all the way down, to inner wall of vacuum chamber 110 must pass through the vertical columns of Zirconia Blocks 190.

A key point regarding the Zirconia Blocks 190 is that heat conduction across two separate hard surfaces in contact with each other is much lower than the heat conduction in a continuous body of the material. Heat conductivity between two hard contact surfaces of Zirconia pieces is about 30~50 times lower than heat conductivity in solid, uninterrupted Zirconia. A Zirconia Block 190 contains several pairs of contact surfaces of the hard, stacked Zirconia pieces. This means that the heat conductivity from an end surface to opposite end surface of a Zirconia Block 190 will be a few hundred times less than the heat conductivity of a single solid piece of Zirconia that has identical shape and size of the stacked Zirconia Block 190.

FIG. 45 clearly shows schematically that all physical paths (physical routes) of heat conduction from the Si-Crucible 130 to the innermost layer of G-Shielding 120 and from the inner most layer of G-Shielding 120 all the way to the wall of the vacuum chamber 110 go through the numerous Zirconia Blocks 190. The Zirconia Blocks 190 incorporated into/between layers of the G-Shielding 120 become critical 'bottle necks' of heat conduction from the Si-Crucible 130, all the way down to the wall of vacuum chamber 110. Since a Zirconia Block 190 may comprise 5 or more stacked individual pieces of Zirconia, the loss of thermal energy of Si-Crucible 130 because of heat conduction will be lowered to a negligible level. This is a unique and novel feature of the Zirconia Blocks 190 of the YKES2.

The Zirconia Blocks 190 also act as weight supports for the Si-Crucible 130 and for all layers of G-Shielding 120, 166, and 186.

FIG. 39 shows the horizontal cross-intersecting beams of a bottom layer of G-Shielding 120, 166, and 186. It shows numerous locations of Zirconia Blocks 190 at the cross-intersections of the horizontal beams. FIG. 45 shows vertical columns of Zirconia Blocks 190 which are placed between two neighboring bottom layers of G-Shielding 120. All Zirconia Blocks 190 between all pairs of neighboring layers of G-Shielding 120, 166, and 186 are vertically aligned. The vertical alignment of the Zirconia Blocks 190 is very important, since the vertically aligned columns of Zirconia Blocks 190 enable the Zirconia Blocks 190 to support the weight of the heavy Si-Crucible 130 and weight of all layers of G-Shielding 120, 166, and 186.

One cubic meter of silicon weighs about 2,300 kg. The total weight of the Si-Crucible 130 and the weight of all layers of G-Shielding 120, 166, and 186 are supported by a plurality of such columns of vertically aligned Zirconia Blocks 190. The number of such vertical columns of Zirconia Blocks 190 and their locations depend on the total mass of the Si-Crucible 130, the height of the Si-Crucible 130, the weight distribution of the Si-Crucible 130 and other design factors. The horizontal layers of G-Shielding 120, 166, and 186 between the Zirconia Blocks 190 are not subject to any mechanical stress of bending or twisting, except stresses of compression. Calcium stabilized Zirconia is the preferred form of Zirconia, since calcium stabilized Zirconia and Molybdenum are very strong against compression even at temperature range of 1,500° C. The concepts regarding the vertical columns of Zirconia Blocks 190 are another novel feature of YKES2.

The use of Zirconia Blocks 190 can drastically reduce heat conduction from the Si-Crucible 130, via many routes, to the inner wall of the vacuum chamber 110 to a negligible level. The same Zirconia Blocks 190 provide strong structural support for the heavy weight of the Si-Crucible 130 and the weight of all layers of G-Shielding 120, 166, and 186.

There are many varieties or configurations of YKES2 envisioned and within the scope of this disclosure. That is, the YKES2 and its unique and novel ideas and physical embodiments are not limited to the specific configurations and 'architectures' of as described in the previous sections. Additional varieties for the geometry and architecture of YKES2 for large scale multi-functional versions of YKES2 are described in this section.

The cross-sectional shape of the E-Storage may be polygonal. The 3D shapes of E-Storage described above are circular cylinders. However, YKES2 is not limited to E-Storage in the form of circular cylinders. The 3D shape of an E-Storage may be polygonal cylinders, that is, tubes of polygonal cross sections. For example, FIGS. 46 and 47 show a 3D view of YKES2 with hexagonally shaped E-Storage, and a schematic 2D top view of the YKES2 when it is cut in half horizontally. FIGS. 48 and 49 show a 3D view of a YKES2 with rectangularly shaped E-Storage with one unit of T-Heater and one unit of T-Steam are lying on top flat surface of the E-Storage and a schematic 2D view of this type of YKES2 when it is vertically cut in half. The 3D shapes of E-Storage are not limited to the configurations shown in FIGS. 46-49.

The YKES2 can be scaled to include multiple units of T-Heater and T-Steam. There is a great benefit of scaled-up large capacity YKES2. One large E-Storage may be connected to multiple units of T-Heater and T-Steam. In this way, YKES2 can receive energy from solar panels at one unit of T-Heater and, at the same time, can also receive energy from wind turbines at another T-Heater. Both units of T-Heater may receive energy from solar panels or from wind turbines concurrently or independently. An YKES2 with one unit of E-Storage, two units of T-Heater, and multiple units of T-Steam can be quite useful for many industrial heating applications. Multiple units of T-Steam attached to a single unit of E-Storage can heat different work fluids at different temperatures for different industrial heating reactors. Several units of T-Steam can supply thermal energy, concurrently or independently, to several different industrial heating reactors at different temperatures. For example, FIGS. 27 and 28 show a 3D view of a YKES2 300 with a collection of eight units of T-Heater 360 and T-Steam 380 which are attached vertical wall of the large E-Storage 330, and a schematic 2D top view of the YKES2 300 when it is cut in half horizontally. The E-Storage 330 of this YKES2 300 receives thermal radiation of energy from one or more units of T-Heater 360 which is heated by electric current from solar panels or wind turbines through the single unit of T-Heater 360 and at the same time, the E-Storage 330 of this YKES2 300 can send its thermal radiation to several separate heat exchange tanks of different unit of T-Steam 380 to heat working-fluid in each heat exchange tank of each T-Steam 380 at differently optimized temperatures. This capability of large scale YKES2 300 will be very useful to many industrial heating processes of steel mills, cement factories, and large petrochemical plants. Currently, such factories and plants use huge amount of heat generated by conventional burning of fossil fuels, with huge amount of carbon dioxides discharged into the atmosphere.

Applications of YKES2 for industrial heating processes has one huge benefit for conservation of energy. For industrial heating processes, the thermal energy stored in the Si-Crucible is not converted into electricity through steam turbines and electricity generators. Such conversion of thermal energy into electricity suffers unavoidable loss of about 60% or more of the thermal energy of the Si-Crucible due to fundamental laws of thermodynamics. Thermodynamic efficiency of YKES2 for industrial heating processes should be far higher than 60%. It could be as high as 90%, if working-fluid that moves through pipes is thermally well insulated.

The extreme thermal insulation of large scale YKES2 provides economies. The efficiency of the thermal insulation of YKES2 improves when the size of the G-Shielding of YKES2 is larger. The volume of silicon, and therefore the amount of energy stored, scales as the cubic power of the linear dimension of it, while the surface area of the Si-Crucible scales as the quadratic power of the linear dimension of it. The rate of loss of thermal energy of the Si-Crucible through thermal radiation is proportional to surface area of it. When YKES2 is large, more than 30 layers of radiation shielding sheets of Molybdenum and stainless steel can be used. Only about 10 of the inner most layers of G-Shielding may use Molybdenum sheets. The rest of 30 or more layers of G-Shielding can be made with sheets of much cheaper stainless steel. The YKES2 100 described above has one Thermal Energy Storage Tank (E-Storage) at its center and one unit of T-Heater (receiver of solar and/or wind energy) and one unit of T-Steam (heat exchange unit). FIGS. 25-28 show YKES2 200 and YKES2 300 having different energy storage capacities and geometric structures of the T-Heater and T-Steam units which are clustered around E-Storage. These are other example configurations of YKES2. Other configurations of YKES2 are also envisioned and within the scope of this disclosure.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described herein as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various modules and components in the embodiments described herein should not be understood as requiring such separation in all embodiments, and it should be understood that the described components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multi-tasking and parallel processing may be advantageous.

What is claimed is:

1. An energy storage system comprising:

a vacuum chamber;

a container located within the vacuum chamber;

a thermal energy storage medium located within the container;

a heater located within the vacuum chamber;

a heat receiver located within the vacuum chamber;

a first radiation shield that is movably reconfigurable between: (i) a first position that separates the heater from the container and (ii) a second position in which the heater is exposed to the container;

a second radiation shield that is movably reconfigurable between: (i) a first position that separates the heat receiver from the container and (ii) a second position in which the container is exposed to the heat receiver; and a first thermal radiation reflector, wherein the heater is located between the first thermal radiation reflector and the container.

2. The energy storage system of claim 1, further comprising thermal radiation shielding located between an inner wall of the vacuum chamber and the container.

3. The energy storage system of claim 2, wherein the thermal radiation shielding is also located between the inner wall of the vacuum chamber and the heater.

4. The energy storage system of claim 2, wherein the thermal radiation shielding is also located between the inner wall of the vacuum chamber and the heat receiver.

5. The energy storage system of claim 2, wherein the thermal radiation shielding comprises multiple layers of sheet material that are spaced apart from each other.

6. The energy storage system of claim 1, further comprising a second thermal radiation reflector, wherein the heat receiver is located between the second thermal radiation reflector and the container.

7. The energy storage system of claim 1, further comprising one or more support members disposed between a bottom of the container and a bottom inner wall of the vacuum chamber, wherein the support members elevate and separate the container from the bottom inner wall of the vacuum chamber.

8. The energy storage system of claim 7, wherein each one of the one or more support members comprises multiple pieces of thermal insulating material in a stacked arrangement.

9. The energy storage system of claim 8, wherein the thermal insulating material comprises zirconia.

10. The energy storage system of claim 7, further comprising thermal radiation shielding located between an inner bottom wall of the vacuum chamber and the container.

11. The energy storage system of claim 1, wherein the thermal energy storage medium comprises silicon.

12. The energy storage system of claim 1, wherein the heater comprises a resistive heating element.

13. The energy storage system of claim 1, wherein the heater and the heat receiver are each spaced apart from the container.

14. The energy storage system of claim 1, further comprising a first actuator coupled to the first radiation shield and operative to move the first radiation shield between: (i) the first position that separates the heater from the container and (ii) the second position in which the heater is exposed to the container.

15. The energy storage system of claim 1, further comprising a second actuator coupled to the second radiation shield and operative to move the second radiation shield between: (i) the first position that separates the heat receiver from the container and (ii) the second position in which the container is exposed to the heat receiver.

16. An energy storage system comprising:

a vacuum chamber;

a container located within the vacuum chamber;

a thermal energy storage medium located within an interior of the container;

a heater located within the vacuum chamber and spaced apart from the container;

a heat receiver located within the vacuum chamber and spaced apart from the container; and a protrusion extending from an inner wall of the container and in contact with the thermal energy storage medium.

17. The energy storage system of claim 16, wherein the protrusion is a pyramid structure.

18. The energy storage system of claim 16, wherein a volume of the protrusion is at least 10% of a volume of the interior of the container.

19. The energy storage system of claim 16, further comprising multiple layers of thermal radiation shielding surrounding the container and within the vacuum chamber.

20. An energy storage system comprising:

a vacuum chamber;

a container located within the vacuum chamber;

a thermal energy storage medium located within the container;

a heater located within the vacuum chamber;

a heat receiver located within the vacuum chamber;

a first radiation shield that is movably reconfigurable between: (i) a first position that separates the heater from the container and (ii) a second position in which the heater is exposed to the container; and a second radiation shield that is movably reconfigurable between: (i) a first position that separates the heat receiver from the container and (ii) a second position in which the container is exposed to the heat receiver, wherein the heater and the heat receiver are each spaced apart from the container.

21. The energy storage system of claim 20, further comprising one or more support members disposed between a bottom of the container and a bottom inner wall of the vacuum chamber, wherein the support members elevate and separate the container from the bottom inner wall of the vacuum chamber.

22. The energy storage system of claim 21, wherein each one of the one or more support members comprises multiple pieces of thermal insulating material in a stacked arrangement.

23. The energy storage system of claim 20, wherein the thermal energy storage medium comprises silicon.

* * * * *